US010551101B2

(12) United States Patent
Takeichi et al.

(10) Patent No.: US 10,551,101 B2
(45) Date of Patent: Feb. 4, 2020

(54) AIR CONDITIONER AND CONTROL METHOD THEREOF FOR DETERMINING AN AMOUNT OF REFRIGERANT

(71) Applicant: SAMSUNG ELECTRONICS CO., LTD., Suwon-si, Gyeonggi-do (KR)

(72) Inventors: Hisashi Takeichi, Yokohama (JP); Hiroaki Eguchi, Yokohama (JP); Tetsuya Ogasawara, Yokohama (JP); Kenichi Yamada, Yokohama (JP); Masahiro Aono, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 307 days.

(21) Appl. No.: 15/508,754

(22) PCT Filed: Sep. 3, 2015

(86) PCT No.: PCT/KR2015/009327
§ 371 (c)(1),
(2) Date: Mar. 3, 2017

(87) PCT Pub. No.: WO2016/036176
PCT Pub. Date: Mar. 10, 2016

(65) Prior Publication Data

US 2017/0276413 A1 Sep. 28, 2017

(30) Foreign Application Priority Data

Aug. 18, 2015 (JP) ..... 2015-161149

(51) Int. Cl.
*F25B 45/00* (2006.01)
*F25B 41/04* (2006.01)
(Continued)

(52) U.S. Cl.
CPC ..... *F25B 41/043* (2013.01); *F25B 45/00* (2013.01); *F25B 49/022* (2013.01);
(Continued)

(58) Field of Classification Search
CPC .. F25B 41/043; F25B 45/00; F25B 2345/001; F25B 2345/002; F25B 2345/003; F25B 2700/04
See application file for complete search history.

(56) References Cited

U.S. PATENT DOCUMENTS 5,784,892 A * 7/1998 Reedy ..... F25B 13/00 62/174
5,802,860 A * 9/1998 Barrows ..... F25B 41/04 62/126
(Continued)

FOREIGN PATENT DOCUMENTS

JP 2008-23579 10/2008
JP 2010-007993 1/2010
(Continued)

OTHER PUBLICATIONS

Partial European Search Report dated Jul. 4, 2017 in corresponding European Patent Application No. 15838951.0, 13 pages.
(Continued)

*Primary Examiner* — Jonathan Bradford
(74) *Attorney, Agent, or Firm* — Staas & Halsey LLP

(57) ABSTRACT

An air conditioner may prevent a refrigerant stored in a refrigerant storage from rapidly flowing into a main refrigerant circuit when the type of operation is switched. The air conditioner may include a refrigerant circuit provided with a compressor, a condenser, an expansion valve and an evaporator; a refrigerant amount detection device configured to determine whether a refrigerant state in an outlet of the compressor is a subcooled state or a gas-liquid two phase
(Continued)

state. The refrigerant amount detection device is configured to calculate a refrigerant amount ratio in the refrigerant circuit based on a predetermined set value according to at least one of a temperature and a pressure detected and the refrigerant state; and a controller configured to control the refrigerant circuit according to the refrigerant amount ratio calculated by the refrigerant amount detection device.

20 Claims, 38 Drawing Sheets

(51) Int. Cl.
*F25B 49/02* (2006.01)
*F25B 13/00* (2006.01)

(52) U.S. Cl.
CPC ..... *F25B 49/027* (2013.01); *F25B 13/00* (2013.01); *F25B 2500/19* (2013.01); *F25B 2700/04* (2013.01)

(56) References Cited

U.S. PATENT DOCUMENTS

2009/0044550 A1* 2/2009 Nishimura ..... F25B 49/005 62/149
2010/0300129 A1* 12/2010 Bean, Jr. ..... F25B 49/005 62/129
2012/0192579 A1* 8/2012 Huff ..... B60H 1/3232 62/115

FOREIGN PATENT DOCUMENTS

JP 2010-127586 6/2010
JP 2012-132601 7/2012
KR 10-2008-0081942 9/2008

OTHER PUBLICATIONS

Extended European Search Report dated Oct. 16, 2017 in corresponding European Patent Application No. 15838951.0.
International Search Report dated Dec. 15, 2015 in corresponding International Application No. PCT/KR2015/009327.
International Written Opinion dated Dec. 15, 2015 in corresponding International Application No. PCT/KR2015/009327.
European Communication dated May 31, 2018 in European Patent Application No. 15838951.0.
European Office Action dated Feb. 5, 2019 in European Patent Application No. 15838951.0.

* cited by examiner

AIR CONDITIONER AND CONTROL METHOD THEREOF FOR DETERMINING AN AMOUNT OF REFRIGERANT

CROSS-REFERENCE TO RELATED APPLICATION

This application is a U.S. national stage application, which claims the benefit under 35 USC § 371 of PCT International Patent Application No PCT/KR2015/009327, filed on Sep. 3, 2015 which claims foreign priority benefit under 35 USC § 119 of Japanese Patent Application No. 2014-179372, filed on Sep. 3, 2014; Japanese Patent Application No. 2014-223569, filed on Oct. 31, 2014; Japanese Patent Application No. 2014-256083, filed on Dec. 18, 2014; Japanese Patent Application No. 2015-126229, filed on Jun. 24, 2015; Japanese Patent Application No. 2015-134148, filed on Jul. 3, 2015; Japanese Patent Application No. 2015-161148, filed on Aug. 18, 2015; Japanese Patent Application No. 2015-161149, filed on Aug. 18, 2015; Japanese Patent Application No. 2015-167170, filed on Aug. 26, 2015; Korean Patent Application No. 10-2015-0125162, filed on Sep. 3, 2015 the entire contents of which are incorporated herein by reference.

TECHNICAL FIELD

Embodiments of the present disclosure relate to an air conditioner configured to detect an amount of refrigerant.

BACKGROUND ART

An Air conditioner may include a main refrigerant circuit in which a compressor, a four-way switching valve, an outdoor heat exchanger, a main pressure-reducing valve and an indoor heat exchanger are connected in order, or a refrigeration cycle in which refrigerant is circulated. In a convention manner, the air conditioner performs the air conditioning operation e.g., a cooling operation and a heating operation, by switching a circulation direction of the refrigerant by the four-way switching valve.

However, as for the air conditioner, since the capacity of outdoor heat exchanger and the capacity of the indoor heat exchanger are different, the amount of refrigerant required for the main refrigerant circuit may vary according to the type of the air conditioning operation. Therefore, to improve the system efficiency, it may be required for the air conditioner to perform each operation with the optimized amount of refrigerant according to the type of the operation.

For this, the air conditioner has a refrigerant storage to store a surplus refrigerant. As for the air conditioner having the refrigerant storage, when the air conditioner performs an operation, in which a small amount refrigerant is needed for the main refrigerant circuit, the air conditioner may store the surplus refrigerant in the refrigerant storage. In addition, when performing an operation, in which a large amount refrigerant is needed for the main refrigerant circuit, the air conditioner may supply the refrigerant stored in the refrigerant storage to the main refrigerant circuit.

Patent document 1 discloses a refrigeration system apparatus in which a compressor, a condenser and an evaporator are installed and a receiver tank is installed between the condenser and the evaporator. Further, the patent document 1 discloses that a surplus refrigerant is collected in the receiver tank and then the refrigerant is supplied to a refrigeration cycle from the receiver tank according to the operation condition of the refrigeration system apparatus.

Patent Document 1 is disclosed in Japanese Patent Laid-Open Publication No. 10-89780.

DISCLOSURE

Technical Problem

Therefore, it is an aspect of the present disclosure to provide an air conditioner capable of preventing a refrigerant stored in a refrigerant storage from rapidly flowing into a main refrigerant circuit when the type of operation is switched, and a control method thereof.

Technical Solution

In accordance with one aspect of the present disclosure, an air conditioner may include a refrigerant circuit provided with a compressor, a condenser, an expansion valve and an evaporator; a refrigerant amount detection device configured to determine whether a refrigerant state in an outlet of the compressor is a subcooled state or a gas-liquid two phase state, and configured to calculate a refrigerant amount ratio in the refrigerant circuit, based on a predetermined set value according to at least one of a temperature and a pressure detected in the refrigerant circuit, and the refrigerant state; and a controller configured to control the refrigerant circuit according to the refrigerant amount ratio calculated by the refrigerant amount detection device.

The refrigerant detection device may calculate an average value of the refrigerant amount ratio based on the calculated refrigerant amount ratio.

The refrigerant circuit may further include a first temperature sensor configured to detect a first refrigerant temperature in the outlet of the condenser and a second temperature sensor configured to detect a second refrigerant temperature in the downstream of a fluid resistance installed in the outlet side of the condenser, wherein the refrigerant detection device determines whether the refrigerant is in the subcooled state or the gas-liquid two phase state based on the first refrigerant temperature and the second refrigerant temperature.

The refrigerant circuit may further include a sub-cooler provided between the condenser and the expansion valve and configured to cool a liquid refrigerant generated in the condenser.

The controller may allow at least one of the compressors, the condenser, the expansion valve, the evaporator and the sub-cooler to be constantly operated according to the control of the refrigerant amount detection device.

The refrigerant circuit may further include a refrigerant storage container configured to store a charging refrigerant and a refrigerant injection valve configured to control the refrigerant supplied from the refrigerant storage container, wherein the controller controls the refrigerant injection valve when the average value of refrigerant amount ratio reaches 100%, during charging the refrigerant.

The refrigerant circuit may further include a receiver configured to store a surplus refrigerant present in the refrigerant circuit, as the subcooled state; and a flow controller configured to reduce the pressure of a refrigerant discharged from the receiver while adjusting a flow rate of the refrigerant.

The refrigerant may include a non-azeotropic mixed refrigerant containing refrigerant R32 and HFO1234yf or HFO1234ze.

The non-azeotropic mixed refrigerant may be characterized in that HFC content is less than 70% by weight, HFO1234yf or HFO1234ze content is less than 30% by weight, and the remainder is a natural refrigerant.

A volume of the receiver may be equal to a volume obtained by converting an amount of refrigerant obtained by subtracting an amount of refrigerant at the time of a cooling operation, from an amount of refrigerant at the time of a heating operation, into a subcooled liquid state.

The refrigerant circuit may further include a subcooler configured to subcool a main refrigerant by performing a heat exchange between the main refrigerant condensed by the evaporator or the condenser and a classified refrigerant classified from the main refrigerant and decompressed by a subcooling pressure-reducing valve.

The receiver may further include at least one refrigerant amount detector configured to detect an amount of refrigerant in the receiver The air conditioner may further include an auxiliary unit configured to connect an outdoor unit provided with the compressor and the condenser, to an indoor unit provided with the evaporator, detachably attached to a pipe of the refrigerant circuit, and provided with the refrigerant amount detector.

The auxiliary unit may further include a refrigerant injection valve configured to control a refrigerant pipe of the auxiliary unit when the calculated refrigerant amount ratio reaches 100% during charging the refrigerant to the refrigerant circuit.

The auxiliary unit may further include a refrigerant storage container configured to store a charging refrigerant and a refrigerant injection valve configured to control the refrigerant supplied from the refrigerant storage container, wherein the controller controls the refrigerant injection valve when an average value of refrigerant amount ratio reaches 100%, during charging the refrigerant.

The auxiliary unit may further include an auxiliary heat exchanger configured to perform a heat exchange with an external heat source device except for the air conditioner.

The auxiliary unit may further include a receiver configured to store a surplus refrigerant present in a pipe of the auxiliary unit, as the subcooled state; and a flow controller configured to reduce the pressure of the refrigerant discharged from the receiver while adjusting a flow rate of the refrigerant, a receiver configured to store a surplus refrigerant present in a pipe of the auxiliary unit, as the subcooled state; and a flow controller configured to reduce the pressure of the refrigerant discharged from the receiver while adjusting a flow rate of the refrigerant.

In accordance with another aspect of the present disclosure, a control method of air conditioner including a refrigerant circuit including a compressor, a condenser, an expansion valve and an evaporator, may include determining whether a refrigerant state in an outlet of the compressor is in a subcooled state or a gas-liquid two phase state; calculating a refrigerant amount ratio in the refrigerant circuit, based on a predetermined set value according to at least one of a temperature and a pressure detected in the refrigerant circuit, and the refrigerant state; and controlling the refrigerant circuit based on the refrigerant amount ratio.

The method may further include calculating an average value of the refrigerant amount ratio based on the calculated refrigerant amount ratio.

The refrigerant circuit may further include a first temperature sensor configured to detect a first refrigerant temperature in the outlet of the condenser and a second temperature sensor configured to detect a second refrigerant temperature in the downstream of a fluid resistance installed in the outlet side of the condenser, wherein the determining may include determining whether the refrigerant states is in the subcooled state or the gas-liquid two phase state based on the first refrigerant temperature and the second refrigerant temperature.

Advantageous Effects

In accordance with one aspect of the present disclosure, it may be possible to prevent a refrigerant stored in a refrigerant storage from rapidly flowing into a main refrigerant circuit when the type of operation is switched.

DESCRIPTION OF DRAWINGS

These and/or other aspects of the present disclosure will become apparent and more readily appreciated from the following description of the embodiments, taken in conjunction with the accompanying drawings of which.

BEST MODE

A First Embodiment

The first embodiment of the present disclosure will be described with reference to the drawings.

Figure 1:
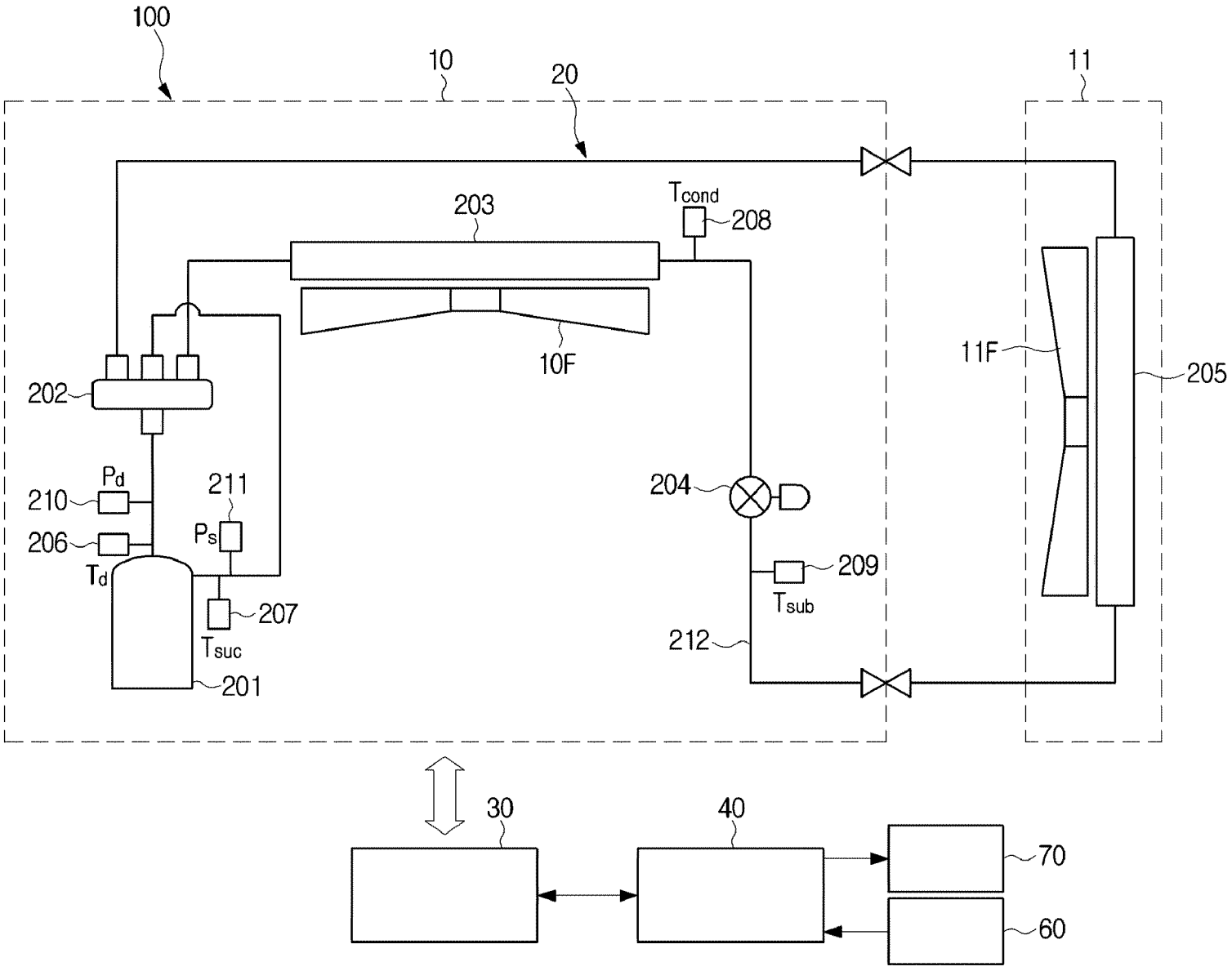
FIG. 1 is a schematic diagram illustrating a configuration of an air conditioner according to a first embodiment.

As illustrated in FIG. 1, according to the first embodiment, an air conditioner 100 may include an outdoor unit 10 installed outdoors of a building; an indoor unit 11 installed inside of the building; a refrigerant circuit 20 configured by connecting the outdoor unit 10 and the indoor unit 11 to a refrigerant pipe; an air conditioner controller 30 configured to perform an air conditioning operation by controlling the outdoor unit 10 and the indoor unit 11; and a refrigerant amount detection device 40 configured to detect the refrigerant amount in the refrigerant circuit. Hereinafter, the air conditioner 100 performing a cooling operation will be described.

The refrigerant circuit 20 may be formed by connecting a compressor 201, a four-way switching valve 202, a condenser (outdoor heat exchanger) 203, a first expansion valve 204, and an evaporator (indoor heat exchanger) 205. According to the first embodiment, the compressor 201, the four-way switching valve 202, the condenser 203, and the first expansion valve 204 may be installed inside the outdoor unit 10, and the evaporator 205 may be installed inside of the indoor unit 11. Meanwhile, the outdoor unit 10 may compress a refrigerant vaporized in the evaporator 205 and then cool the compressed refrigerant. Further, the indoor unit 11 may perform a heat exchange between room air and the refrigerant in the evaporator 205, and cool the room air while vaporizing the refrigerant.

The compressor 201 may generate a high-temperature and a high-pressure compressed gas by compressing the vaporized refrigerant gas flowing from an inlet of the low pressure side. The compressor 201 may be driven by a motor capable of controlling the rotational speed, and thus the compression performance may be changed in accordance with the rotational speed of the motor. That is, when the rotational speed of the motor is high, the compression performance may be high, and when the rotational speed of the motor is low, the compression performance may be low. The compressor 201 may control the rotational speed of the motor by a compressor controller 301, described later. The compressor 201 may send the generated high-temperature and high-pressure compressed gas to the condenser 203 through the four-way switching valve 202.

The condenser 203 may condense the compressed gas, which is generated by the compressor 201, through the heat exchanger. The condenser 203 may perform the heat exchange between the high temperature compressed gas and the low temperature outdoor air, and then generate a liquid refrigerant. The condenser 203 may send the liquid refrigerant generated by the heat exchange, to the first expansion valve 204.

The first expansion valve 204 may be a valve configured to adjust a flow rate flowing therethrough by opening or closing thereof. The first expansion valve 204 may be opened and closed by a first expansion valve controller 302. When the first expansion valve 204 is opened, the liquid refrigerant may expand and vaporize and then become refrigerant gas. This refrigerant gas has a lower temperature than the liquid refrigerant before flowing into the first expansion valve 204. The first expansion valve 204 may control a degree of opening indicating its openness, in response to a signal output from the first expansion valve controller 302, described later. The first expansion valve 204 may send the refrigerant gas to the evaporator 205.

The evaporator 205 may perform the heat exchange between the refrigerant gas generated in the first expansion valve 204 and the high temperature room air. The evaporator 205 may cool the room air while vaporizing a portion of the refrigerant. Gas-liquid two-phase refrigerant generated in the evaporator 205 may be sent to the compressor 201 through the four-way switching valve 202. The gas-liquid two-phase refrigerant may represent that two states, e.g., gas state and liquid state, are mixed.

In addition, an outdoor fan 10F may be installed in the outdoor unit 10 and an indoor fan 11F may be installed in the indoor unit 11.

The outdoor fan 10F may cool the refrigerant by blowing air to the condenser 203. The rotational speed of the outdoor fan 10F may be controlled by an outdoor fan controller 303, described later.

The indoor fan 11F may cool the indoor air in the evaporator 205 and then blow the cooled air into the room. The indoor fan 11F may be controlled by an indoor fan controller 304, described later.

In addition, a discharge temperature sensor 206, a suction temperature sensor 207, an outlet temperature sensor 208, a liquid pipe temperature sensor 209, a high pressure sensor 210, and a low pressure sensor 211 may be installed in the refrigerant circuit 20.

The discharge temperature sensor 206 may detect a refrigerant temperature (discharge temperature; Td) in the high-pressure side of the compressor 201 and output a signal indicating the detected discharge temperature to an A/D converter 50.

The suction temperature sensor 207 may detect a refrigerant temperature (suction temperature; Tsuc) in the low-pressure side of the compressor 201 and output a signal indicating the detected suction temperature to the A/D converter 50.

The outlet temperature sensor 208 may detect a refrigerant temperature (outlet temperature; Tcond (a first refrigerant temperature)) in the outlet of the condenser 203 and output a signal indicating the detected outlet temperature to the A/D converter 50. The outlet temperature sensor 208 may be installed in a heat transfer pipe on the side of the outlet of the condenser 203.

The liquid pipe temperature sensor 209 may detect a refrigerant temperature (liquid pipe temperature; Tsub (a second refrigerant temperature)) in the downstream side of the first expansion valve 204 installed in the side of the outlet of the condenser 203, and output a signal indicating the detected liquid pipe temperature to the A/D converter 50. The liquid pipe temperature sensor 209 may be installed in a liquid pipe 212. The liquid pipe 212 may be a pipe connecting the outlet of the condenser 203 to the inlet of the evaporator 205.

The high pressure sensor 210 may detect a pressure (high pressure side pressure; Pd) in the high pressure side of the compressor 201 and output a signal indicating the detected high pressure side pressure to the A/D converter 50.

The low pressure sensor 211 may detect a pressure (low pressure side pressure; Ps) in the low pressure side of the compressor 201 and output a signal indicating the detected low pressure side pressure to the A/D converter 50.

The air conditioner controller 30 may control each component of the air conditioner 100. Meanwhile, although the air conditioner controller 30 and each component of the indoor unit 11 and the outdoor unit 10 are connected to each other, the connection thereof is not described in FIG. 1. A detail description of the air conditioner controller 30 will be described later with reference to FIG. 2.

The refrigerant amount detection device 40 may detect the amount of refrigerant in the refrigerant circuit in the air conditioner 100. Meanwhile, although the refrigerant amount detection device 40 and each component of the indoor unit 11 and the outdoor unit 10 are connected to each other, the connection thereof is not described in FIG. 1. A detail description of the air conditioner controller 30 will be described later with reference to FIG. 2.

Figure 2:
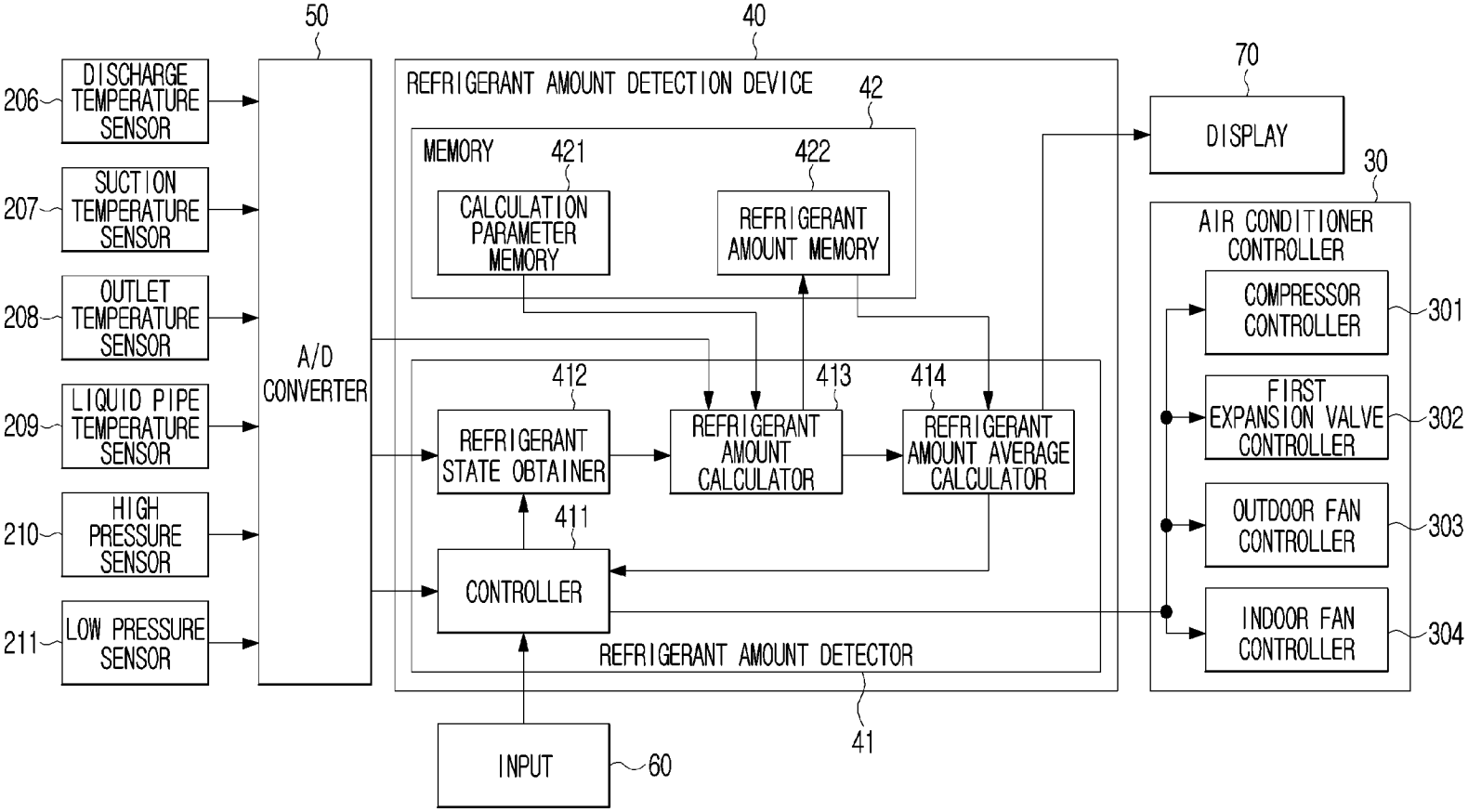
FIG. 2 is a schematic block diagram illustrating a configuration of a refrigerant amount detection device according to the first embodiment.

FIG. 2 is a schematic block diagram illustrating a configuration of the refrigerant amount detection device 40 according to the first embodiment. The A/D converter 50 may analog-to-digital convert the signal received from the sensors 206 to 211 and then output the converted signal to a refrigerant amount detector 41. An input 60 may output detection start information indicating that the detection of the refrigerant amount is started, to a controller 411 in response to a user's operation. A display 70 may be a display unit configured to display information, i.e., a digital display panel by using light emitting diode (LED), and the display 70 may display information about a refrigerant amount ratio input from a refrigerant amount average calculator 414, described later.

Particularly, the refrigerant amount detection device 40 may include the refrigerant amount detector 41 configured to determine a refrigerant state and calculate the refrigerant amount ratio and a memory 42 configured to memory a parameter used for calculating the refrigerant amount ratio and the refrigerant amount ratio that is previously calculated.

The refrigerant amount detector 41 may calculate the refrigerant amount ratio based on the information of the temperature and the pressure received from the A/D converter 50, and output the calculated refrigerant amount ratio to the display 70. "Refrigerant amount ratio" may represent a value obtained by dividing an amount of refrigerant actually present in the air conditioner 100 by an amount of refrigerant specified as the specification for the air conditioner 100 ("actual refrigerant amount"/"specified refrigerant amount")

The refrigerant amount detector 41 may include the controller 411, a refrigerant state obtainer 412, a refrigerant amount calculator 413, and the refrigerant amount average calculator 414.

The controller 411 may receive the detection start information indicating that the detection of the refrigerant amount ratio of the air conditioner 100 is started, from the input 60. Further, the controller 411 may output a command configured to allow the air conditioner 100 to perform a certain operation mode, i.e., a cooling operation, to the air conditioner controller 30. The controller 411 may output an operation end command configured to end the operation, to the air conditioner controller 30.

The air conditioner controller 30 may include the compressor controller 301 controlling the rotational speed of the motor of the compressor 201; the first expansion valve controller 302 controlling the opening degree of the first expansion valve 204; the outdoor fan controller 303 controlling the rotational speed of the outdoor fan 10F; and the indoor fan controller 304 controlling the rotational speed of the indoor fan 11F based the command received from the controller 411.

Particularly, the air conditioner controller 30 may allow a degree of superheat (SH) of the evaporator 205 provided in the indoor unit 11, to be constant (e.g., 3K). "Degree of superheat" may be obtained by subtracting a saturation temperature at an evaporation temperature from the refrigerant temperature at the outlet of the evaporator 205, i.e. by subtracting a saturation temperature of the pressure in the low pressure side of the compressor 201 from the refrigerant temperature in the low pressure side of the compressor 201. The first expansion valve controller 302 may allow the degree of superheat of the evaporator 205 to be constant by adjusting the opening degree of the first expansion valve 204.

In addition, the controller 411 may output a command, which is configured to allow the rotational speed of the motor of the compressor 201 to be driven at a predetermined rotational speed (e.g., 65 Hz), to the compressor controller 301. The compressor controller 301 may receive the command, which is configured to allow the rotational speed of the motor of the compressor 201 to be driven at a predetermined rotational speed (e.g., 65 Hz), and allow the motor to be driven at the rotational speed of 65 Hz.

The controller 411 may output a command configured to drive the outdoor fan 10F at a constant speed, to the outdoor fan controller 303. The outdoor fan controller 303 may allow the outdoor fan 10F to be driven at the constant speed.

The controller 411 may output a command configured to drive the indoor fan 11F at a constant speed, to the indoor fan controller 304. The indoor fan controller 304 may allow the indoor fan 11F to be driven at the constant speed.

In addition, the controller 411 may output a command configured to allow the refrigerant state obtainer 412 and the refrigerant amount calculator 413 to calculate the refrigerant amount ratio. The controller 411 may receive an average calculation end signal indicating that the calculation of the average value of the refrigerant amount ratio is completed, from the refrigerant amount average calculator 414. The controller 411 may output an operation end signal to the air conditioner controller 30 when receiving the average value calculation end signal from the refrigerant amount average calculator 414.

The refrigerant state obtainer 412 may acquire information related to whether the refrigerant state in the outlet of the condenser 203 is a subcooled state or a gas liquid two-phase state, after the air conditioner 100 starts a certain operation mode by the air conditioner controller 30. The refrigerant state obtainer 412 may determine that the refrigerant is in any one of the subcooled state or the gas liquid two-phase state, by using the outlet temperature (Tcond) indicated by an outlet temperature signal and the liquid pipe temperature (Tsub) indicated by the liquid pipe temperature signal as parameters. The refrigerant state obtainer 412 may output a determination signal to the refrigerant amount calculator 413.

Details are as follows.

When Tcond-Tsub≤X is established, the refrigerant state may be determined as "subcooled state".

When Tcond-Tsub>X is established, the refrigerant state may be determined as "gas liquid two-phase state."

X is a constant, and obtained in advance by using measured data (e.g., X=1.5).

The refrigerant amount calculator 413 may calculate the refrigerant amount ratio in the air conditioner 100 by using a different equation, according to the refrigerant state obtained by the refrigerant state obtainer 412.

Particularly, when the refrigerant is in the subcooled state, the refrigerant amount calculator 413 may calculate a refrigerant amount ratio (RA) by using an equation for the subcooled state and when the refrigerant is in the gas-liquid two-phase state, the refrigerant amount calculator 413 may calculate a refrigerant amount ratio (RA) by using an equation for the gas-liquid two-phase state.

The equation for the subcooled state is as follows.

$$RA=a1+b1+Pd+c1\times Ps+d1\times Tsub+e1\times Td$$

The constants (a1, b1, c1, d1, and e1) may be a value obtained in advance by the multi-regression calculation by using measured data indicating a relationship between Pd, Ps, Tsub, Td and RA in the subcooled state. Meanwhile, the constants (a1, b1, c1, d1 and e1) may be recorded in a calculation parameter memory 421 set in the memory 42.

The equation for the gas-liquid two-phase state is as follows.

$$RA=a2+b2+Pd+c2\times Ps+d2\times Tsub+e2\times Td$$

The constants (a2, b2, c2, d2, and e2) may be a value obtained in advance by the multi-regression calculation by using measured data indicating a relationship between Pd, Ps, Tsub, Td and RA in the gas-liquid two-phase state. Meanwhile, the constants (a2, b2, c2, d2, and e2) may be recorded in the calculation parameter memory 421.

The refrigerant amount calculator 413 may read the constants (a1, b1, c1, d1, and e1), or the constants (a2, b2, c2, d2, and e2) in accordance with the refrigerant state acquired by the refrigerant state obtainer 412. Further, the refrigerant amount calculator 413 may calculate the refrigerant amount ratio (RA) by the equation corresponding to the refrigerant state, by using the discharge pressure (Pd) indicated by the discharge pressure signal, the suction pressure (Ps) indicated by the suction pressure signal, the liquid pipe temperature (Tsub) indicated by the liquid pipe temperature signal, and the discharge temperature (Td) indicated by the discharge temperature signal. The refrigerant amount calculator 413 may record the refrigerant amount ratio data indicating the calculated refrigerant amount ratio (RA) in a refrigerant amount memory 422 set in the memory 42.

The refrigerant amount average calculator 414 may read a refrigerant amount ratio (RA) that is calculated within a predetermined time (e.g., the past five minutes), on the refrigerant amount calculator 413. The refrigerant amount average calculator 414 may calculate an average value of the read refrigerant amount ratio (RA) and output the calculated average value of the refrigerant amount ratio (RA) to the display 70. When the calculation of the average value of the refrigerant amount ratio (RA) is completed, the refrigerant amount average calculator 414 may output a calculation end signal indicating that the calculation of the average value of the refrigerant amount ratio RA is completed, to the controller 411.

According to the first embodiment, the air conditioner 100 may detect the amount of refrigerant with high accuracy, regardless of the refrigerant state at the outlet of the condenser 203, by using the equation for the subcooled state when the refrigerant state is the subcooled state, and by using the equation for the gas-liquid two-phase state when the refrigerant state is the gas-liquid two-phase state. Therefore, according to the first embodiment, it may be possible to detect the refrigerant amount ratio with high accuracy despite of using a long pipe or although there is a large difference in height between the outdoor unit 10 and the indoor unit 11.

According to the first embodiment, the controller 411 may fix the opening degree of a second expansion valve 215 to a predetermined value. As a result, the degree of cooling of the liquid refrigerant in the liquid pipe 212 may be maintained to be constant, and the refrigerant amount ratio may be detected with high accuracy.

In addition, according to the first embodiment, the controller 411 may fix the compression performance of the compressor 201 to a predetermined value. Accordingly, in this embodiment, it may be possible to maintain the refrigerant state at the inlet and the outlet of the compressor 201 to be constant, and it may be possible to detect the refrigerant amount ratio with high accuracy.

According to the first embodiment, the controller 411 may fix the opening degree of the first expansion valve 204 to a predetermined value. As a result, it may be possible to maintain the degree of cooling of the liquid refrigerant in the first expansion valve 204 to be constant, and it may be possible to detect the refrigerant amount ratio with high accuracy.

According to the first embodiment, the controller 411 may fix the rotational speed of the outdoor fan 10F and the rotational speed of the indoor fan 11F to a predetermined value. Accordingly, it may be possible to maintain the degree of heat exchange in the condenser 203 and the degree of heat exchange in the evaporator 205 to be constant and thus it may be possible to detect the refrigerant amount ratio with high accuracy.

A Second Embodiment

The second embodiment of the present disclosure will be described with reference to the drawings.

Figure 3:
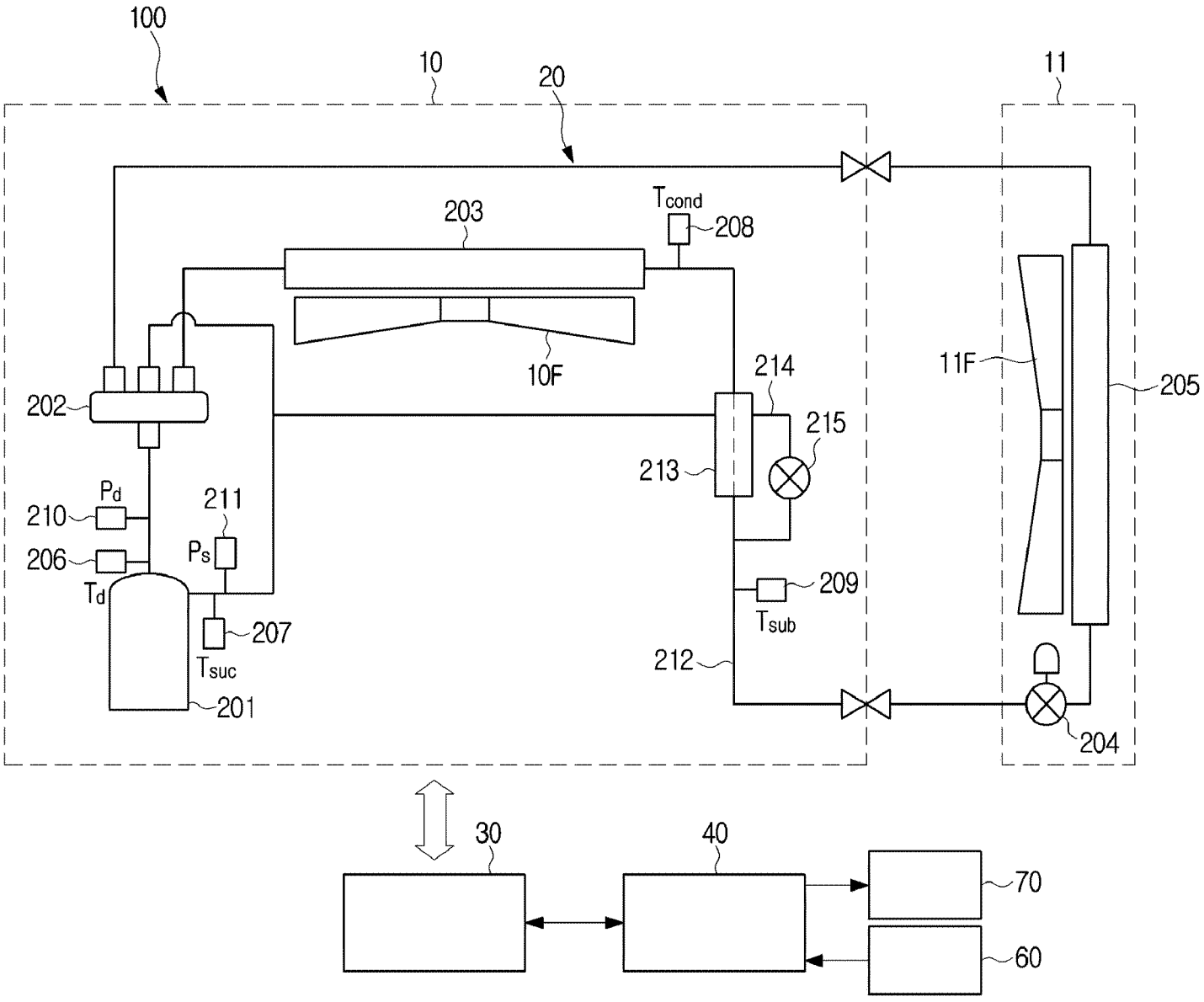
FIG. 3 is a schematic diagram illustrating a configuration of an air conditioner according to a second embodiment.

As illustrated in FIG. 3, according to the second embodiment, a configuration of an air conditioner 100 may be the same as that of the air conditioner 100 according to the first embodiment, except that a sub-cooler 213 is included. According to the second embodiment, a first expansion valve 204 may be provided in an indoor unit 11.

Particularly, the air conditioner 100 may include the sub-cooler 213 installed between a condenser 203 and the first expansion valve 204; a bypass path 214 diverged from the downstream side of the sub-cooler 213 in the refrigerant circuit 20 and connected to the low-pressure side of the compressor 201 via the sub-cooler 213; and a second expansion valve 215 installed in the bypass path 214 to adjust the amount of refrigerant flowing into the sub-cooler 213.

The sub-cooler 213 may cool the refrigerant liquid generated in the condenser 203 by using a sub-cooler cooling refrigerant sent from the second expansion valve 215. The sub cooler 213 may perform the heat exchange between the high temperature liquid refrigerant and the low temperature sub-cooler cooling refrigerant. The sub cooler 213 may send the cooled liquid refrigerant to the first expansion valve 204. The sub cooler 213 may send the sub cooler cooling refrigerant after the heat exchange, to the inlet of the low pressure side of the compressor 201.

Figure 4:
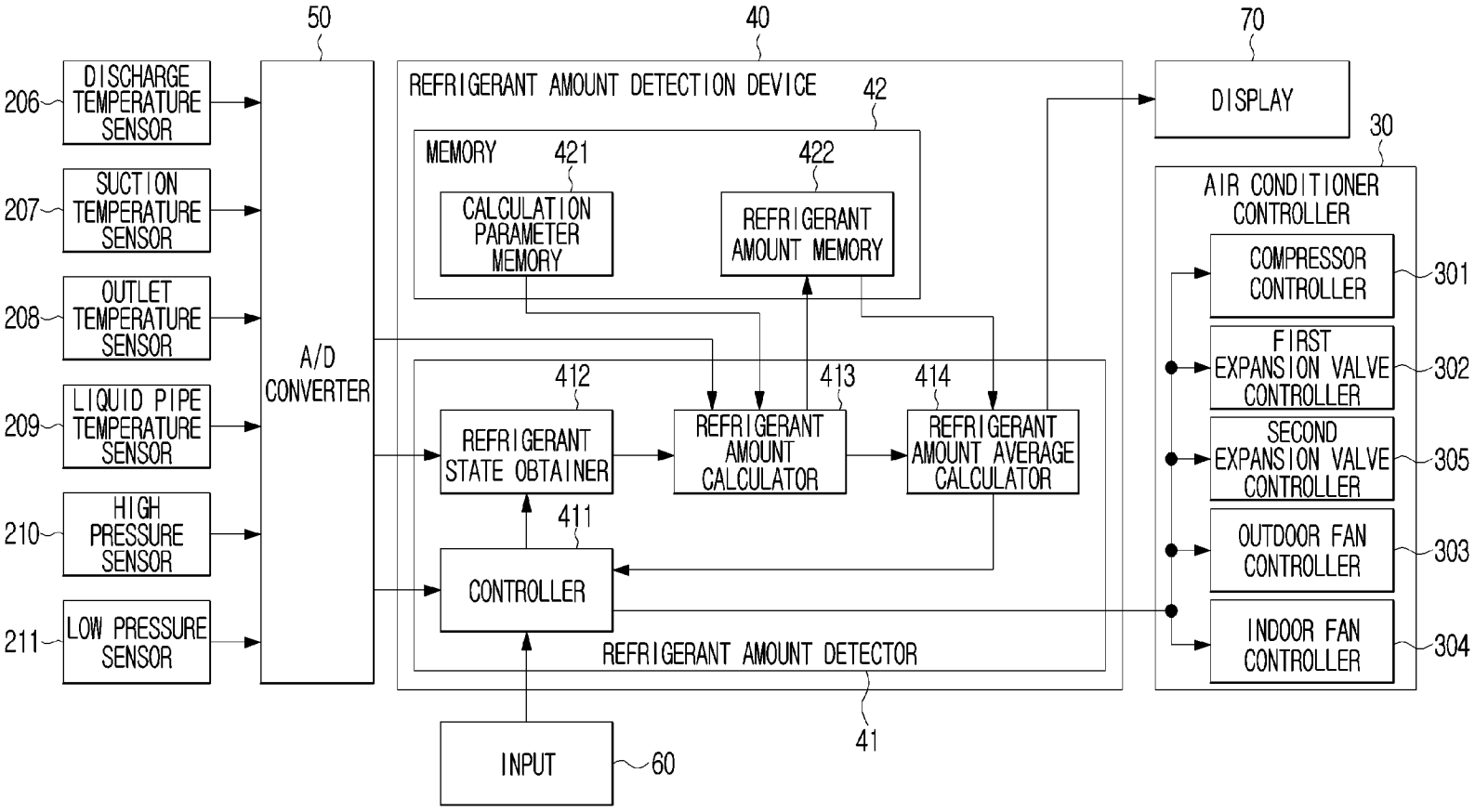
FIG. 4 is a schematic block diagram illustrating a configuration of a refrigerant amount detection device according to the second embodiment.

The second expansion valve 215 may be a valve configured to adjust the flow rate flowing therethrough by opening or closing thereof. As for, the second expansion valve 215, a degree of opening indicating the degree of its openness may be controlled by a second expansion valve controller 305 (refer to FIG. 4). When the second expansion valve 215 is opened, the liquid refrigerant, which is generated in the evaporator 205 and then flowed into the second expansion valve 215 via the sub-cooler 213, may expand and vaporize and then become the sub-cooler cooling refrigerant having a lower temperature than the liquid refrigerant. The second expansion valve 215 may send the sub-cooler cooling refrigerant to the sub-cooler 213.

According to the second embodiment, a liquid pipe temperature sensor 209 may detect a refrigerant temperature (liquid pipe temperature; Tsub) around an outlet of the sub-cooler 213, and output a signal indicating the detected liquid pipe temperature to an A/C converter 50. Meanwhile, the liquid pipe 212 may be a pipe installed from the outlet of the condenser 203 to the first expansion valve 204 via the sub-cooler 213 and configured to flow the liquid refrigerant.

Next, an operation of a refrigerant amount detection device 40 according to the second embodiment will be described with reference to FIG. 5.

Figure 5:
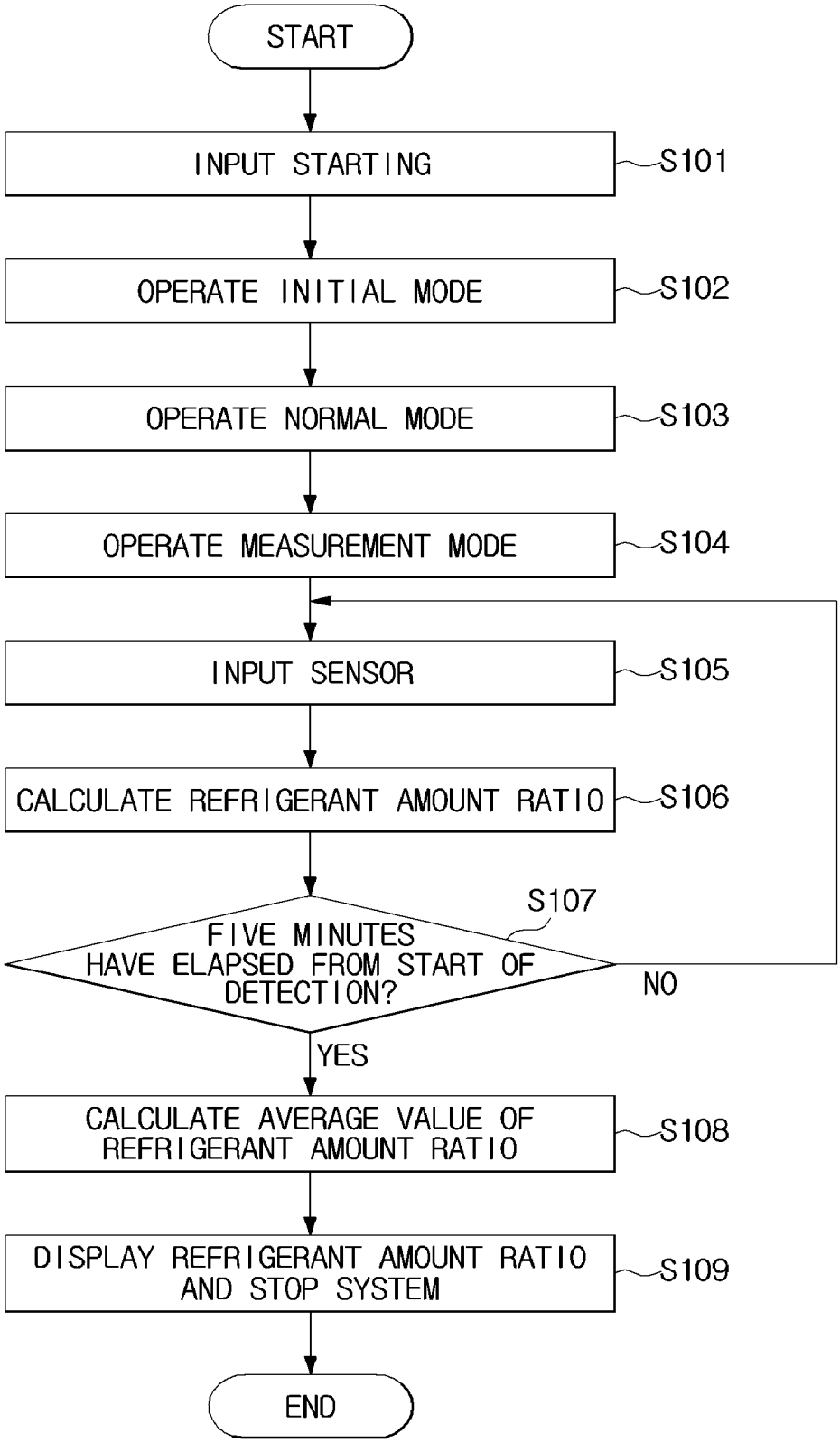
FIG. 5 is a view illustrating an example of an operation of a refrigerant amount detection device according to the second embodiment.

FIG. 5 is a view illustrating an example of an operation of the refrigerant amount detection device 40 according to the second embodiment.

(Step 101) an input 60 may receive an input of information indicating of the start of the detection of the refrigerant amount, from a user. The input 60 may output the detection start information indicating that the start of the detection of the detection of the refrigerant amount, to the controller 411. The procedure may proceed to step 102.

(Step 102) the controller 411 may output a command configured to start an operation of the air conditioner 100 to the air conditioner controller 30 based on the input detection start information that is input in step 101 (i.e., proceeding from a system stationary state)

In any operation mode, which will be described later, the air conditioner 100 may perform the cooling operation.

In addition, when the air conditioner 100 includes a plurality of indoor units 11 (FIG. 1 illustrates a single indoor unit), the air conditioner 100 may also operate all the indoor units 11.

The controller 411 may output a command to perform an initial mode operation to the air conditioner controller 30. The air conditioner controller 30 may start the initial mode operation. The initial mode operation may represent performing an operation as follows.

The air conditioner controller 30 may allow the indoor fan 11F to blow air at the rotational speed of "rapid" mode, which is predetermined and represents larger air volume than a normal air volume. The air conditioner controller 30 may allow the degree of superheat of the evaporator 205 provided in the indoor unit 11, to become 3K (all indoor units SH control: SH=3K). The first expansion valve controller 302 may allow the degree of superheat of the evaporator 205 to become 3K by adjusting the degree of opening of the first expansion valve 204. The air conditioner controller 30 may operate the air conditioner 100 by setting a set temperature of the room temperature, as approximately 3° C. (all indoor units set temperature: Remote=3K). The air conditioner controller 30 may maintain the initial mode operation for five to ten minutes, and then proceed to step 103.

(Step 103) the controller 411 may output a command configured to perform a normal mode operation to the air conditioner controller 30. The air conditioner controller 30 may start the normal mode operation. The normal mode operation may represent performing an operation as follows.

The controller 411 may output a command configured to allow the motor of the compressor 201 to be rotated at a predetermined rotational speed (e.g., 65 Hz), to the compressor controller 301 (compressor 65 Hz fixed). The compressor controller 301 may receive the command configured to allow the motor of the compressor 201 to be rotated at a predetermined rotational speed (e.g., 65 Hz), from the controller 411 and allow the motor to be rotated at the rotation speed of 65 Hz.

The controller 411 may output a command configured to allow the degree of opening to be a predetermined value (e.g., 120 pls), to the first expansion valve controller 302. "pls" used as a unit of the opening degree of the expansion valve may be defined as "0" pls, when the expansion valve is completely closed, and as "2000" pls, when the expansion valve is completely opened. The first expansion valve controller 302 may receive a command configured to allow the opening degree to be 120 pls, from the controller 411 and the first expansion valve controller 302 may operate the first expansion valve 204 with the opening degree of 120 pls (EEV: 120 pls Fixed).

The controller 411 may output a command configured to allow the degree of opening to be a predetermined value (e.g., 120 pls), to the second expansion valve controller 305. The second expansion valve controller 305 may receive a command configured to allow the opening degree to be 120 pls, from the controller 411 and the second expansion valve controller 305 may operate the second expansion valve 215 with the opening degree of 120 pls (EVI: 120 pls Fixed). The air conditioner controller 30 may maintain the normal mode operation for five to ten minutes, and then proceed to step 104.

(Step 104) the controller 411 may output a command configured to perform a measurement mode operation to the air conditioner controller 30. The air conditioner controller 30 may start the measurement mode operation. The measurement mode operation may represent performing an operation as follows.

The controller 411 may output a command configured to measure the outdoor fan 10F at a constant speed, to the outdoor fan controller 303. The outdoor fan controller 303 may allow the outdoor fan 10F to be operated at the constant speed (outdoor fan: Step Fixed). The air conditioner controller 30 may maintain the measurement mode operation for approximately 25 minutes, and then proceed to step 105.

(Step 105) the controller 411 may output a command configured to calculate the refrigerant amount ratio to the refrigerant state obtainer 412 and the refrigerant amount calculator 413. The refrigerant state obtainer 412 may receive the outlet temperature signal and the liquid pipe temperature signal. The refrigerant amount calculator 413 may receive the discharge temperature signal, the liquid pipe temperature signal, the high-pressure-side pressure signal, and the low-pressure-side pressure signal. The procedure may proceed to step 106.

(Step 106) the refrigerant state obtainer 412 may determine whether the refrigerant is the subcooled state or the gas-liquid two-phase state, based on the outlet temperature (Tcond) indicated by the outlet temperature signal and the liquid pipe temperature (Tsub) indicated by the liquid pipe temperature signal input in step S105.

The refrigerant amount calculator 413 may read the equation (equation parameter) in accordance with the refrigerant state acquired by the refrigerant state obtainer 412, from the parameter calculation memory 421. The refrigerant amount calculator 413 may calculate the refrigerant amount ratio (RA) by using the equation in accordance with the refrigerant state, based on the high pressure side pressure (Pd) indicated by the high pressure side pressure signal, the low pressure side pressure (Ps) indicated by the low pressure side pressure signal, the liquid pipe temperature (Tsub) indicated by the liquid pipe temperature signal, and the discharge temperature (Td) indicated by the discharge temperature signal. The refrigerant amount calculator 413 may record the calculated refrigerant amount ratio (RA) on the refrigerant amount memory 422. The procedure may proceed to step 107.

(Step 107) the controller 411 may determine whether or not five minutes have elapsed from when the command to calculate the refrigerant amount ratio is started. When it is determined that five minutes have elapsed (Yes), the procedure may proceed to step 108. When it is determined that five minutes have not elapsed (No), the procedure may return to step 105.

(Step 108) the refrigerant amount average calculator 414 may read the refrigerant amount ratio recorded in the refrigerant amount memory 422 in step 106, and calculate the average value of the refrigerant amount ratio. The refrigerant amount average calculator 414 may output information about the average value of the calculated refrigerant amount ratio, to the display 70. The refrigerant amount average calculator 414 may output average calculation end information indicating that the calculation of the average value of the refrigerant amount ratio is completed, to the controller 411. The procedure may proceed to step 109.

(Step 109) the display 70 may receive information indicating the average value of the refrigerant amount ratio calculated by the refrigerant amount average calculator 414 in step 108 and display the information. The controller 411 may output an operation stop command of the air conditioner 100 to the air conditioner controller 30 based on the average calculation end information received from the refrigerant amount average calculator 414. The air conditioner controller 30 may stop the operation of the air conditioner 100 according to the operation stop signal received from the controller 411. The procedure may proceed to the termination.

According to the second embodiment, it may be possible to detect the amount of refrigerant with high accuracy regardless of the refrigerant state at the outlet of the condenser 203, by using the equation for the subcooled state when the refrigerant state is the subcooled state, and by using the equation for the gas-liquid two-phase state when the refrigerant state is the gas-liquid two-phase state. Therefore, according to the second embodiment, it may be possible to detect the refrigerant amount ratio with high accuracy despite of using a long pipe using the sub-cooler 213 to prevent the vaporization in the liquid pipe or although there is a large difference in height between the outdoor unit 10 and the indoor unit 11.

A Third Embodiment

The third embodiment of the present disclosure will be described with reference to the drawings.

According to the first and second embodiment, it may be possible to precisely measure the amount of refrigerant in the air conditioner 100. However, according to the third embodiment, when the refrigerant is supplemented, it may be possible to calculate the refrigerant amount ratio and when charging the refrigerant is started, it may be possible to display a notification informing a user, who performs an operation, of operating a refrigerant injection valve 216, promptly when the refrigerant amount ratio reaches 100%.

Figure 6:
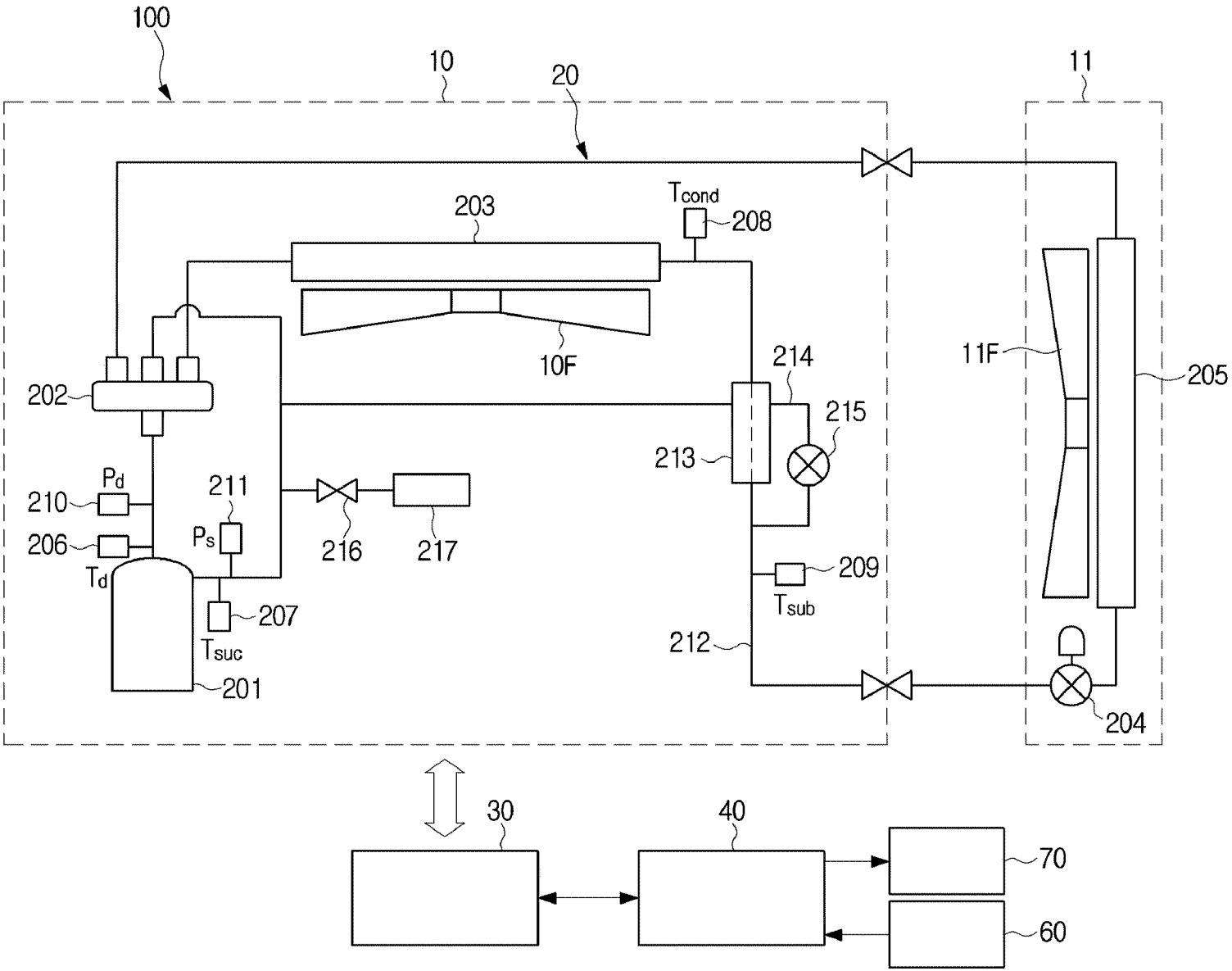
FIG. 6 is a schematic block diagram illustrating a configuration of an air conditioner according to a third embodiment.

FIG. 6 is a schematic block diagram illustrating a configuration of the air conditioner 100 according to the third embodiment.

According to the third embodiment, the configuration of the air conditioner 100 may be the same as that of the air conditioner 100 according to the second embodiment (FIG. 3), except that a refrigerant injection valve (charging valve) 216 and a refrigerant storage container 217 are included. Therefore, a description other than the refrigerant injection valve 216 and the refrigerant storage container 217 will be omitted.

The refrigerant injection valve 216 may be a valve configured to be opened or closed by a user who performs an operation to supplement the refrigerant according to instructions displayed on the display 70.

The refrigerant storage container 217 may be a container to store the supplemented refrigerant.

Figure 7:
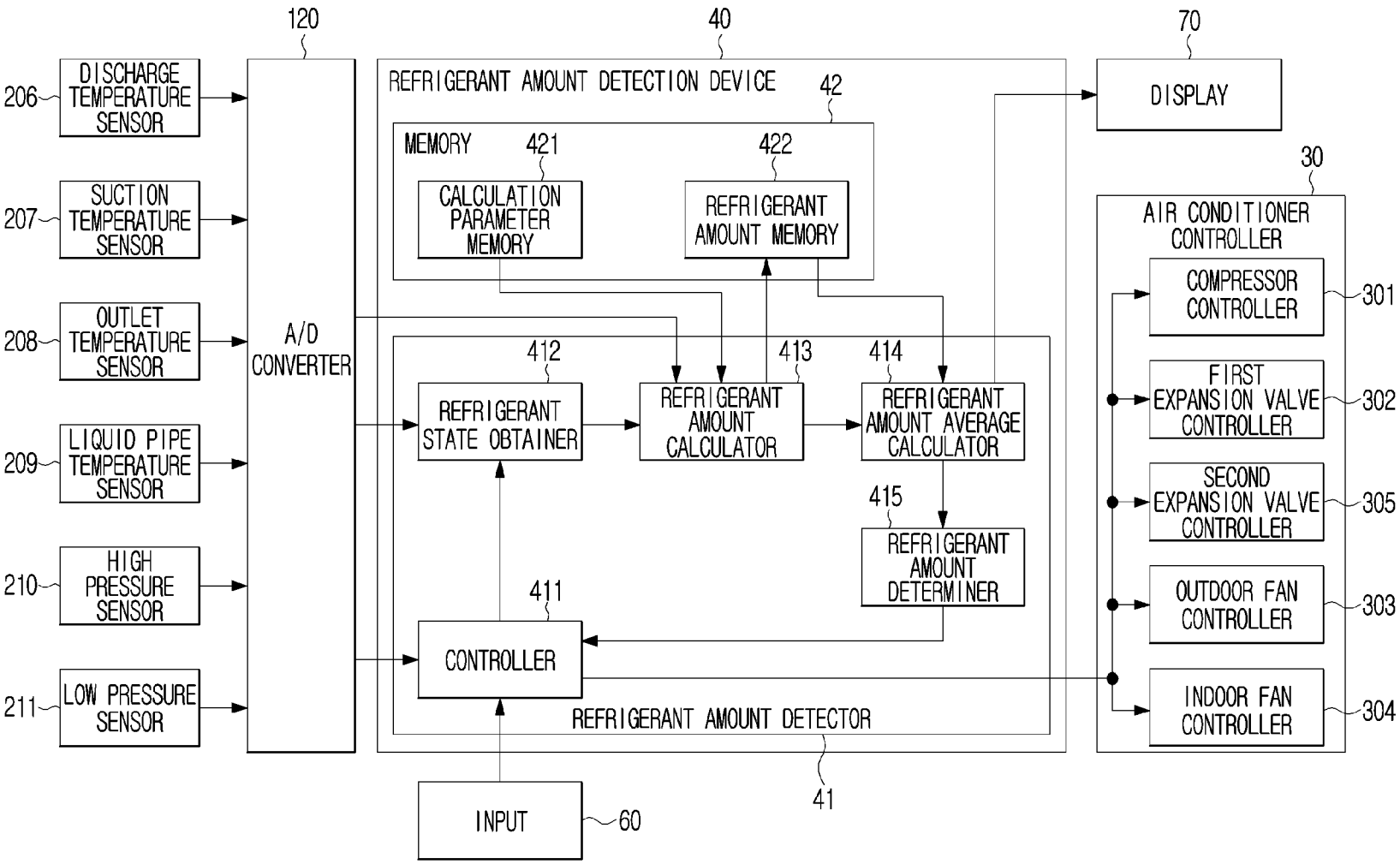
FIG. 7 is a schematic block diagram illustrating a configuration of a refrigerant detection device according to the third embodiment.

FIG. 7 is a schematic block diagram illustrating a configuration of a refrigerant detection device 40 according to the third embodiment.

According to the third embodiment, the configuration of the refrigerant amount detection device 40 may be the same as that of the refrigerant detection device 40 according to the second embodiment (FIG. 4), except that a refrigerant amount determiner 415 is included and a new function is added to the refrigerant amount average calculator 414 and the controller 411. Therefore, a description other than the refrigerant amount average calculator 414, the refrigerant amount determiner 415 and the controller 411 will be omitted.

The refrigerant amount average calculator 414 may read a refrigerant amount ratio that is calculated within a predetermined time (e.g., the past five minutes), on the refrigerant amount calculator 413. The refrigerant amount average calculator 414 may calculate a moving average value of the read refrigerant amount ratio and output the calculated moving average value of the refrigerant amount ratio to the refrigerant amount determiner 415.

The refrigerant amount determiner 415 may determine whether the moving average value of the refrigerant amount ratio is more than 100% or not, based on the moving average value of the refrigerant amount ratio received from the refrigerant amount average calculator 414. When it is determined that the moving average value of the refrigerant amount ratio is more than 100%, the refrigerant amount determiner 415 may output a charging end signal to the controller 411.

The controller 411 may output a command, which is configured to inform a user who performs an operation, about "open" or "close" the refrigerant injection valve 216, on the display 70, based on the input of the detection start information from the input 60 and the input of charging end signal from the refrigerant amount determiner 415.

Figure 8:
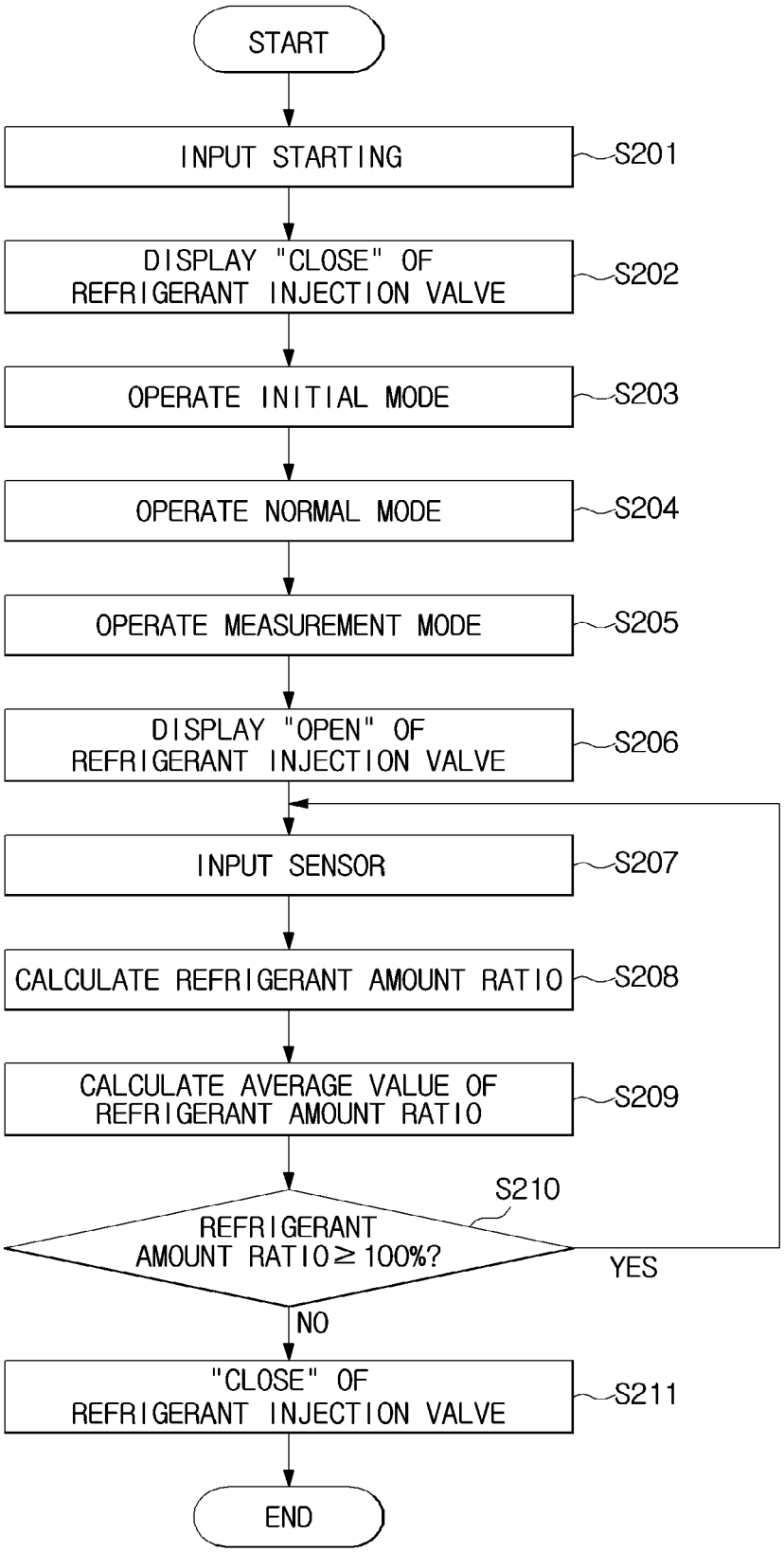
FIG. 8 is a flow chart illustrating an example of the operation of the refrigerant amount detection device according to the third embodiment.

An operation of the refrigerant amount detection device 40 according to the third embodiment will be described with reference to FIG. 8. FIG. 8 is a flow chart illustrating an example of the operation of the refrigerant amount detection device 40 according to the third embodiment.

(Step 201) the input 60 may receive an input of starting automatic charging of the refrigerant from a user, and output the detection start information configured to start the detection of the amount of refrigerant to the controller 411. Thereafter, the procedure may proceed to step 202.

(Step 202) the controller 411 may output the command configured to display a notification informing a user, who performs an operation, about closing the refrigerant injection valve 216, to the display 70. Thereafter, the procedure may proceed to step 203. Each process in step 203~205 may be the same as each process of step S102~step S104 in the second embodiment (FIG. 5).

(Step 206) the controller 411 may output the command configured to display a notification informing a user, who performs an operation, about opening the refrigerant injection valve 216, to the display 70. Thereafter, the procedure may proceed to step 207. Each process in step 207 and 208 may be the same as each process of step S105 and 106 in the second embodiment (FIG. 5).

(Step 209) the refrigerant amount average calculator 414 may read the refrigerant amount ratio recorded in the refrigerant amount memory 422 and calculate the moving average value of the refrigerant amount ratio for five minutes. The refrigerant amount average calculator 414 may output information about the calculated moving average value of the refrigerant amount ratio to the refrigerant amount determiner 415. Thereafter, the procedure may proceed to step 210.

(Step 210) the refrigerant amount determiner 415 may determine whether the moving average value of the refrigerant amount ratio is more than 100% or not, based on the information about the moving average value of the refrigerant amount ratio received from the refrigerant amount average calculator 414. When it is determined that the moving average value of the refrigerant amount ratio is more than 100% (Yes), the refrigerant amount determiner 415 may output the charging end signal indicating that the charging of the refrigerant is completed, to the controller 411 and then the procedure may proceed to step 211. When it is determined that the moving average value of the refrigerant amount ratio is less than 100% (No), the procedure may proceed to step 207.

(Step 211) the controller 411 may output the command configured to display a notification informing a user, who performs an operation, about closing the refrigerant injection valve 216, to the display 70. The controller 411 may output an operation stop command of the air conditioner 100 to the air conditioner controller 30 based on the charging end signal received from the refrigerant amount determiner 415 in step 210. The air conditioner controller 30 may stop the operation of the air conditioner 100 according to the operation stop command received from the controller 411. The controller 411 may output the operation stop command of the air conditioner 100 to the air conditioner controller 30. The air conditioner controller 30 may stop the operation of the air conditioner 100 according to the operation stop command received from the controller 411. Thereafter, the process proceeds to a termination process.

According to the third embodiment, the air conditioner 100 may be provided with the refrigerant injection valve 216 to charge the refrigerant to the air conditioner 100. Depending on the determination of the refrigerant amount determiner 415, the air conditioner 100 may display an instruction configured to close the refrigerant injection valve 216, to the display 70. Accordingly, it may be possible to allow a user who performs an operation to open the refrigerant injection valve 216 when the detection of the refrigerant amount ratio is started and it may be possible to allow a user who performs an operation to promptly close the refrigerant injection valve 216 when the refrigerant amount ratio becomes more than 100%. Therefore, the refrigerant may be surely supplemented.

According to the third embodiment, the refrigerant injection valve 216 may be opened or closed by a user who performs the operation, but alternatively the refrigerant injection valve 216 may be automatically opened or closed under the control of the air conditioner controller 30 by the controller 411.

According to each embodiment described above, the reliable protection of the compressor 201 may be continued and when it enters the protection area (i.e., a case in which each measured value of the discharge temperature, the overcurrent, the high voltage and the low pressure is over a minimum physical amount that causes a predetermined reaction), it may be possible to stop the operation of the air conditioner 100 and display "detection failure" on the display 70.

In addition, it may be allowed to use the following equations for calculating the refrigerant amount ratio according to each of embodiments.

$$RA=f(Tc, Te, T\text{sub}, Td)$$

The equation for the subcooled state is as follows.

$$RA=a3+b3\times Tc+c3\times Te+d3\times \text{Tsub}+e3\times Td$$

The constants (a3, b3, c3, d3, and e3) may be a value obtained in advance by the multi-regression calculation by using measured data indicating a relationship between Tc, Te, Tsub, Td and RA in the subcooled state.

The equation for the gas-liquid two-phase state is as follows.

$$RA=a4+b4+Tc+c4\times Te+d4\times Tsub+e4\times Td$$

The constants (a4, b4, c4, d4, and e4) may be a value obtained in advance by the multi-regression calculation by using measured data indicating a relationship between Tc, Te, Tsub, Td and RA in the gas-liquid two-phase state.

The refrigerant amount calculator 413 may calculate a saturation temperature (Tc) and a saturation temperature (Te) based on the discharge pressure (Pd) indicated by the discharge pressure signal and the suction pressure (Ps) indicated by the suction pressure signal, and saturated steam curve data recorded in the parameter calculation memory 421. The refrigerant amount calculator 413 may calculate the refrigerant amount ratio (RA) based on the above mentioned factors, the liquid pipe temperature (Tsub) indicated by the liquid pipe temperature signal and the discharge temperature (Td) indicated by the discharge temperature signal.

The equation for the subcooled state and the equation for the gas-liquid two-phase state may vary according to the type of the refrigerant. It may be appropriate that the refrigerant amount detection device records constants of equations according to the type of the refrigerant to detect various types of air conditioner. For example, it may be allowed that the refrigerant state obtainer 412 calculates the refrigerant amount by reading a parameter (constant) corresponding to the refrigerant, from the parameter calculation memory 421, according to the type of the refrigerant that is input from the input 60.

A Fourth Embodiment

The fourth embodiment of the present disclosure will be described with reference to the drawings.

According to the fourth embodiment, an air conditioner 100 may include components of the air conditioner 100 according to the first embodiment and further include a refrigerant storage configured to store surplus refrigerant of the refrigerant circuit 20.

Figure 9:
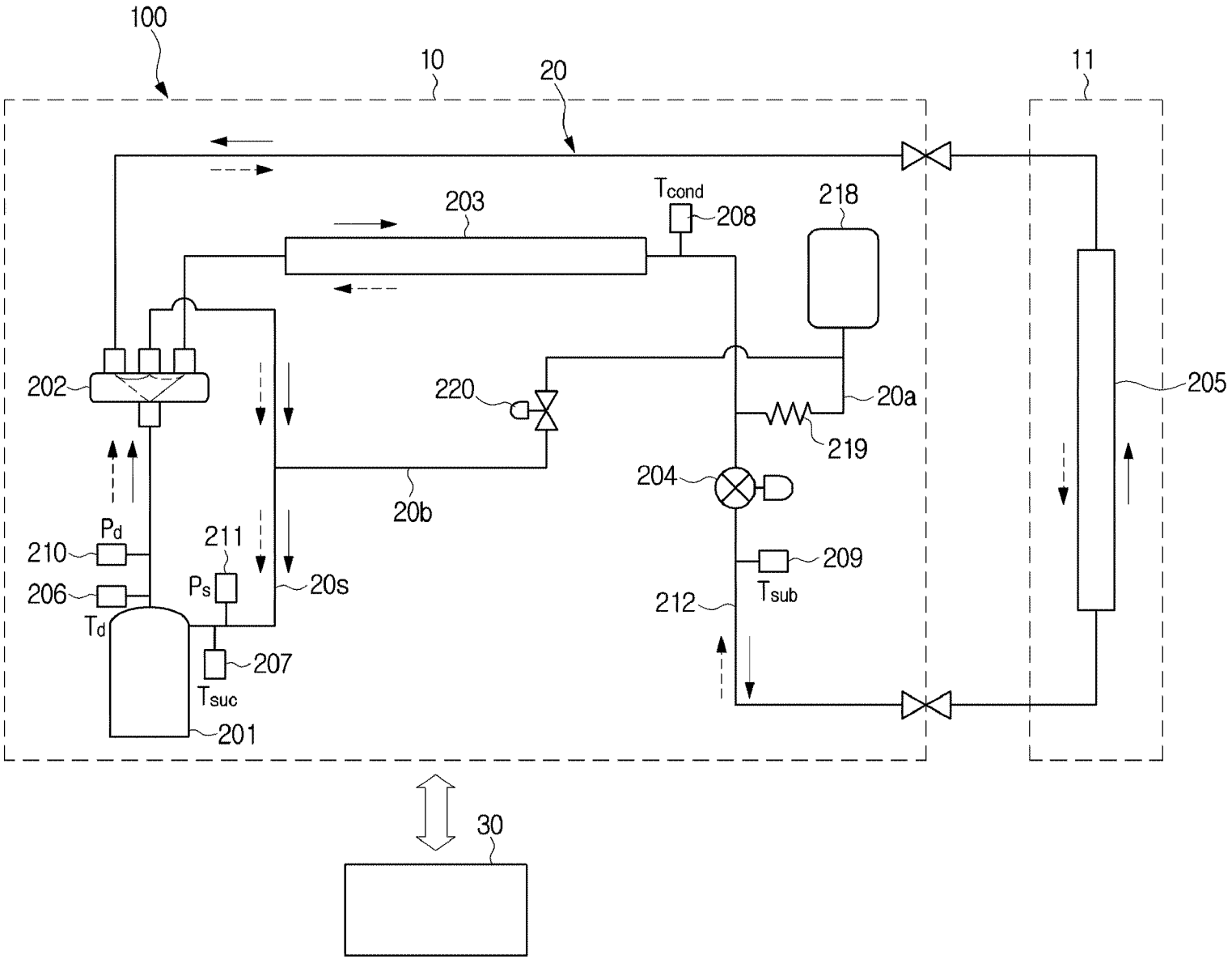
FIG. 9 is a schematic diagram illustrating a configuration of an air conditioner according to a fourth embodiment.

Particularly, as illustrated in FIG. 9, the air conditioner 100 may include a receiver 218 that is an example of refrigerant storage configured to store a surplus refrigerant; and a receiver pressure-reducing valve 219 that is an example of flow controller configured to reduce the pressure of the refrigerant while regulating the flow of the refrigerant discharged from the receiver 218.

According to the fourth embodiment, the degree of the opening of the receiver pressure-reducing valve 219 may be controlled by the control of the air conditioner controller 30, and the receiver pressure-reducing valve 219 may be configured to regulate the pressure and the amount of the refrigerant passing the receiver pressure-reducing valve 219.

The outdoor unit 10 of the air conditioner 100 may be switched to an open state or a closed state by the control of the air conditioner controller 30, and the outdoor unit 10 may be provide with a connection opening and closing valve 220 that is an example of a supply amount controller configured to regulate the flow of the refrigerant passing a connection path 20*b*, described later.

The air conditioner 100 may include a branch path 20*a* diverged from the refrigerant circuit 20; and the connection path 20*b* connecting the refrigerant circuit 20 to the branch path 20*a*.

The branch path 20*a* may be diverged from a pipe between the condenser 202 (outdoor heat exchanger) and the first expansion valve 203 in the refrigerant circuit 20. The receiver 218 may be connected to an end of the branch path 20*a*. In addition, the receiver pressure-reducing valve 219 may be installed in the branch path 20*a*.

The connection path 20*b* may be diverged from a pipe between the receiver pressure-reducing valve 219 and the receiver 218 in the branch path 20*a*, and then connected to a low pressure pipe 20*s* of the refrigerant circuit 20. The connection opening and closing valve 220 may be installed in the connection path 20*b*.

A detail description thereof will be described later and as for the air conditioner 100 according to the fourth embodiment, the connection opening and closing valve 220 may be normally in a closed state. When the discharge temperature (Td) of the refrigerant discharged from the compressor 201 is increased to a predetermined temperature, the connection opening and closing valve 220 may be switched to the open state. Accordingly, the refrigerant stored in the receiver 218 may be supplied to the compressor 201 via the connection path 20*b* and thus the discharge temperature (Td) of the refrigerant discharged from the compressor 201 may be prevented to be increased.

According to the fourth embodiment, the receiver 218 may be formed of material having thermal conductivity, e.g., iron. For example, the receiver 218 may have a cylindrical shape and vertically installed in the outdoor unit 10. A connector connected to the end of the branch path 20*a* may be formed in a bottom of the receiver 218 that is vertically lowered. In other words, as for the receiver 218 according to the fourth embodiment, the refrigerant may be introduced via the connector installed in a vertically lower portion of the receiver 218.

The receiver 218 may store a surplus refrigerant during the cooling operation and a defrosting operation. In addition, during a heating operation, the receiver 218 may supply the refrigerant stored at the time of cooling operation or defrosting operation, to the refrigerant circuit 20. In other words, as for the air conditioner 100 according to the fourth embodiment, it may be possible to regulate the amount of refrigerant circulating in the refrigerant circuit 20 by the receiver 218.

The volume of the receiver 218 may be set the same as a volume obtained by converting an amount of refrigerant obtained by subtracting an optimal amount of refrigerant for the cooling operation, from an optimal amount of refrigerant for the heating operation, into a subcooled liquid state. "Optimum amount of refrigerant" may represent an amount of refrigerant allowing the system efficiency of the heating operation and the cooling operation to be the highest. Although a detail description will be described later, in the air conditioner 100 according to the fourth embodiment, the optimal amount of refrigerant for the heating operation may be sealed in the refrigerant circuit 20. Therefore, when the volume of the receiver 218 is set as mentioned above, the surplus refrigerant may be stored in the receiver 218 during the cooling operation, and thus the cooling operation may be performed with the optimal amount of refrigerant. Accordingly, the increase in size of the receiver 218 may be prevented.

In the air conditioner 100 according to the fourth embodiment, a R32 refrigerant or a mixed refrigerant containing at least 70% by weight of refrigerant R32 may be used as the refrigerant. For example, when comparing refrigerant R32 with refrigerant R410A that is typically used as the refrigerant in the air conditioner, refrigerant R32 may have a low warming coefficient. Therefore, in the fourth embodiment, by using refrigerant R32 or the mixed refrigerant containing at least 70% by weight of refrigerant R32, the effect on the environment may be reduced in comparison with using refrigerant R410A containing 50% by weight of refrigerant R32 and 50% by weight of refrigerant R125.

It may be allowed that the refrigerant contains various additives, e.g., a lubricant, increasing the lubricity of the refrigerant in the compressor 201.

Hereinafter a behavior of the refrigerant in the air conditioner 100 according to the fourth embodiment will be described. The behavior of the refrigerant in the air conditioner 100 during the heating operation will be described.

During the heating operation, the refrigerant circuit 20 may be switched to a flow path illustrated by a broken line as illustrated in FIG. 9, by the four-way switching valve 202 and then the refrigerant may flow as indicated by a broken line arrow in FIG. 9. During the heating operation, a cooling cycle in which the refrigerant flows from the compressor 201, the four-way switching valve 202, the indoor heat exchanger 205, the first expansion valve 204, the outdoor heat exchanger 203 to the four-way switching valve 202 in order and then returns to the compressor 201, may be configured.

Particularly, the refrigerant in the form of gas having high temperature and high pressure, which is compressed in the compressor 201 and discharged from the discharger, may pass the four-way switching valve 107 and then flow into the indoor heat exchanger 104. As mentioned above, during the heating operation, the indoor heat exchanger 104 may be acted as a condenser. Therefore, the refrigerant may exchange a heat with indoor air in the indoor heat exchanger 104 and then condensed, liquefied and discharged from the indoor heat exchanger 104. After the high-pressure refrigerant in the liquid phase discharged from the indoor heat exchanger 104 is decompressed by the first expansion valve 103 and then the refrigerant becomes the gas-liquid two-phase state, the refrigerant may flow into the outdoor heat exchanger 102. During the heating operation, the outdoor heat exchanger 102 may be acted as an evaporator. Therefore, the refrigerant may exchange a heat with outdoor air in the outdoor heat exchanger 102 and then evaporated, vaporized and discharged from the outdoor heat exchanger 102. The refrigerant in the form of gas having low temperature, which is discharged from the outdoor heat exchanger 102, may be suctioned into the compressor 201 from the suction unit and then compressed again.

During the heating operation, after the refrigerant stored in the receiver 218 passes the branch path 20*a* and the pressure thereof is reduced by the receiver pressure-reducing valve 219, the refrigerant may be supplied to the refrigerant circuit 20.

The degree of the opening of the receiver pressure-reducing valve 219 may be controlled by the control of the air conditioner controller 30. As for the air conditioner 100 according to the fourth embodiment, it may be prevented that the large amount of the refrigerant rapidly flows from the receiver 218 to the refrigerant circuit 20 by adjusting the degree of the opening of the receiver pressure-reducing valve 219. A detail description of controlling the degree of the opening of the receiver pressure-reducing valve 219 will be described in the end.

Hereinafter a behavior of the refrigerant in the air conditioner 100 during the cooling operation or the defrosting operation will be described.

During the cooling operation or the defrosting operation, the refrigerant circuit 20 may be switched to a flow path illustrated by the broken line as illustrated in FIG. 9, by the four-way switching valve 107 and then the refrigerant may flow as indicated by a solid line arrow in FIG. 9. During the cooling operation and the defrosting operation, a cooling cycle in which the refrigerant flows from the compressor 201, the four-way switching valve 107, the outdoor heat exchanger 102, the first expansion valve 103, the indoor heat exchanger 104 to the four-way switching valve 107 in order and then returns to the compressor 201, may be configured.

Particularly, the refrigerant in the form of gas having high temperature and high pressure, which is compressed in the compressor 201 and discharged from the discharger, may pass the four-way switching valve 107 and then suctioned into the outdoor heat exchanger 102. As mentioned above, during the cooling operation or the defrosting operation, the outdoor heat exchanger 102 may be acted as the condenser. Therefore, the refrigerant may exchange a heat with outdoor air in the outdoor heat exchanger 102 and condensed, liquefied, become a subcooled liquid phase and then discharged from the outdoor heat exchanger 102. The high pressure liquid refrigerant discharged from the outdoor heat exchanger 102 may be diverged to the side of the refrigerant circuit 20 and the side of the branch path 20*a*. After the refrigerant in the side of the refrigerant circuit 20 is decompressed by the first expansion valve 103 and then becomes the gas-liquid two-phase state, the refrigerant may be suctioned into the indoor heat exchanger 104. During the cooling operation or the defrosting operation, the indoor heat exchanger 104 may be acted as an evaporator. Therefore, the refrigerant may exchange a heat with indoor air in the indoor heat exchanger 104 and then evaporated, vaporized and discharged from the indoor heat exchanger 104. The refrigerant in the form of gas having low temperature, which is discharged from the indoor heat exchanger 104, may be suctioned from the suction unit into the compressor 201 and then compressed again.

The refrigerant branched to the side of the branch path 20*a* may pass the receiver pressure-reducing valve 219, suctioned into the receiver 218 from the connector and then stored in the receiver 218. During the cooling operation or the heating operation, the receiver pressure-reducing valve 219 may be set as a fully open state by the air conditioner controller 30. Accordingly, the refrigerant branched to the side of the branch path 20*a* may be suctioned into the receiver 218 without decompressing by the receiver pressure-reducing valve 219.

As for the air conditioner 100, the volume of the outdoor heat exchanger 102 may be smaller than the volume of the indoor heat exchanger 104 according to the type of the outdoor heat exchanger 102. In this case, when the air conditioner 100 in which the outdoor heat exchanger 102 acts as the condenser perform the cooling operation and the defrosting operation, the amount of the refrigerant for the refrigerant circuit 20 may be reduced in comparison with when the air conditioner 100 in which the outdoor heat exchanger 102 acts as the evaporator perform the heating operation.

When the air conditioner 100, in which an optimal amount of refrigerant at the time of the heating operation about the refrigerant circuit 20 is sealed, performs the cooling operation or the defrosting operation, the refrigerant circulating the refrigerant circuit 20 may exceed the optimal amount of refrigerant at the time of the cooling operation or the defrosting operation. In other words, during the cooling operation or the defrosting operation, the surplus refrigerant may be generated in the refrigerant circuit 20.

In a state in which the refrigerant circulating the refrigerant circuit 20 is surplus, when the air conditioner 100 performs the cooling operation or the defrosting operation, the discharge pressure from the compressor 201 may be increased and thus the system efficiency of the air conditioner 100 may be decreased.

In comparison with the above mentioned description, as for the air conditioner 100 according to the fourth embodiment, a portion of the refrigerant may be stored in the receiver 218 during the cooling operation and the defrosting operation, and thus it may be prevented that the surplus refrigerant is generated in the refrigerant circuit 20. Accordingly, in the air conditioner 100, the cooling operation and the defrosting operation may be performed with the optimal amount of the refrigerant. Therefore, it may be prevented that the discharge pressure from the compressor 201 is increased. During the cooling operation and the defrosting operation of the air conditioner 100, the reduction in the system efficiency may be prevented.

Figure 10:
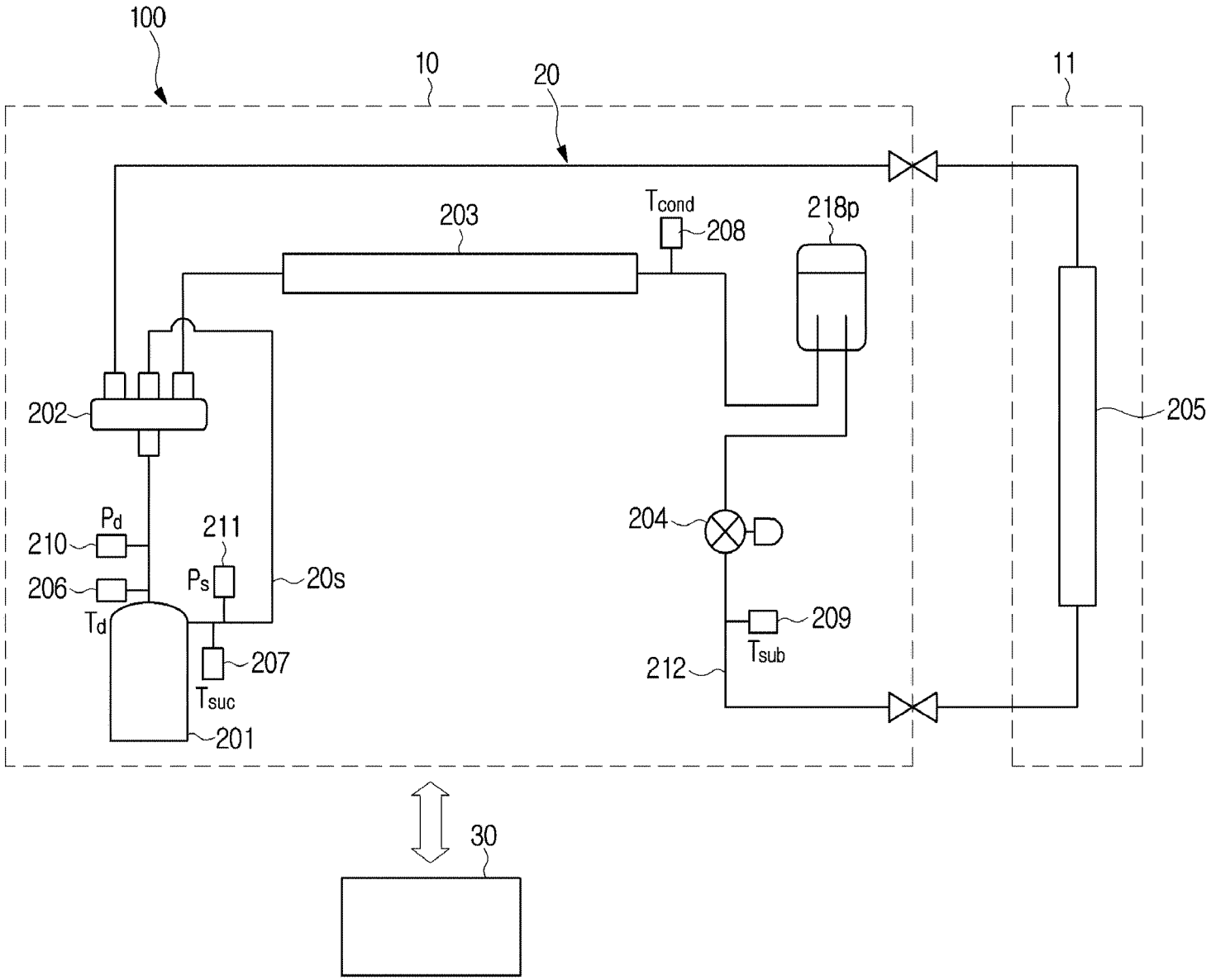
FIG. 10 is a view illustrating an air conditioner in a convention manner.

However, as for the air conditioner 100 in the conventional manner, there may be difficulties in sufficiently giving the degree of subcooling to the refrigerant before being suctioned into the first expansion valve 103, as mentioned below. FIG. 10 is a view illustrating an air conditioner 100 in the convention manner. In FIG. 10, components same as the components of the air conditioner 100 according to the embodiment illustrated in FIG. 9 may have the same reference and a detail description thereof will be omitted.

Figure 11:
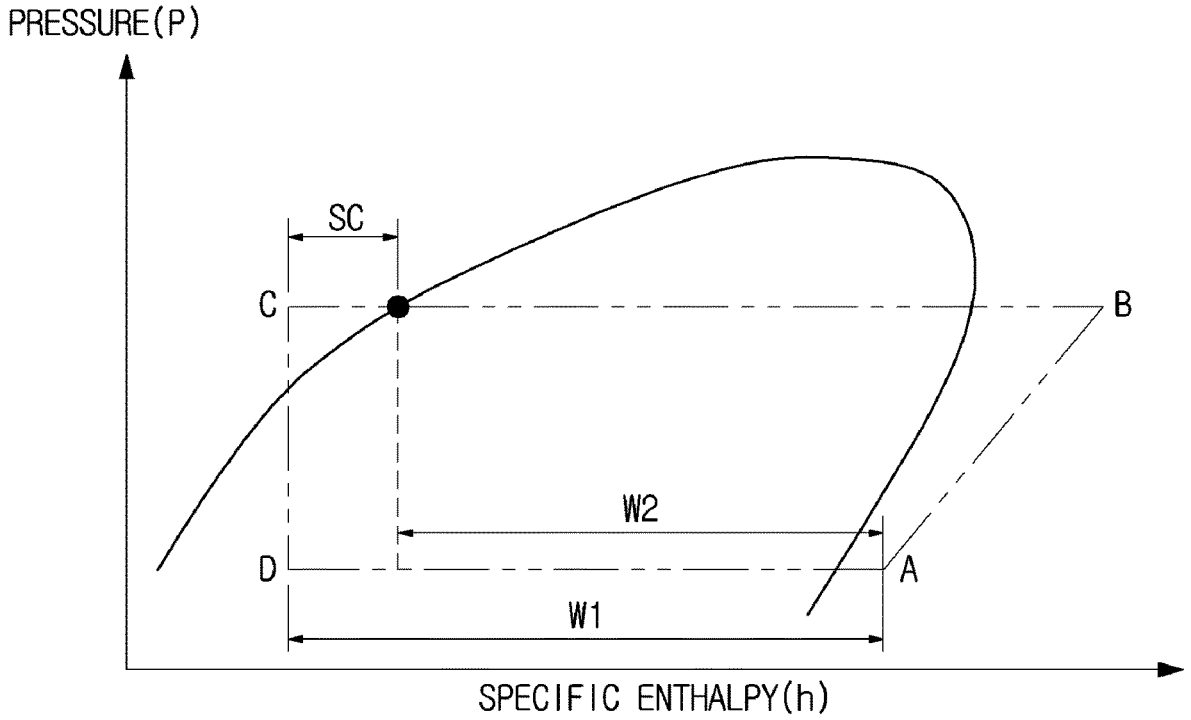
FIG. 11 is a p-h diagram of pressure-specific enthalpy of an air conditioner during the cooling operation.

FIG. 11 is a p-h diagram of pressure-specific enthalpy of the air conditioner 100 during the cooling operation. In FIG. 11, an alternate long and short dash line may represent a p-h diagram of the air conditioner 100 according to the fourth embodiment when the connection opening and closing valve 220 of the connection path 20*b* is closed, and the broken line may represent a p-h diagram of the air conditioner 100 in the conventional manner as illustrated in FIG. 10. FIG. 11 illustrates that between A-B corresponds to a compression cycle by the compressor 201 and between B-C corresponds to a condensation cycle by the outdoor heat exchanger 102. In addition, between C-D may correspond to a reducing pressure cycle by the first expansion valve 103 and between D-A may correspond to an evaporation cycle by the indoor heat exchanger 104.

As illustrated in FIG. 10, as for the air conditioner 100 in the conventional manner, a receiver 218*p* may be connected to a pipe between the outdoor heat exchanger 102 and the first expansion valve 103 in the refrigerant circuit 20. In addition, in comparison with the air conditioner 100 according to the fourth embodiment, the air conditioner 100 in the conventional manner may exclude the branch path 20*a*, as illustrated in FIG. 10.

As illustrated in FIG. 10, the air conditioner 100 in the conventional manner may store the surplus refrigerant, which is generated during the cooling operation or the defrosting operation, in the gas-liquid two-phase state in the receiver 218*p*. As illustrated in FIG. 10, as for the air conditioner 100 in the conventional manner, the liquid refrigerant in the gas-liquid two-phase refrigerant stored in the receiver 218*p* may be discharged from the receiver 218*p* to the refrigerant circuit 20 and then suctioned into the first expansion valve 103.

Accordingly, as for the air conditioner 100 as illustrated in FIG. 10, the refrigerant, which is discharged from the receiver 218*p* and before being suctioned into the first expansion valve 103, may become a saturated liquid state or a state closing to the saturated liquid state, as illustrated by a point X in FIG. 11. In other words, as for the air conditioner 100 illustrated in FIG. 10, it may be difficult that the refrigerant before being suctioned into the first expansion valve 103 becomes subcooled.

As for the air conditioner 100 as illustrated in FIG. 10, when the surplus refrigerant is stored in the gas-liquid two-phase state in the receiver 218*p*, the volume of the stored refrigerant may be increased. Therefore, there is a tendency that the receiver 218*p* becomes large.

In comparison with the above mentioned air conditioner, the air conditioner 100 according to fourth embodiment, the surplus refrigerant may be stored in the subcooled state in the receiver 218. Accordingly, before being suctioned into the first expansion valve 103, the refrigerant may become subcooled in comparison with the air conditioner 100 in the conventional manner, as illustrated in FIG. 10.

That is, during the cooling operation or the defrosting operation, a temperature of the refrigerant, which is condensed and liquefied in the outdoor heat exchanger 102 and then discharged from the outdoor heat exchanger 102, may have typically 50° C.~60° C. degree. The ambient temperature of the receiver 218 may have typically 20° C.~40° C. Therefore, the temperature of the refrigerant discharged from the outdoor heat exchanger 102 and then suctioned into the receiver 218 may be higher than the ambient temperature of the receiver 218. As mentioned above, the receiver 218 according to the fourth embodiment may be formed of a heat conductive material.

Accordingly, the refrigerant, which is discharged from the outdoor heat exchanger 102 and then suctioned into the receiver 218, may exchange a heat with the ambient air via a wall of the receiver 218. As a result, the refrigerant may be subcooled in the receiver 218 and the surplus refrigerant may be stored in the receiver 218 in the subcooled liquid state.

As mentioned above, the branch path 20*a* in which the receiver 218 is installed may be connected to the pipe between the outdoor heat exchanger 102 and the first expansion valve 103 in the refrigerant circuit 20. Accordingly, since the refrigerant stored in the receiver 218 become the subcooled state, the degree of subcooling (SC) may be given to the refrigerant before being suctioned into the first expansion valve 103, as illustrated in FIG. 11.

As a result, the refrigerating effect of the air conditioner 100 according to the fourth embodiment during the cooling operation and the defrosting operation (W1 of FIG. 11) may be increased in comparison with the refrigerating effect of the air conditioner 100 in the conventional manner (W2 of FIG. 11). In addition, the system efficiency of the air conditioner 100 according to the fourth embodiment may be improved in comparison with the air conditioner 100 as illustrated in FIG. 10.

For example, when comparing the refrigerant R410A with the refrigerant R32 that is used as a refrigerant for the air conditioner 100 according to the fourth embodiment, there may be a large difference in the enthalpy (difference in amount of heat) in the subcooling station. Accordingly, in the air conditioner 100 using the refrigerant R32 or the mixed refrigerant containing at least 70% by weight of refrigerant R32, as the refrigerant, it may be difficult for the refrigerant, which is before being suctioned into the first expansion valve 103 after being condensed, to become the subcooled state.

However, in the air conditioner 100 according to the fourth embodiment, the receiver 218 may store the refrigerant in the subcooled state, as mentioned above. Accordingly, although the refrigerant R32 or the mixed refrigerant containing at least 70% by weight of refrigerant R32 is used as a refrigerant for the air conditioner 100 according to the fourth embodiment, it may be possible for the refrigerant, which is before being suctioned into the first expansion valve 103 after being condensed, to become the subcooled state.

In addition, as for the air conditioner 100 according to the fourth embodiment, it may be possible to allow the refrigerant before suctioned into the first expansion valve 103 to be the subcooled state by installing the receiver 218, and thus there may be no need of increasing the volume of the outdoor heat exchanger 102 for subcooling the refrigerant.

As for the air conditioner 100 according to the fourth embodiment, during the cooling operation and the defrosting operation, the surplus refrigerant may be stored in the subcooled liquid state, and thus it may be possible to miniaturize the receiver 218 in comparison with when the surplus refrigerant is stored in the gas-liquid two-phase state.

Therefore the increase in size of the outdoor unit 10 in which the outdoor heat exchanger 102 and the receiver 218 are installed, may be prevented.

As for the air conditioner 100 according to the fourth embodiment, during the cooling operation and the defrosting operation, the surplus refrigerant may be stored in the subcooled state, and thus it may be possible to store the large amount of the surplus refrigerant in the receiver 218 in comparison with when the surplus refrigerant is stored in the gas-liquid two-phase state. Accordingly, during the defrosting operation in which it is easy to generate the surplus refrigerant, the large amount of the surplus refrigerant may be stored in the receiver 218 and thus the reliability of the compressor 201 may be improved.

As for the air conditioner 100 according to the fourth embodiment, the branch path 20*a* diverged from the refrigerant circuit 20 may be installed, and the receiver 218 may be installed in the end of the branch path 20*a*. In other words, the receiver 218 may be provided at a position where there is no interference to the refrigeration cycle operated by the refrigerant circuit 20. Accordingly, the fluctuation in the air conditioning performance due to storing the surplus refrigerant in the receiver 218 may be prevented in comparison with the air conditioner 100 in the conventional manner, in which the receiver 218 is installed in the refrigerant circuit 20 (refer to FIG. 10).

However, during the heating operation, as for the air conditioner 100, the outdoor heat exchanger 102 may allow the refrigerant to absorb a heat and then vaporize the refrigerant. Therefore, when the humidity of the outdoor air is high or when the temperature of the outdoor air is low, the frost may be generated in the outdoor heat exchanger 102 during the heating operation. When the frost is generated in the outdoor heat exchanger 102, the efficiency of the heat exchange in the outdoor heat exchanger 102 may be reduced and thus the evaporation of the refrigerant in the outdoor heat exchanger 102 may be prevented. As a result, the amount of the refrigerant circulating the refrigerant circuit 20 may be reduced and the heating capacity of the air conditioner 100 may be reduced. Further, when the outdoor heat exchanger 102 is left as having the frost, the evaporation temperature of the refrigerant in the outdoor heat exchanger 102 may be lowered and thus the outdoor heat exchanger 102 may become a condition in which the frost is easily generated.

To prevent the above mentioned case, the air conditioner 100 according to the fourth embodiment may perform the defrosting operation configured to remove frost from the outdoor heat exchanger 102 when the amount of the frost generated in the outdoor heat exchanger 102 exceeds a predetermined amount of the frost. As mentioned above, as for the air conditioner 100, the refrigerant may be circulated in the refrigerant circuit 20 during the defrosting operation as well as the cooling operation. Accordingly, the high temperature and high pressure refrigerant discharged from the compressor 201 may be suctioned into the outdoor heat exchanger 102 and thus the frost generated in the outdoor heat exchanger 102 may be melted. As a result, the frost may be removed from the outdoor heat exchanger 102.

As mentioned above, as for the air conditioner 100 according to the fourth embodiment, the surplus refrigerant may be stored in the receiver 218 during the defrosting operation. During the defrosting operation, the temperature of the outdoor air may be typically low and the temperature of the ambient air of the receiver 218 may be typically low in comparison with the cooling operation. Therefore, during the defrosting operation, the heat exchange between the refrigerant stored in the receiver 218 and the ambient air of the receiver 218 may be easily performed in comparison with the cooling operation. As a result, during the defrosting operation, the large amount of the refrigerant may be easily stored in the receiver 218.

As for the air conditioner 100, after the frost is removed from the outdoor heat exchanger 102 by the defrosting operation, the operation may be switched to the heating operation. As for the air conditioner 100, the refrigerant stored in the receiver 218 may pass the branch path 20*a* and then supplied to the refrigerant circuit 20 when the operation is switched from the defrosting operation to the heating operation.

Particularly, when the operation is switched from the defrosting operation to the heating operation, the gas-liquid two-phase state refrigerant, in which the pressure thereof is reduced in the first expansion valve 103, may flow to the pipe, which is between the first expansion valve 103 and the outdoor heat exchanger 102, to which the branch path 20*a* is connected, among the refrigerant circuit 20. During the heating operation, the temperature of the refrigerant after passing the first expansion valve 103 may be approximately −15° C.~−5° C. Therefore, when the operation is switched from the defrosting operation to the heating operation, the refrigerant temperature in the receiver 218 connected to the pipe between the first expansion valve 103 and the outdoor heat exchanger 102 via the branch path 20*a*, may be approximately −15° C.~−5° C.

In comparison with the above mentioned description, the temperature of the ambient air of the receiver 218 may be approximately 0° C.~10° C. That is, when the operation is switched from the defrosting operation to the heating operation, the temperature of the refrigerant in the receiver 218 may be lower than the temperature of the ambient air of the receiver 218. Accordingly, a part of the refrigerant stored in the receiver 218 may exchange a heat with the ambient air via the wall surface of the receiver 218 and then vaporized.

When a part of the refrigerant stored in the receiver 218 is vaporized, the refrigerant in the receiver 218 may be separated into a gas-like refrigerant part and a liquid-like refrigerant part. The gas-like refrigerant part may be placed in the vertical upper portion of the receiver 218 and the liquid-like refrigerant part may be placed in the vertical lower portion of the receiver 218. When the evaporation of the refrigerant is more processed in the receiver 218 and the gas-like refrigerant is increased, the liquid-like refrigerant may be pressed by the gas-like refrigerant. As a result, the liquid-like refrigerant may be discharged to the branch path 20*a* via the connector installed in the vertical lower portion of the receiver 218.

The refrigerant discharged from the receiver 218 to the branch path 20*a* may pass the receiver pressure-reducing valve 219 and then supplied to the refrigerant circuit 20. Accordingly, the amount of the refrigerant circulating the refrigerant circuit 20 may be increased and then the heating operation may be performed with the optical amount of the refrigerant.

When the operation is switched from the defrosting operation to the heating operation, as mentioned above, the temperature of the ambient air of the receiver 218 may be higher than a saturation temperature corresponding to pressure in the receiver 218. Because of this, during the heating operation, the refrigerant in the receiver 218 may be maintained in the superheated gas state. Accordingly, the liquid refrigerant may be prevented from flowing to the inside of the receiver 218. In other words, during the heating operation, it may be prevented that the refrigerant passes the branch path 20*a* from the refrigerant circuit 20 and then flow to the inside of the receiver 218.

In addition, as for the receiver 218 according to the fourth embodiment, the connector allowing the refrigerant to be entered or discharged may be installed in the vertical lower portion of the receiver 218. Therefore, when the operation of the air conditioner 100 is switched from the defrosting operation to the heating operation and the refrigerant stored in the receiver 218 is discharged from the receiver 218, it may be prevented that the lubricant contained in the refrigerant is remained in the receiver 218.

Particularly, when comparing the refrigerant R32 that is used as a refrigerant for the air conditioner 100 according to the fourth embodiment, with the refrigerant R410A, the solubility of the lubricant may be low at the low temperature. Therefore, in the case of the refrigerant R32 or the mixed refrigerant containing at least 70% by weight of refrigerant R32, it may be not ease to separate the lubricant from the refrigerant in comparison with the refrigerant R410A. However, according to the fourth embodiment, the connector may be installed in the vertical lower portion of the receiver 218 and thus the lubricant separated from the refrigerant in the receiver 218 may be discharged from the receiver 218 by the gravity. Accordingly, it may be prevented that the lubricant contained in the refrigerant is remained in the receiver 218, and the deterioration of lubricity of the refrigerant in the compressor 201 may be prevented.

Hereinafter controlling opening or closing of the receiver pressure-reducing valve 219 when the operation is switched from the defrosting operation to the heating operation in the air conditioner 100, will be described. As for the air conditioner 100 according to the fourth embodiment, when the operation is switched from the defrosting operation to the heating operation, the degree of the opening of the receiver pressure-reducing valve 219 may be changed to be smaller by the air conditioner controller 30 in comparison with the defrost operation.

The receiver pressure-reducing valve 219 may be set as the fully open state by the air conditioner controller 30 to store the surplus refrigerant in the receiver 218 during the cooling operation and the defrosting operation. Accordingly, during the cooling operation and the defrosting operation, the surplus refrigerant flowing to the branch path 20*a* may pass through the receiver pressure-reducing valve 219 without reducing the pressure thereof. The refrigerant passing through the receiver pressure-reducing valve 219 may be stored in the receiver 218 in the subcooled state, as mentioned above.

When the operation is switched from the defrosting operation to the heating operation, the degree of the opening of the receiver pressure-reducing valve 219 may be changed to be small by the air conditioner controller 30 on a point of time when the operation is switched to the heating operation. Therefore, the amount of the refrigerant passing through the receiver pressure-reducing valve 219 per unit time may be less in comparison with the fully open state of the receiver pressure-reducing valve 219.

When the operation is switched from the defrosting operation to the heating operation, the refrigerant discharged from the receiver 218 may be prevented from flowing into the refrigerant circuit 20 by controlling the degree of the opening of the receiver pressure-reducing valve 219.

When the operation is switched from the defrosting operation to the heating operation, the evaporation of the refrigerant may occur in the receiver 218 and then the large amount of the refrigerant may be discharged from the receiver 218, as mentioned above. Therefore, when the receiver pressure-reducing valve 219 is in the fully open state, the refrigerant discharged from the receiver 218 may rapidly flow to the refrigerant circuit 20 via the branch path 20*a*. When the refrigerant discharged from the receiver 218 rapidly flows to the refrigerant circuit 20, the refrigerant suctioned into the compressor 201 may be excessive. In this case, there may be a risk of damaging the compressor 201.

According to the fourth embodiment, the amount of the refrigerant flowing from the branch path 20*a* into the refrigerant circuit 20 may be reduced by allowing the degree of the opening of the receiver pressure-reducing valve 219 to be small and by adjusting the amount of the refrigerant passing through the receiver pressure-reducing valve 219. Accordingly, it may be prevented that the refrigerant suctioned into the compressor 201 is excessive and thus the failure of the compressor 201 may be prevented.

Figure 12:
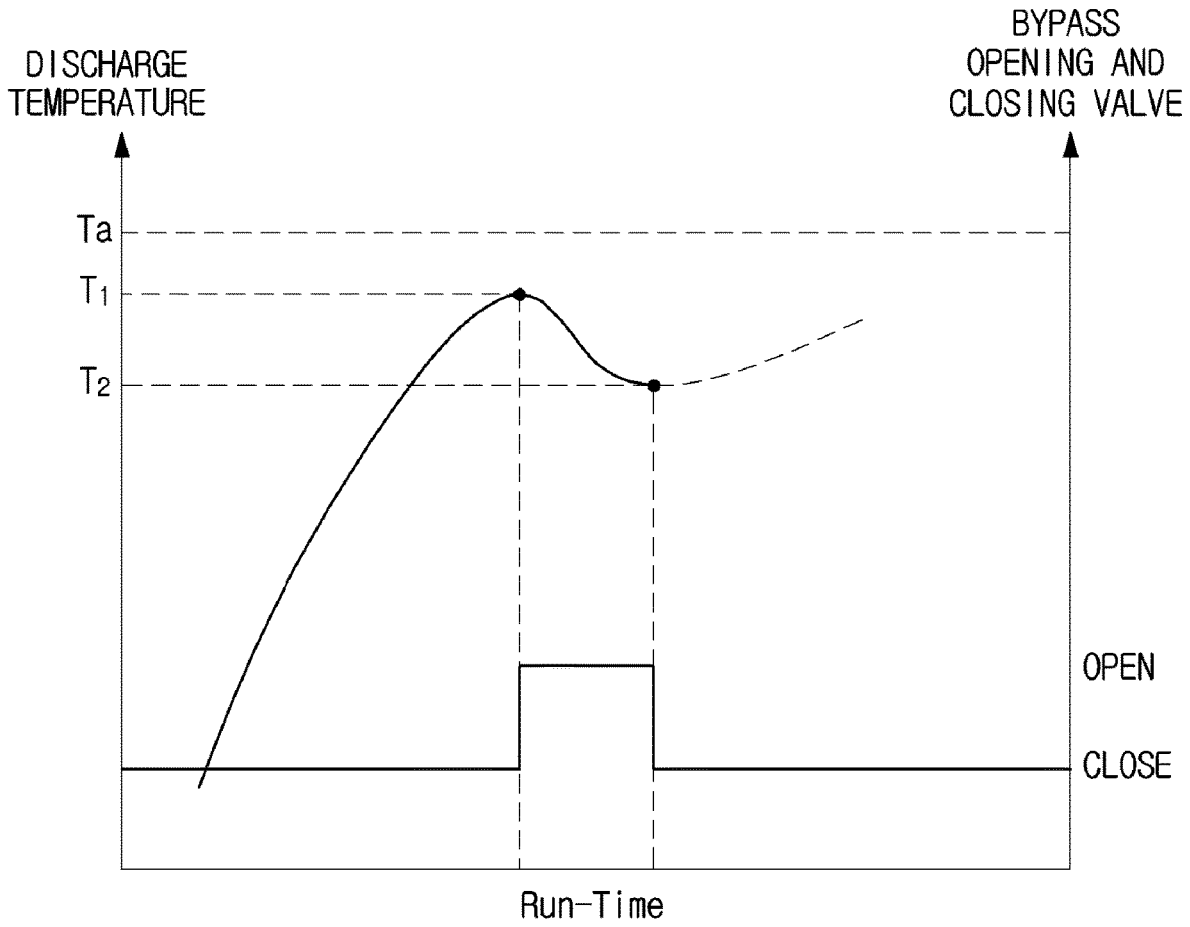
FIG. 12 is a view illustrating a relationship between a temperature of the refrigerant discharged from a compressor and an opening and closing of the connection opening and closing valve according to the fourth embodiment.
Figure 13:
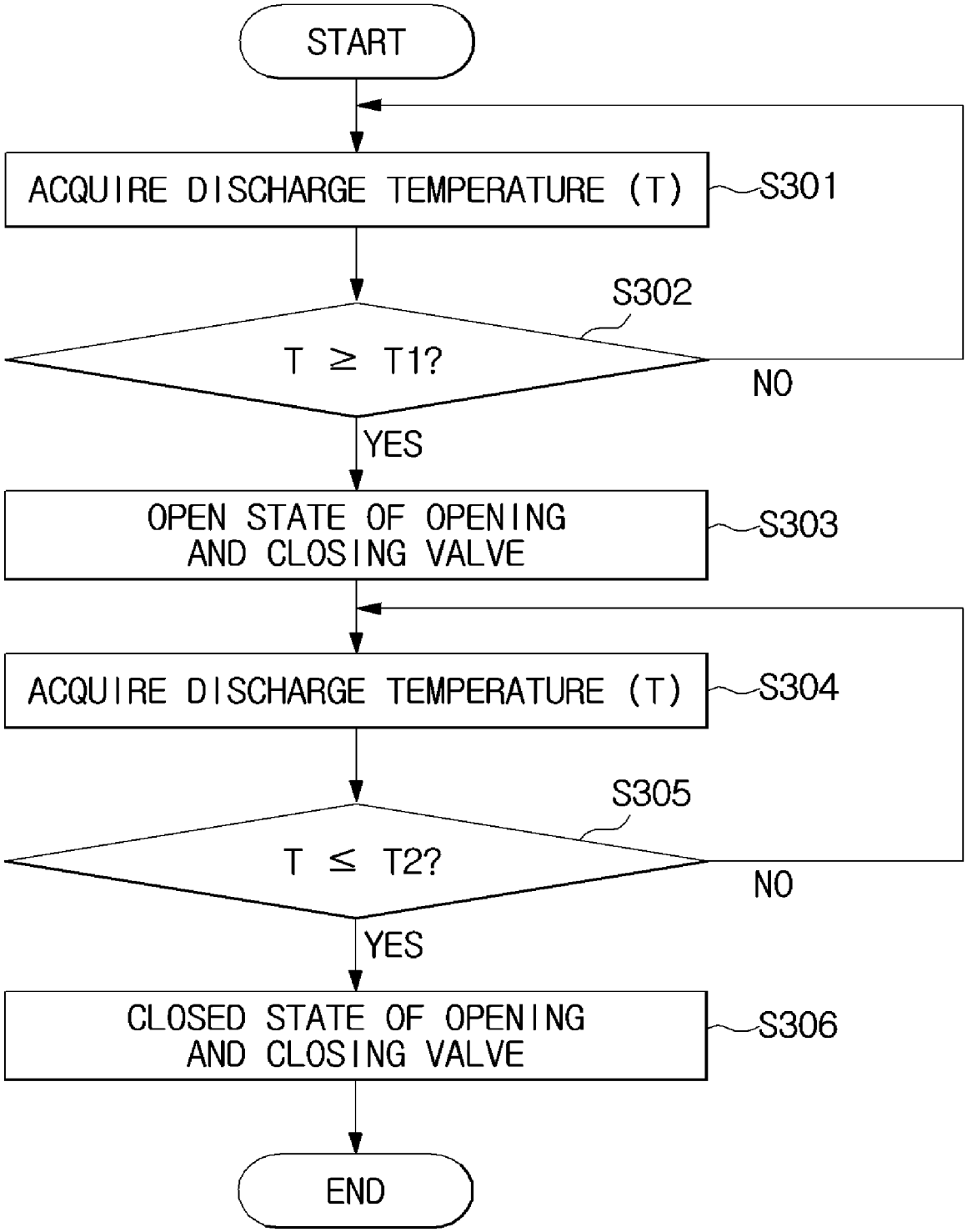
FIG. 13 is a flow chart illustrating a procedure of opening and closing control of the connection opening and closing valve operated by the air conditioner controller according to the fourth embodiment.

Hereinafter the operation by the connection path 20*b* and the connection opening and closing valve 220 will be described. FIG. 12 is a view illustrating a relationship between a temperature of the refrigerant discharged from the compressor 201 and the opening and closing of the connection opening and closing valve 220 according to the fourth embodiment. FIG. 13 is a flow chart illustrating a procedure of opening and closing control of the connection opening and closing valve 220 operated by the air conditioner controller 30 according to the fourth embodiment. As for the air conditioner 100 according to the fourth embodiment, the opening and closing of the connection opening and closing valve 220 may be controlled based on the temperature detection result by the discharge temperature sensor 206. Accordingly, the increase of the refrigerant temperature (discharge temperature) discharged from the compressor 201 may be prevented. Hereinafter a detail description of the control of the opening and closing of the connection opening and closing valve 220 will be described.

As for the air conditioner 100 according to the fourth embodiment, the connection opening and closing valve 220 may normally be in the closed state.

The air conditioner controller 30 may acquire the refrigerant temperature (discharge temperature; Td) discharged from the compressor 201 which is detected by the discharge temperature sensor 206 (step 301). The air conditioner controller 30 may compare the discharge temperature (Td) obtained in step 301 with a first reference temperature (T1) that is one example of the predetermined reference temperature (step 302). When it is determined that the discharge temperature (Td) is less than the first reference temperature (T1) (NO in step 302), the air conditioner controller 30 may return to step 301 and then continue the process.

When it is determined that the discharge temperature (Td) is equal to or more than the first reference temperature (T1) (YES in step 302), the air conditioner controller 30 may switch the closed state to the open state in the connection opening and closing valve 220 (step 303). Accordingly, the suppercooled state refrigerant stored in the receiver 218 may pass the connection path 20*b* and then supplied to the low pressure pipe 20*s* of the refrigerant circuit 20.

The connection path 20*b* may be connected to the pipe between the receiver 218 and the receiver pressure-reducing valve 219 in the branch path 20*a*. Because of this, when the connection opening and closing valve 220 is in the open state, the refrigerant stored in the receiver 218 may be not decompressed by the receiver pressure-reducing valve 219 and then supplied to the low pressure pipe 20*s* while being in the suppercooled state.

As a result, the temperature of the refrigerant suctioned into the compressor 201 from the low pressure pipe 20*s* may be lowered and then the compressor 201 may be cooled. The discharge temperature (Td) of the refrigerant discharged from the compressor 201 may be lowered.

The air conditioner controller 30 may acquire the discharge temperature (Td) detected by the discharge temperature sensor 206, again (step 304).

The air conditioner controller 30 may compare the discharge temperature (Td) obtained in step 304 with a second reference temperature (T2) that is one example of the predetermined reference temperature (step 305). When it is determined that the discharge temperature (Td) is higher than the second reference temperature (T2) (NO in step 305), the air conditioner controller 30 may return to step 304 and then continue the process.

When it is determined that the discharge temperature (Td) is equal to or lower than the second reference temperature (T2) (YES in step 305), the air conditioner controller 30 may switch the open state to the closed state in the connection opening and closing valve 220 (step 306).

Accordingly, the supply of the refrigerant to the low pressure pipe 20*s* via the connection path 20*b* may be stopped. As a result, the reduction of the discharge temperature (Td) of the refrigerant discharged from the compressor 201 may be terminated.

As mentioned above, as for the air conditioner 100 according to the fourth embodiment, by performing repeatedly opening and closing control of the connection opening and closing valve 220, it may be possible that the refrigerant temperature of the refrigerant discharged from the compressor 201 is within a predetermined range (from the first reference temperature (T1) to the second reference temperature (T2))

As a result, in the air conditioner 100, it may be possible to perform a stable air conditioning operation, and it may be prevented the system efficiency is lowered. It may be possible to prevent the difficulty of the compressor 201 caused by the rise of the discharge temperature.

As for the air conditioner 100 according to the fourth embodiment, the refrigerant R32 or the mixed refrigerant containing at least 70% by weight of refrigerant R32 may be used as the refrigerant. When comparing the refrigerant R32 with the refrigerant R410A, the refrigerant R32 may have the characteristics to allow the discharge temperature of the refrigerant discharged from the compressor 201 to be easily increased.

For example, during the heating operation when the temperature of the outdoor air is low, it may be ease to increase the discharge temperature (Td) of the refrigerant when the compression ratio of the refrigerant in the compressor 201 is large.

According to the fourth embodiment, it may be possible to directly cool the compressor 201 by the subcooled state refrigerant stored in the receiver 218. Therefore, although using a refrigerant in which the discharge temperature (Td) is easily increased or although performing the air conditioning operation under conditions in which the discharge temperature (Td) is easily increased, the rise of the discharge temperature (Td) may be prevented.

The first reference temperature (T1) may be set to a temperature lower than a discharge temperature limit (Ta) of the compressor 201. The discharge temperature limit (Ta) may represent a temperature in which the difficulty in the compressor 201 may occur, e.g., the deterioration of the seal material and the lubricating oil. By setting the first reference temperature (T1) as a temperature lower than the discharge temperature limit (Ta), it may be possible to prevent the discharge temperature (Td) from reaching the discharge temperature limit (Ta) and to prevent the deterioration of the compressor 201. In this case, the discharge temperature limit (Ta) of the compressor 201 may be approximately 120° C. and the first reference temperature (T1) may be set to approximately 110° C.

The second reference temperature (T2) may be not limited to a certain temperature and but the second reference temperature (T2) may be set to a temperature lower than the first reference temperature (T1). In this case, the second reference temperature (T2) may be set to approximately 90° C.

According to the fourth embodiment, it may be configured to switch the state of the connection opening and closing valve 220 into one of the open state or the closed state according to the discharge temperature (Td), but alternatively, it may be configured to change the degree of the opening of the connection opening and closing valve 220 as multi-stages according to the discharge temperature (Td). Particularly, it may be possible to allow the degree of the opening of the connection opening and closing valve 220 to be larger as the discharge temperature (Td) is increased, and to allow the degree of the opening of the connection opening and closing valve 220 to be smaller as the discharge temperature (Td) is decreased, by the air conditioner controller 30.

As for the air conditioner 100 according to the fourth embodiment, the amount of the refrigerant circulating the refrigerant circuit 20 may be adjusted by allowing the connection opening and closing valve 220 to be the open state. That is, when the connection opening and closing valve 220 is in the open state, the refrigerant stored in the receiver 218 may be supplied to the low-pressure pipe 20*s* of the refrigerant circuit 20. Accordingly, the amount of the refrigerant stored in the receiver 218 may be reduced and the amount of the refrigerant circulating the refrigerant circuit 20 may be increased.

It may be possible to perform the air conditioning operation with the optimal amount of refrigerant, by increasing the amount of the refrigerant circulating the refrigerant circuit 20 and by allowing the connection opening and closing valve 220 to be the open state during the cooling operation according to the temperature of the outside air or the room temperature, e.g. the temperature of the outside air is low.

As mentioned below, by using an opening and closing valve as the first expansion valve 103, the opening and closing of the first expansion valve 103, the receiver pressure-reducing valve 219 and the connection opening and closing valve 220 may be controlled in conjunction with each other by the air conditioner controller 30. Accordingly, after stopping the cooling operation and then performing the cooling operation again, the temperature of the refrigerant suctioned into the compressor 201 may be lowered.

Particularly, when stopping the cooling operation, the first expansion valve 103 may be switched into the closed state while the receiver pressure-reducing valve 219 is maintained to be the open state and the connection opening and closing valve 220 is maintained to be the closed state, by the air conditioner controller 30. Therefore, when stopping the cooling operation, the amount of the refrigerant flowing from the refrigerant circuit 20 to the branch path 20*a* may be increased and the refrigerant may be stored in the receiver 218. When starting the cooling operation, the first expansion valve 103 and the connection opening and closing valve 220 may be switched into the closed state by the air conditioner controller 30. Accordingly, the subcooled state refrigerant stored in the receiver 218 may be supplied to the low pressure pipe 20*s*, and the temperature of the refrigerant suctioned into the compressor 201 may be decreased. As a result, despite of starting the cooling operation, in which the temperature of the compressor 201 is easily increased, the reduction of the system efficiency of the cooling operation may be prevented.

In the above mentioned embodiment, the air conditioner 100 provided with the receiver pressure-reducing valve 219 that is an example of flow rate adjusting means has been described. However, the flow rate adjusting means is not limited to the pressure-reducing valve. For example, it may be possible to use an opening and closing value or a flow control valve, as the flow rate adjusting means. In this case, it may be possible to adjust the flow rate and the speed of the refrigerant that is discharged from the receiver 218 to the refrigerant circuit 20 via the branch path 20*a*.

According to the fourth embodiment, the refrigerant R32 or the mixed refrigerant containing at least 70% by weight of refrigerant R32 has been described as the refrigerant for the air conditioner 100, but the embodiment may be applied to an air conditioner using the different refrigerant. However, as described above, in consideration of the characteristics of refrigerant R32, the embodiment may be appropriately applied to the air conditioner 100 using the refrigerant R32 or the mixed refrigerant containing at least 70% by weight of refrigerant R32, as the refrigerant.

A Fifth Embodiment

The fifth embodiment of the present disclosure will be described with reference to the drawings.

Figure 14:
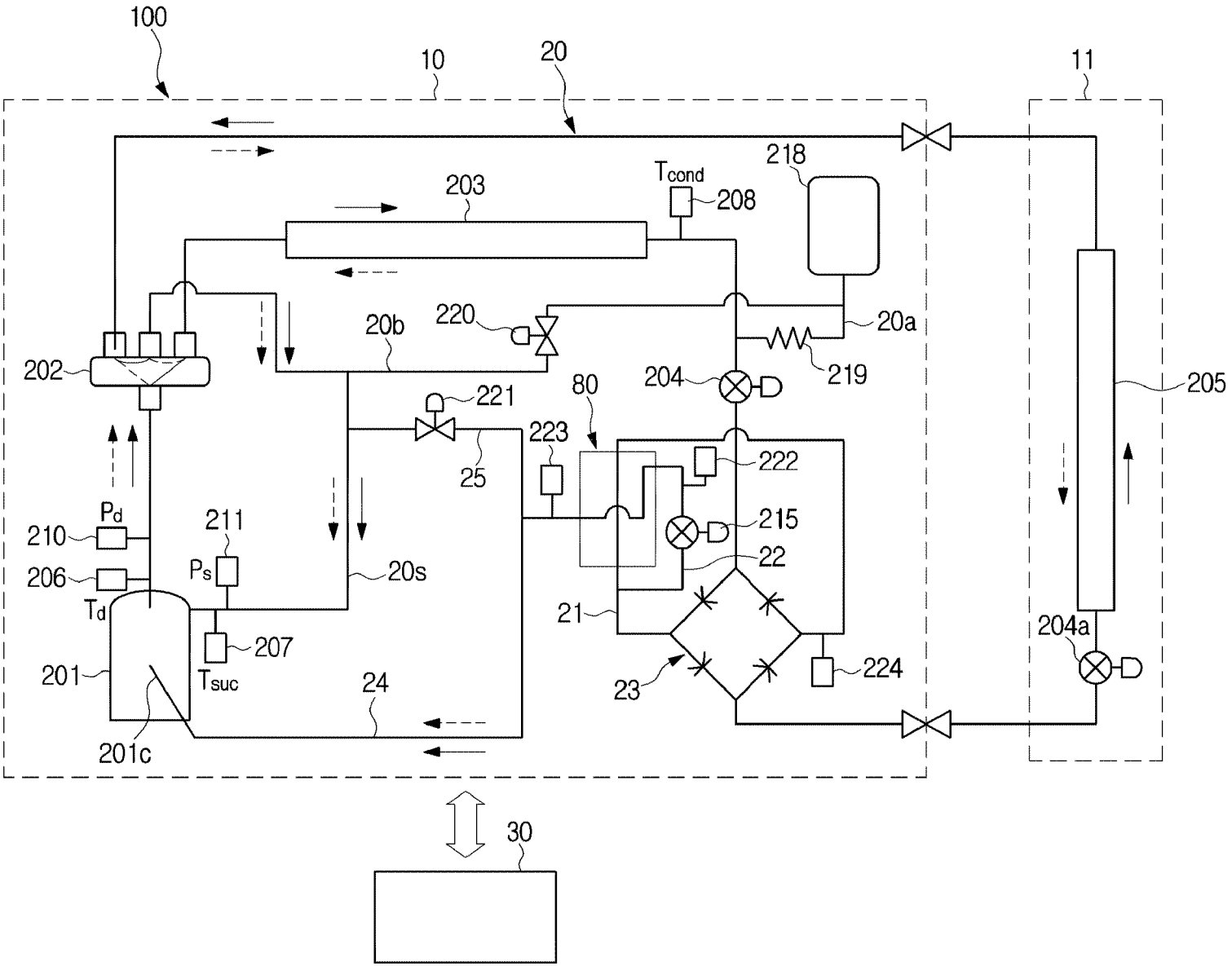
FIG. 14 is a schematic diagram illustrating a configuration of an air conditioner according to a fifth embodiment.

An air conditioner 100 according to the fifth embodiment may include components as illustrated in the fourth embodiment and further include a subcooler 80 configured to subcool the refrigerant after being condensed by the outdoor heat exchanger 102 or the indoor heat exchanger 104, as illustrated in FIG. 14. According to the fifth embodiment, the subcooler 80 may be installed in the outdoor unit 10 of the air conditioner 100.

Figure 15:
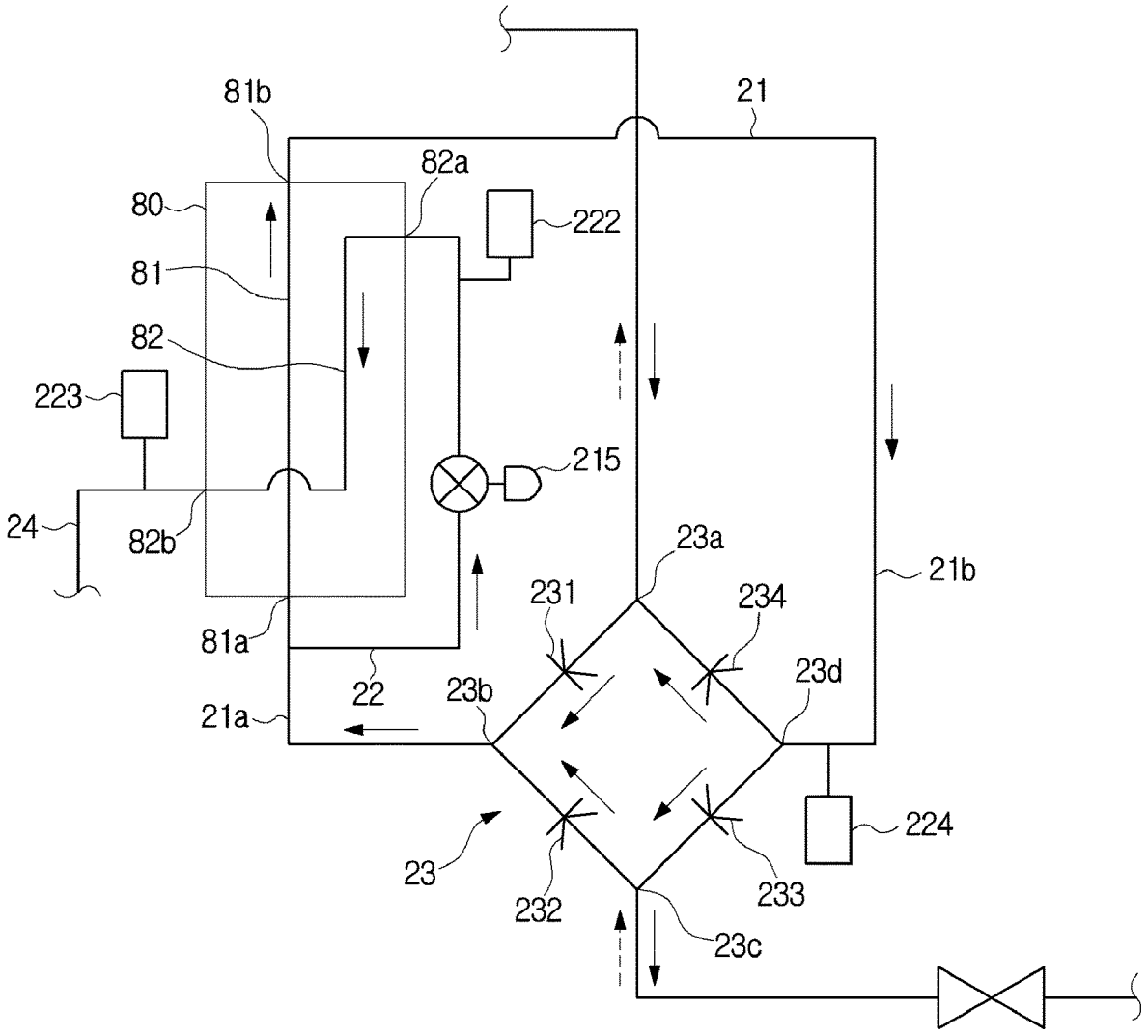
FIG. 15 is a view illustrating a configuration in the vicinity of a subcooler according to the fifth embodiment

As illustrated in FIG. 15, the subcooler 80 may include a first pipe 81 and a second pipe 82, wherein the first pipe 81 and the second pipe 82 are in parallel with each other. The first pipe 81 may include a first inlet portion 81*a* in which the refrigerant flows, and a first outlet portion 81*b* from which the refrigerant is discharged. The second pipe 82 may include a second inlet portion 82*a* in which the refrigerant flows, and a second outlet portion 82*b* from which the refrigerant is discharged.

According to the fifth embodiment, the first inlet portion 81*a* of the first pipe 81 may be installed in a position opposite to the second inlet portion 82*a* of the second pipe 82 about a transport direction of the refrigerant in the subcooler 80. The first outlet portion 81*b* of the first pipe 81 may be installed in a position opposite to the second outlet portion 82*b* of the second pipe 82 about a transport direction of the refrigerant in the subcooler 80.

In the subcooler 80, a flow direction of the refrigerant flowing in the first pipe 81 may be opposite to a flow direction of the refrigerant flowing in the second pipe 82. In other words, in the subcooler 80, the flow direction of the refrigerant flowing in the first pipe 81 and the flow direction of the refrigerant flowing in the second pipe 82 may be a counter flow.

As illustrated in FIG. 14, the air conditioner 100 may include a first expansion valve 204*a* and 204*b* configured to expand and vaporize the refrigerant that is subcooled in the subcooler 80 so as to allow the refrigerant to be low temperature and low pressure. According to the fifth embodiment, the first expansion valve 204*a* in an one side may be installed in the outdoor unit 10 and the first expansion valve 204*b* in the other side may be installed in the indoor unit 11. As for the air conditioner 100 according to the fifth embodiment, during the cooling operation or the defrosting operation, the first expansion valve 204*a* in the one side may expand and vaporize the refrigerant. During the heating operation, the first expansion valve 204*b* in the other side may expand and vaporize the refrigerant.

The air conditioner 100 may include a connection opening and closing valve 221 configured to regulate an amount of the refrigerant passing a connection path 25 described later.

The air conditioner 100 may include a subcooling pressure-reducing valve (second expansion valve) 215 configured to decompress the refrigerant and configured to regulate the flow of the refrigerant flowing in a subcooling branch path 22 described later.

The compressor 201 may include an intermediate pressure suction 201*c* to which the refrigerant having an intermediate pressure is suctioned via an injection path 24, described later.

According to the fifth embodiment, the air conditioner 100 may include a subcooling path 21 installed in the above mentioned subcooler 80. The subcooling path 21 may be connected to a pipe between the first expansion valve 204*a* in the one side and the first expansion valve 204*b* in the other side in the refrigerant circuit 20, via a bridge circuit 23, described later.

The subcooling path 21 may include an upstream side subcooling path 21*a* connecting a second connection point 23*b* of the bridge circuit 23 described later to the first inlet portion 81*a* of the first pipe 81 in the subcooler 80. The subcooling path 21 may include a lower side subcooling path 21*b* connecting a fourth connection point 23*d* of the bridge circuit 23 described later to the first outlet portion 81*b* of the first pipe 81 in the subcooler 80.

According to the fifth embodiment, the air conditioner 100 may include a subcooling branch path 22 diverged from the upstream side subcooling path 21*a* and connected to the second inlet portion 82*a* of the second pipe 82 in the subcooler 80.

The air conditioner 100 may include the bridge circuit 23 to allow the flow direction of the refrigerant in the subcooling path 21 and the subcooling branch path 22 to be one direction during the cooling operation (defrosting operation) and the heating operation.

The bridge circuit 23 may be configured in a way in which four pipes are connected. Particularly, as shown in FIG. 15, the bridge circuit 23 may include four pipes in which a first non-return valve 231, a second non-return valve 232, a third non-return valve 233 and a fourth non-return valve 234 are formed, respectively. The four pipes may form a closed loop through a first connection point 23*a*, a second connection point 23*b*, a third connection point 23*c* and a four connection points 23*d*.

In the bridge circuit 23, a pipe extending from the first expansion valve 204*b* in the other side in the refrigerant circuit 20 may be connected to the first connection point 23*a*. A pipe extending from the first expansion valve 204*a* in the one side among the refrigerant circuit 20 may be connected to the third connection point 23*c*. The upstream side subcooling path 21*a* may be connected to the second connection point 23*b*. The downstream side subcooling path 21*b* may be connected to the fourth connection point 23*d*.

The air conditioner 100 may include the injection path 24 configured to allow the intermediate pressure suction 201*c* of the compressor 201 to suction the refrigerant passing the second pipe 82 of the subcooler 80. As illustrated in FIG. 15, the injection path 24 may be connected to the second outlet portion 82*b* of the second pipe 82 in the subcooler 80.

The air conditioner 100 may include the connection path 25 configured to connect the injection path 24 to the low pressure pipe 20*s* in the refrigerant circuit 20.

According to the fifth embodiment, the air conditioner 100 may include an inlet temperature sensor 222 installed in the subcooling branch path 22 and configured to detect the refrigerant before being suctioned into the second pipe 82 of the subcooler 80. The air conditioner 100 may include an outlet temperature sensor 223 installed in the injection path 24 and configured to detect the refrigerant discharged from the second outlet portion 82*b* of the second pipe 82. The air conditioner 100 may include a subcooling temperature sensor 224 installed in the downstream side subcooling path 21*b* and configured to detect the refrigerant discharged from the first outlet portion 81*b* of the first pipe 81.

According to the fifth embodiment, the degree of the opening of the subcooling pressure-reducing valve 215 may be controlled by the air conditioner controller 30 based on the result of the detection by the inlet temperature sensor 222, the outlet temperature sensor 223 and the subcooling temperature sensor 224. A detail description of the control of the degree of the opening of the subcooling pressure-reducing valve 215 by the air conditioner controller 30 will be described in the end.

As for the air conditioner 100 according to the fifth embodiment, a non-azeotropic mixed refrigerant containing two or three refrigerants containing a refrigerant R32 (HFC32) and HFO1234yf or HFO1234ze may be used as the refrigerant. The non-azeotropic mixed refrigerant may include a natural refrigerant.

When comparing the non-azeotropic mixed refrigerant containing the refrigerant R32 and HFO1234yf or HFO1234ze with the refrigerant R32, the global warming coefficient may be low. Therefore, as for the air conditioner 100 according to the fifth embodiment, by using the non-azeotropic mixed refrigerant containing the refrigerant R32 and HFO1234yf or HFO1234ze, the impact on the environment may be reduced.

As for the air conditioner 100 according to the fifth embodiment, it may be appropriate that the non-azeotropic mixed refrigerant is characterized in that HFC content is less than 70% by weight, HFO1234yf or HFO1234ze content is less than 30% by weight, and the remainder is a natural refrigerant. By setting the mixing ratio of the non-azeotropic mixed refrigerant, as mentioned above, a temperature gradient in the saturation station of the non-azeotropic mixed refrigerant is more than 2 degree. In this case, as described later, the heat exchange efficiency in the subcooler 80 may be improved and the refrigeration effect of the air conditioner 100 may be improved.

A behavior of the refrigerant in the air conditioner 100 according to the fifth embodiment will be described with reference to FIGS. 14 and 15. In the air conditioner 100, the behavior of the refrigerant in the refrigerant circuit 20 may be same as the behavior of the refrigerant according to the fourth embodiment. Therefore, the behavior of the refrigerant in the bridge circuit 23, the subcooling path 21 and the subcooling branch path 22 will be described.

As mentioned above, the bridge circuit 23 may be provided with the first non-return valve 231 to the fourth non-return valve 234. As illustrated by an arrow in FIG. 15, the refrigerant may flow from the first non-return valve 231 to the fourth non-return valve 234 in one direction.

As for the air conditioner 100, during the cooling operation or the defrosting operation, the refrigerant condensed in the outdoor heat exchanger 102 and passing through the first expansion valve 204*b* in the other side may flow from the first connection point 23*a* to the bridge circuit 23. The refrigerant flowing to the bridge circuit 23 may pass the first non-return valve 231 and then discharged from the second connection point 23*b* to the upstream side subcooling path 21*a*.

The refrigerant discharged to the upstream side subcooling path 21*a* may be divided into the side of the subcooling path 21 toward the first pipe 81 of the subcooler 80 and the side of the subcooling branch path 22 toward the second pipe 82.

The refrigerant in the side of the subcooling path 21 may flow from the first inlet portion 81*a* to the first pipe 81. The refrigerant flowing into the first pipe 81 may exchange a heat with the refrigerant flowing in the second pipe 82 and then discharged from the first outlet portion 81*b* to the downstream side subcooling path 21*b*. The refrigerant discharged into the downstream side subcooling path 21*b* may pass the fourth connection point 23*d* and then flow into the bridge circuit 23. The refrigerant flowing into the bridge circuit 23 may pass through the third non-return valve 233 and then discharged from the third connection point 23*c* to the refrigerant circuit 20. The refrigerant discharged into the refrigerant circuit 20 may be decompressed in the first expansion valve 204*a* in the one side and then circulate the refrigerant circuit 20, like in the fourth embodiment.

The refrigerant in the side of the subcooling branch path 22 may flow from the second inlet portion 82*a* into the second pipe 82.

The refrigerant flowing into the second pipe 82 may exchange a heat with the refrigerant flowing in the first pipe 81 and then discharged from the second outlet portion 82*b* to the injection path 24.

The refrigerant discharged to the injection path 24 may be suctioned from the intermediate pressure suction 201*c* to the compressor 201.

The heat exchange of the refrigerant in the subcooler 80 will be described in details in the end portion.

As for the air conditioner 100, during the heating operation, the refrigerant, which is condensed in the indoor heat exchanger 104 and passes through the first expansion valve

204*a* in the one side, may flow from the third connection point 23*c* to the bridge circuit 23. The refrigerant flowing to the bridge circuit 23 may pass the second non-return valve 232 and discharged from the second connection point 23*b* to the upstream side subcooling path 21*a*.

The refrigerant discharged to the upstream side subcooling path 21*a* may be divided into the side of the subcooling path 21 toward the first pipe 81 and the side of the subcooling branch path 22 toward the second pipe 82 of the subcooler 80.

The refrigerant in the side of the subcooling path 21 may flow from the first inlet portion 81*a* to the first pipe 81 in the same manner as the cooling operation. The refrigerant flowing into the first pipe 81 may exchange a heat with the refrigerant flowing in the second pipe 82 and then discharged from the first outlet portion 81*b* to the downstream side subcooling path 21*b*. The refrigerant discharged into the downstream side subcooling path 21*b* may pass the fourth connection point 23*d* and then flow into the bridge circuit 23. The refrigerant flowing into the bridge circuit 23 may pass through the fourth non-return valve 234 and then discharged from the first connection point 23*a* to the refrigerant circuit 20. The refrigerant discharged into the refrigerant circuit 20 may be decompressed in the first expansion valve 204*a* in the one side and then circulate the refrigerant circuit 20, in the same manner as the fourth embodiment.

The refrigerant in the side of the subcooling branch path 22 may flow from the second inlet portion 82*a* into the second pipe 82, in the same manner as in the cooling operation. The refrigerant flowing into the second pipe 82 may exchange a heat with the refrigerant flowing in the first pipe 81 and then discharged from the second outlet portion 82*b* to the injection path 24.

The refrigerant discharged to the injection path 24 may be suctioned from the intermediate pressure suction 201*c* to the compressor 201.

As mentioned above, according to the fifth embodiment, during the cooling operation (the defrosting operation), the flow direction of the refrigerant in the subcooling path 21 and the subcooling branch path 22 may be the same as during the heating operation. Accordingly, during the cooling operation and the heating operation, the refrigerant flowing in the first pipe 81 and the second pipe 82 of the subcooler 80 may be a counter flow in the both sides.

Hereinafter the heat exchange of the refrigerant in the subcooler 80 will be described according to the fifth embodiment.

Figure 16:
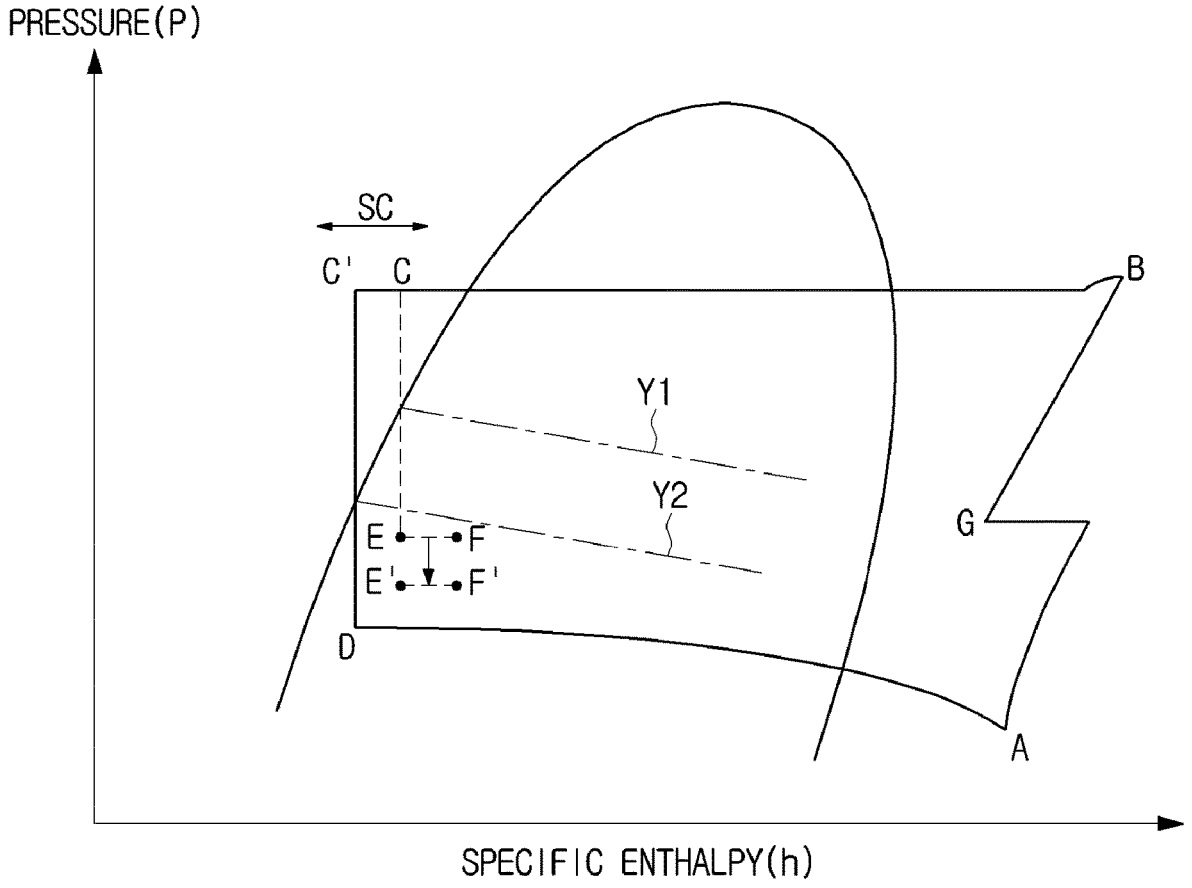
FIG. 16 is a p-h diagram of pressure-specific enthalpy of the air conditioner according to the fifth embodiment.

FIG. 16 is a p-h diagram of pressure-specific enthalpy of the air conditioner 100 according to the fifth embodiment. FIG. 16 illustrates the p-h diagram during the cooling operation but during the heating operation, the p-h diagram has the same trend as FIG. 16.

FIG. 16 illustrates that between A-B corresponds to a compression cycle by the compressor 201 and between B-C corresponds to a condensation cycle by the outdoor heat exchanger 102. In addition, between C-E may correspond to a reducing pressure cycle by the subcooling pressure-reducing valve 215. A point G may correspond to the intermediate pressure suction 201*c* of the compressor 201.

Further, between C-C' and between E-F may correspond to a heat exchange cycle by the subcooler 80. Particularly, between C-C' may correspond to the refrigerant state from the first inlet portion 81*a* to the first outlet portion 81*b* in the first pipe 81 of the subcooler 80. Between E-F may correspond to the refrigerant state from the second inlet portion 82*a* to the second outlet portion 82*b* in the second pipe 82 of the subcooler 80

Between C'-D may correspond to the reducing pressure cycle by the first expansion valve 204*a* and between D-A may correspond to an evaporation cycle by the indoor heat exchanger 104.

In FIG. 16, a one-dot chain line Y1 and Y2 may represent an isotherm. Y1 may correspond to the refrigerant temperature in a point C (the first inlet portion 81*a*). Y2 may correspond to the refrigerant temperature in a point C' (the first outlet portion 81*b*).

As mentioned above, in the subcooler 80, the heat exchange may be performed between the refrigerant flowing in the first pipe 81 and the refrigerant flowing in the second pipe 82. Accordingly, the refrigerant flowing in the first pipe 81 may be super cooled.

Particularly, the refrigerant condensed by the outdoor heat exchanger 102 or the indoor heat exchanger 104 may flow in the first pipe 81. That is, the high-pressure liquid state refrigerant after condensation may flow in the first pipe 81, as illustrated in between C-C' of FIG. 16.

The refrigerant decompressed by the subcooling pressure-reducing valve 215 installed in the subcooling branch path 22 may flow in the second pipe 82. That is, as illustrated in between E-F of FIG. 16, the gas-liquid two-phase state refrigerant (saturation station) having the low temperature and the low pressure may flow in the second pipe 82 in comparison with the refrigerant flowing in the first pipe 81.

In the subcooler 80, a heat may be taken from the high pressure liquid refrigerant flowing in the first pipe 81 by the cold and low pressure refrigerant flowing in the second pipe 82. Accordingly, in the subcooler 80, the refrigerant flowing in the first pipe 81 may be super cooled.

Figure 17A:
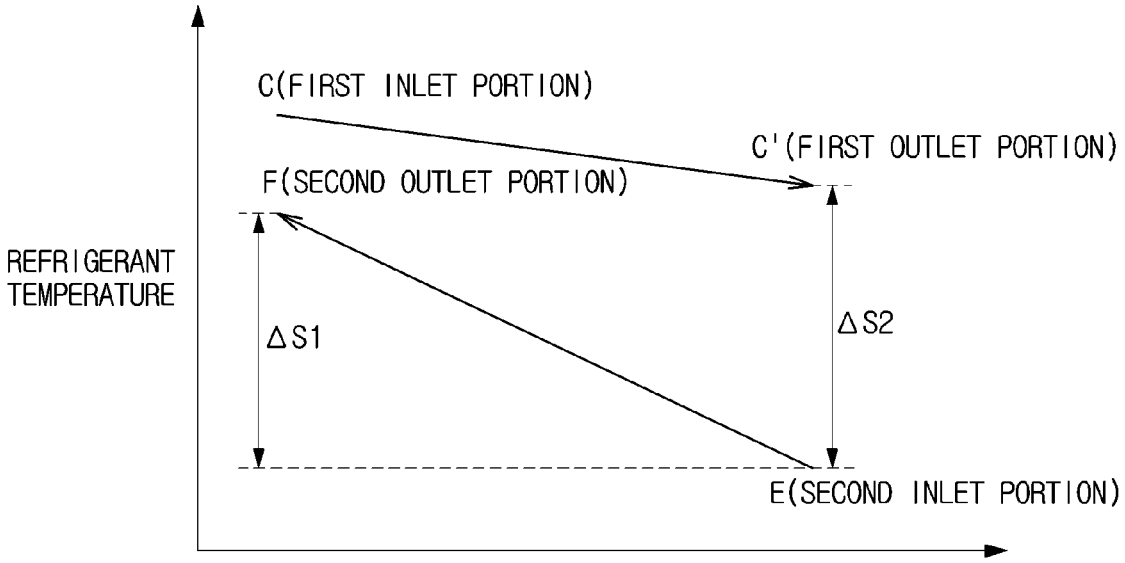
FIG. 17A illustrates a relationship when a refrigerant flowing in a first pipe and a refrigerant flowing in a second pipe are counter flows according to the fifth embodiment.
Figure 17B:
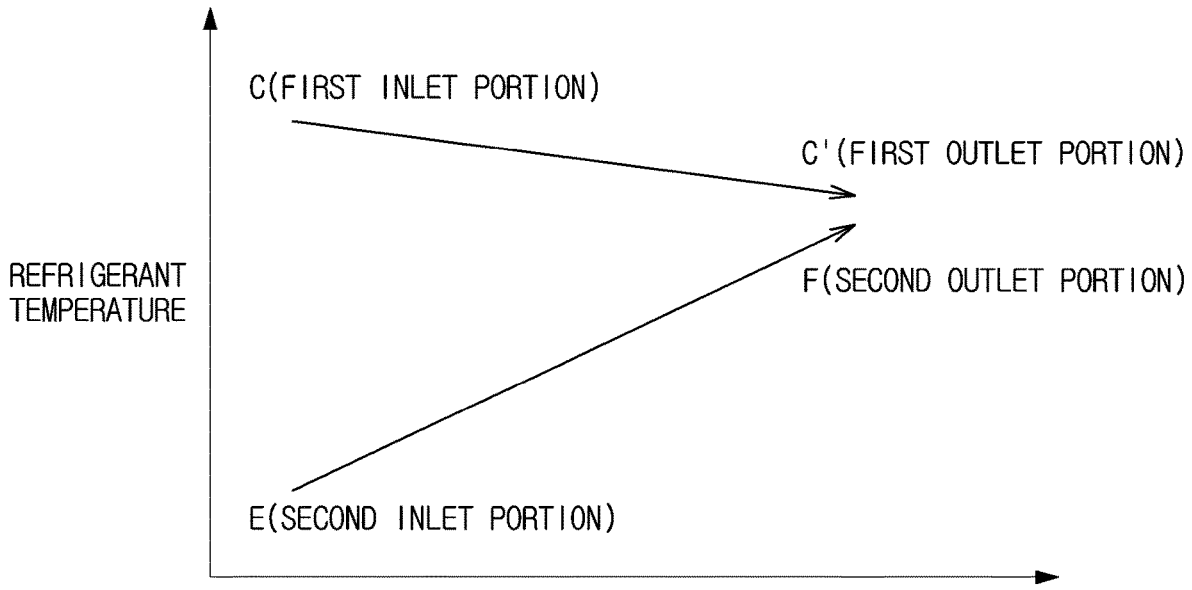
FIG. 17B illustrates the relationship when the refrigerant flowing in the first pipe and the refrigerant flowing in the second pipe are parallel flows.

FIGS. 17A and 17B are views illustrating a relationship between the temperature of the refrigerant flowing in the first pipe 81 and the temperature of the refrigerant flowing in the second pipe 82 in the subcooler 80. FIG. 17A illustrates the relationship when the refrigerant flowing in the first pipe 81 and the refrigerant flowing in the second pipe 82 are counter flows according to the fifth embodiment. FIG. 17B illustrates the relationship when the refrigerant flowing in the first pipe 81 and the refrigerant flowing in the second pipe 82 are parallel flows.

As mentioned above, according to the fifth embodiment, the non-azeotropic mixed refrigerant containing the refrigerant R32 and HFO1234yf or HFO1234ze may be used as the refrigerant. By using the non-azeotropic mixed refrigerant, a temperature gradient may occur in the refrigerant in the second pipe 82 in which the gas-liquid two-phase state refrigerant (saturation station) flows. In other words, as shown in FIG. 17A, a temperature difference (Δ S1) may be generated between the second inlet portion 82*a* (point E) and the second outlet portion 82*b* (point F).

As mentioned above, as for the subcooler 80 according to the fifth embodiment, the refrigerant flowing in the first pipe 81 and the refrigerant flowing in the second pipe 82 may be a counter flow. Accordingly, as illustrated in FIG. 16 or 17A, in an entire area from the first inlet portion 81*a* (point C) to the first outlet portion 81*b* (point C'), the temperature difference between the refrigerant flowing in the first pipe 81 and the refrigerant flowing in the second pipe 82 may be secured. In other words, the temperature difference between the refrigerant flowing in the first pipe 81 and the refrigerant flowing in the second pipe 82 may be large in comparison with a case of FIG. 17*b* illustrating that the refrigerant flowing in the first pipe 81 and the second pipe 82 is a parallel flow.

Accordingly, for example, in comparison with a case that the refrigerant flowing in the first pipe 81 and the second pipe 82 is a parallel flow, it may be possible to give a large degree of subcooling (SC) by the refrigerant before being suctioned to the first expansion valve 204*a* in the one side (during the heating operation, the first expansion valve 204*b* in the other side).

As for the air conditioner 100 according to the fifth embodiment, during the heating operation and the cooling operation, the refrigeration effect may be improved in both sides, in comparison with a case to which the configuration is not applied.

As mentioned above, according to the fifth embodiment, the non-azeotropic mixed refrigerant containing the refrigerant R32 and HFO1234yf or HFO1234ze may be used as the refrigerant.

When using the non-azeotropic mixed refrigerant containing the refrigerant R32 and HFO1234yf or HFO1234ze, the refrigeration effect may be low in comparison with the refrigerant R32. Because of this, it may be required to use the large amount of the refrigerant circulating in the air conditioner 100 to obtain the same efficiency as using the refrigerant R32. However, when increasing the amount of refrigerant circulating in the air conditioner 100, it may be easy to grow the pressure loss in the subcooler 80. In this case, the heat exchange efficiency in the subcooler 80 may be reduced and thus it may be difficult to sufficiently super cool the refrigerant in the subcooler 80.

As for the subcooler 80 according to the fifth embodiment, during the cooling operation and the heating operation, the heat exchange may be performed in the counter flow manner in the both sides. Accordingly, in comparison with performing the heat exchanger in the parallel flow manner, the reduction in the heat exchange efficiency in the subcooler 80 may be prevented. As a result, it may be possible sufficiently super cool the refrigerant in the subcooler 80. Although the non-azeotropic mixed refrigerant containing the refrigerant R32 and HFO1234yf or HFO1234ze, which has a relative low refrigeration effect than the refrigerant R32, is used as the refrigerant, the reduction in the refrigeration effect may be prevented.

According to the fifth embodiment, the subcooling branch path 22 diverged from the subcooling path 21 may be installed in the upstream side of the subcooler 80. In the subcooler 80, the refrigerant that is diverged to the subcooling branch path 22 and flows into the second pipe 82, may super cool the refrigerant flowing in the first pipe 81.

Therefore, as for the subcooler 80 according to the fifth embodiment, the amount of the refrigerant flowing from the subcooling path 21 to the first pipe 81 of the subcooler 80 may be reduced in comparison with a case in which the subcooling branch path 22 is not installed in the subcooler 80. As a result, the pressure loss generated in the first pipe 81 of the subcooler 80 may be reduced and thus the reduction in the heat exchange efficiency in the subcooler 80 may be more prevented.

As for the air conditioner 100 according to the fifth embodiment, the refrigerant discharged from the second outlet portion 82*b* of the second pipe 82 in the subcooler 80, may be suctioned into the intermediate pressure suction 201*c* of the compressor 201. In other words, the intermediate pressure refrigerant whose temperature is lowered by the heat exchange in the subcooler 80 may be suctioned into the intermediate pressure suction 201*c* of the compressor 201.

As a result, as illustrated in FIG. 16, as for the air conditioner 100 according to the fifth embodiment, the temperature of the refrigerant may be lowered in the intermediate pressure suction 201*c* (point G) of the compressor 201. Accordingly, the temperature of the refrigerant (discharge temperature) discharged from the discharge unit (point B) of the compressor 201 may be prevented from increasing in comparison with a case in which the refrigerant discharged from the second pipe 82, is not suctioned into the intermediate pressure suction 201*c*. For example, the difficulties may be prevented, wherein the difficulties includes the reduction of service life of the compressor 201, caused by raising the discharge temperature.

The air conditioner 100 according to the fifth embodiment may include the connection path 25 connecting the injection path 24 to the low pressure pipe 20*s* in the refrigerant circuit 20. The connection opening and closing valve 221 in which the degree of the opening thereof is controlled by the air conditioner controller 30 may be installed in the connection path 25.

According to the fifth embodiment, by controlling the degree of the opening of the connection opening and closing valve 221, it may be possible to adjust the pressure of the refrigerant flowing in the injection path 24 and the second pipe 82 of the subcooler 80.

Particularly, when the connection opening and closing valve 221 is in the open state, the low pressure pipe 20*s* of the refrigerant circuit 20 may be connected to the injection path 24 via the connection path 25. Accordingly, the pressure of the refrigerant flowing in the injection path 24 and the second pipe 82 of the subcooler 80 may be lowered in comparison with a case in which the connection opening and closing valve 221 is in the closed state.

When the pressure of the refrigerant flowing in the second pipe 82 is lowered, the state of the refrigerant flowing in the second pipe 82 may be changed from E-F to E-F' as illustrated in FIG. 16. Accordingly, the average temperature difference of the refrigerant flowing in between the second pipe 82 and the first pipe 81 may become large. As a result, the efficiency of the heat exchange may be improved in the subcooler 80, and the refrigerant flowing in the first pipe 81 may be more super cooled. The refrigeration effect on the air conditioner 100 may be enhanced.

Hereinafter the control of the degree of the opening of the subcooling pressure-reducing valve 215 performed by the air conditioner controller 30 will be described.

Figure 18:
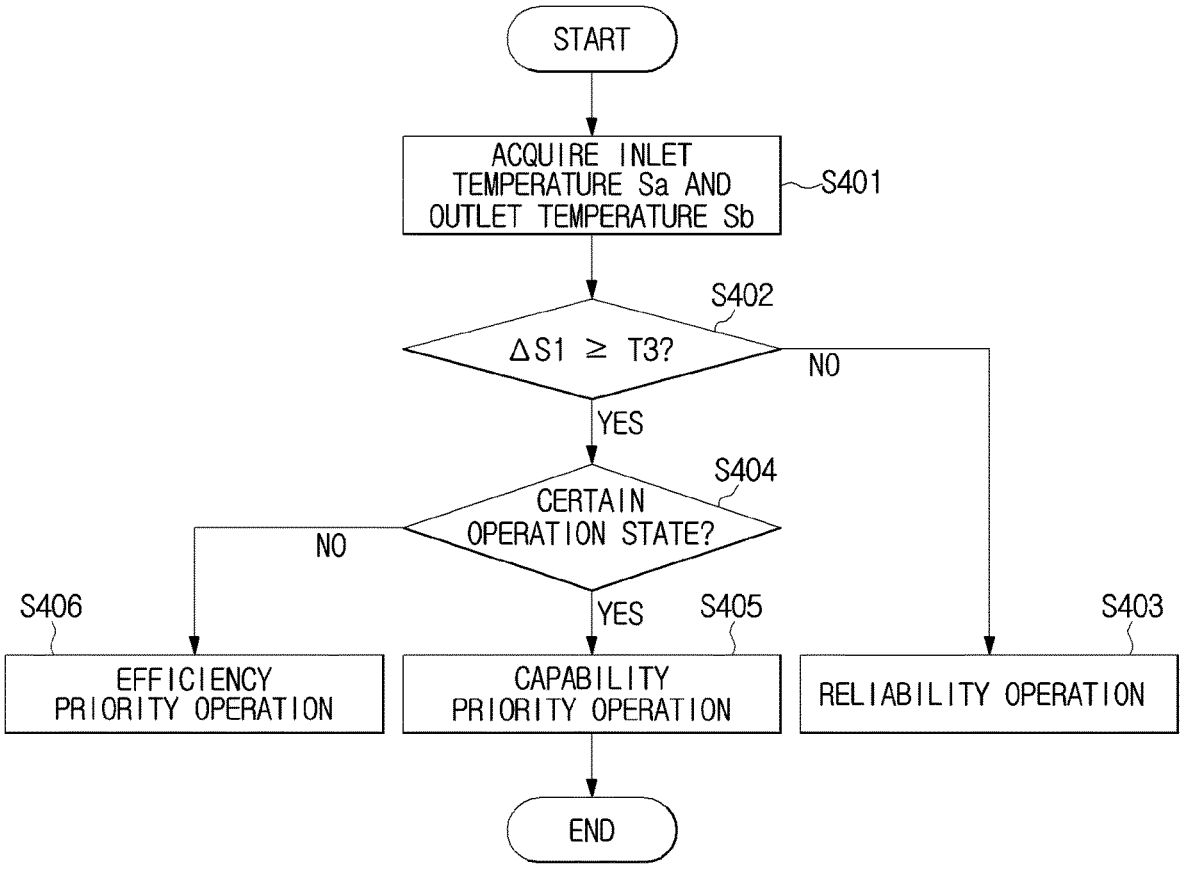
FIG. 18 is a flow chart illustrating a procedure of opening and closing control of a subcooling pressure-reducing valve operated by the air conditioner controller according to the fifth embodiment.

FIG. 18 is a flow chart illustrating a procedure of opening and closing control of the subcooling pressure-reducing valve 215 operated by the air conditioner controller 30 according to the fifth embodiment. As for the air conditioner 100 according to the fifth embodiment, any one of a reliability operation, an efficiency priority operation and a capability priority operation may be performed based on the detection result by the inlet temperature sensor 222, the outlet temperature sensor 223 and the super cooling temperature sensor 224. For each operation, the degree of the opening of the subcooling pressure-reducing valve 215 may be adjusted by variable controls.

The reliability operation may be configured to prevent a failure of the compressor 201 by securing the reliability of the compressor 201. The efficiency priority operation may be configured to perform an operation with a priority on the system efficiency. The capability priority operation may be configured to perform an operation with a priority on the air conditioning capacity (heating capacity and cooling capacity).

When the air conditioner 100 performs the air conditioning operation, the air conditioner controller 30 may acquire the temperature of the refrigerant detected by the inlet temperature sensor 222 and the outlet temperature sensor 223 (step 401). Hereinafter, a temperature detected by the inlet temperature sensor 222 may be referred to as "inlet temperature (Sa)", and a temperature detected by the outlet temperature sensor 223 may be referred to as "outlet temperature (Sb)". A temperature detected by the super cooling temperature sensor 224 may be referred to as "subcooling temperature (Sc).

The air conditioner controller 30 may determine whether the inlet temperature (Sa) and the outlet temperature (Sb) obtained in step 401 meet a predetermined condition. Particularly, the air conditioner controller 30 may compare a temperature difference Δ S1 (=Sb−Sa) obtained by subtracting the inlet temperature (Sa) from the outlet temperature (Sb), with a predetermined third reference temperature (T3) (step 402). The temperature difference Δ S1 may correspond to a temperature difference (a degree of superheat) between a temperature of the second inlet portion 82*a* and the second outlet portion 82*b* of the refrigerant flowing in the second pipe 82 of the subcooler 80 (refer to FIG. 17). In addition, the third reference temperature (T3) may be an optimum value of the degree of superheat of the subcooler 80, i.e., the third reference temperature (T3) is set in a range of from −1° C. to 3° C.

When the temperature difference Δ S1 is less than the third reference temperature (T3) (Δ S1<T3; NO in step 402), the reliability operation may be performed under the control of the air conditioner controller 30 (step 403).

As mentioned above, the reliability operation may be configured to secure the reliability of the compressor 201. During the reliability operation, the subcooling pressure-reducing valve 215 may be switched to the closed state under control of the air conditioner controller 30. According to the fifth embodiment, the reliability operation may be performed when the temperature difference Δ S1 is less than the third reference temperature (T3), and thus the liquid refrigerant may be prevented from being suctioned into the intermediate pressure suction 201*c* of the compressor 201.

When the temperature difference Δ S1 is less than the third reference temperature (T3), the evaporation of the refrigerant flowing in the second pipe 82 of the subcooler 80 may be insufficient. In this case, the liquid refrigerant may be discharged to the injection path 24 from the second outlet portion 82*b* of the second pipe 82. The liquid refrigerant may be suctioned into the intermediate pressure suction 201*c* of the compressor 201 via the injection path 24. When the liquid refrigerant is suctioned into the intermediate pressure suction 201*c* of the compressor 201, the liquid compression may occur in the compressor 201 and thus it may lead to the failure of the compressor 201.

According to the fifth embodiment, by switching the subcooling pressure-reducing valve 215 to the closed state by the reliability operation, the liquid refrigerant may be prevented from being discharged from the second outlet portion 82*b* of the second pipe 82. Accordingly, the liquid refrigerant may be prevented from being suctioned into the intermediate pressure suction 201*c* of the compressor 201. As a result, the failure of the compressor 201 may be prevented and thus the reliability may be secured.

When the temperature difference Δ S1 is equal to or more than the third reference temperature (T3) (Δ S1≥T3; YES in step 402), the air conditioner controller 30 may determine whether to perform the efficiency priority operation or the capability priority operation. Particularly, the air conditioner controller 30 may determine whether the air conditioner 100 corresponds to a predetermined operation condition (step 404).

"Predetermined operation condition" may include a case in which the heating operation is performed when the temperature of the outside air is low, a case in which a starting operation of the air conditioner 100 is performed, and a case of performing an operation in which the power consumption is likely to increase, is performed.

When the operation condition of the air conditioner 100 corresponds to the predetermined operation condition (YES in step 404), the capability priority operation may be performed under the control of the air conditioner controller 30 (step 405).

During the capability priority operation, the air conditioner controller 30 may control the degree of the opening of the subcooling pressure-reducing valve 215 so that a temperature difference Δ S2 (=Sc−Sa) obtained by subtracting the inlet temperature (Sa) from a subcooling temperature (Sc), is less than a predetermined fourth reference temperature (T4) (ΔS2<T4). The temperature difference Δ S2 may be a constant of an optimum temperature difference between the refrigerant flowing in the first refrigerant pipe 81 and the refrigerant flowing in the second refrigerant pipe 82 in the subcooler 80. The fourth reference temperature (T4) may set in a range of from 10° C. to 20° C.

Particularly, during the capability priority operation, the air conditioner controller 30 may acquire the inlet temperature (Sa) and the subcooling temperature (Sc). The air conditioner controller 30 may compare the temperature difference Δ S2 obtained by subtracting the inlet temperature (Sa) from the subcooling temperature (Sc), with the predetermined fourth reference temperature (T4).

During the capability priority operation, when the temperature difference Δ S2 is equal to or more than the fourth reference temperature (T4) (ΔS2≥T4), the air conditioner controller 30 may allow the degree of the opening of the subcooling pressure-reducing valve 215 to be large. Accordingly, the amount of the refrigerant passing through the subcooling pressure-reducing valve 215 may be increased and the pressure thereof after passing through the subcooling pressure-reducing valve 215 may be relatively increased. Therefore, the temperature difference Δ S2 may be reduced and a state in which the temperature difference Δ S2 is less than the fourth reference temperature (T4) (ΔS2<T4) may be maintained.

Figure 19:
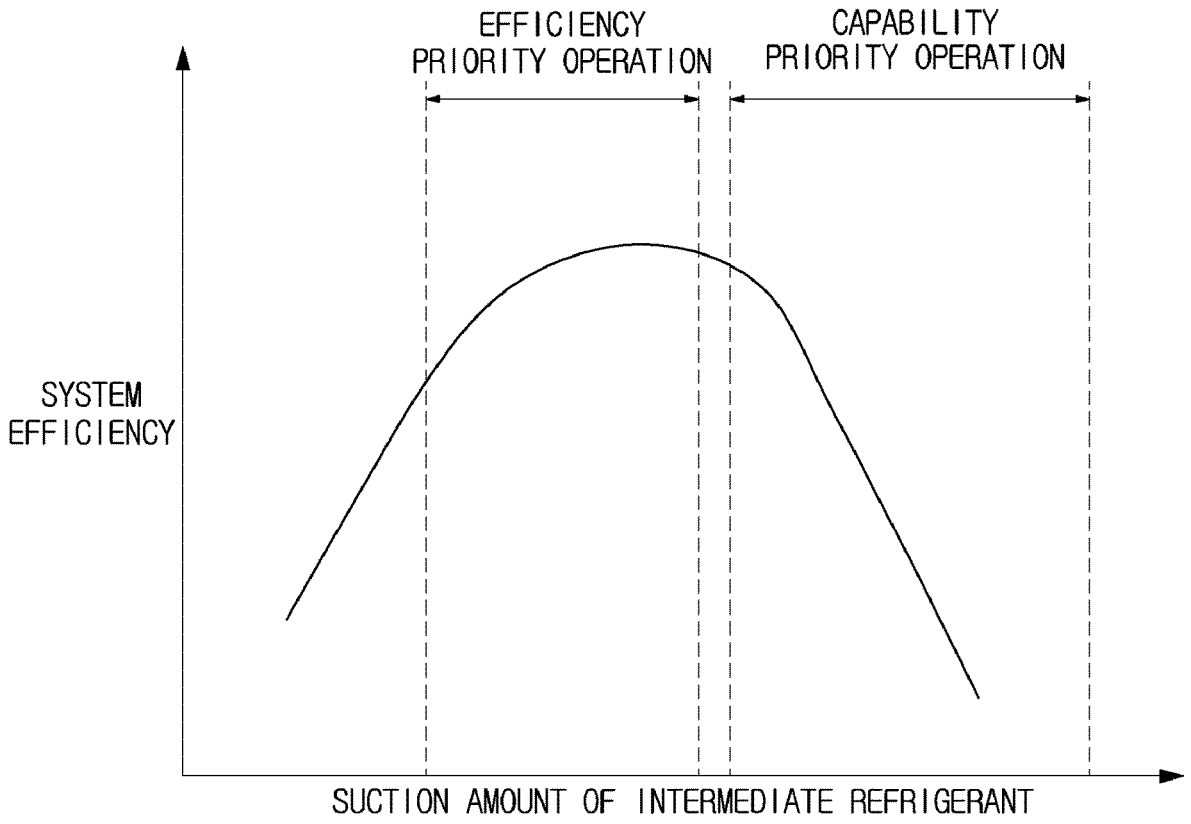
FIG. 19 is a view illustrating a relationship among a degree of an opening of a subcooling pressure-reducing valve, an amount of the refrigerant suctioned into a compressor and a system efficiency of an air conditioner.

FIG. 19 is a view illustrating a relationship among the degree of the opening of the subcooling pressure-reducing valve 215, the amount of the refrigerant suctioned into the compressor 201 and the system efficiency of the air conditioner 100.

During the capability priority operation, the degree of the opening of the subcooling pressure-reducing valve 215 may be controlled so that the temperature difference Δ S2 less than the predetermined fourth reference temperature (T4) (ΔS2<T4). Accordingly, during the capability priority operation, as illustrated in FIG. 19, the amount of the refrigerant passing through the subcooling pressure-reducing valve 215 and the second pipe 82 and then discharged to the injection path 24 may be increased in comparison with the efficiency priority operation. The amount of the refrigerant suctioned into the intermediate pressure suction 201*c* of the compressor 201 via the injection path 24 may be increased. Since the amount of the refrigerant suctioned into the intermediate pressure suction 201*c* of the compressor 201 is increased, the amount of the refrigerant flowing in the indoor heat exchanger 104 (during the heating operation, the outdoor heat exchanger 102) that acts as the evaporator may be reduced.

In addition, since the amount of the refrigerant suctioned into the intermediate pressure suction 201*c* of the compressor 201 is increased, the amount of the refrigerant flowing in the indoor heat exchanger 104 (during the heating operation, the outdoor heat exchanger 102) that acts as the evaporator may be reduced. Therefore, during the capability priority operation, the pressure loss in the indoor heat exchanger 104 or the outdoor heat exchanger 102 may be reduced.

Since the amount of the refrigerant suctioned into the intermediate pressure suction 201*c* of the compressor 201 is increased, the amount of the refrigerant that is pressed in the low pressure side of the compressor 201 (between from the suction unit to the intermediate pressure suction 201*c*) may be reduced. Therefore, the workload in the low pressure side of the compressor 201 may be reduced.

As mentioned above, since the air conditioner 100 performs the capability priority operation, the air conditioning performance may be improved. As a result, although the compressor 201 is in the operation condition in which the power consumption is likely to increase, the air conditioner 100 may more quickly perform the air conditioning in the user desired environment.

When the operation condition of the air conditioner 100 does not correspond to the predetermined operation condition (NO in step 404), the efficiency priority operation may be performed under the control of the air conditioner controller 30 (step 406).

During the efficiency priority operation, the air conditioner controller 30 may control the degree of the opening of the subcooling pressure-reducing valve 215 so that a temperature difference Δ S2 (=Sc−Sa) obtained by subtracting the inlet temperature (Sa) from the subcooling temperature (Sc), is equal to or more than the predetermined fourth reference temperature (T4) (ΔS2≥T4).

Particularly, during the efficiency priority operation, the air conditioner controller 30 may acquire the inlet temperature (Sa) and the subcooling temperature (Sc) in the same manner as the capacity priority operation. The air conditioner controller 30 may compare the temperature difference Δ S2 obtained by subtracting the inlet temperature (Sa) from the subcooling temperature (Sc), with the predetermined fourth reference temperature (T4). During the efficiency priority operation, when the temperature difference Δ S2 is less than the fourth reference temperature (T4) (ΔS2<T4), the air conditioner controller 30 may allow the degree of the opening of the subcooling pressure-reducing valve 215 to be small. Accordingly, the pressure of the refrigerant passing through the subcooling pressure-reducing valve 215 may be relatively reduced. Therefore, since the inlet temperature (Sa) is reduced, the temperature difference Δ S2 may be increased and thus a state in which the temperature difference Δ S2 is equal to or more than the fourth reference temperature (T4) (ΔS2≥T4) may be maintained.

As mentioned above, since the state in which the temperature difference Δ S2 is equal to or more than the fourth reference temperature (T4) (ΔS2≥T4) is maintained during the efficiency priority operation, the average temperature difference between the refrigerant flowing in the first pipe 81 and the refrigerant flowing in the second pipe 82 may become large in comparison with the capacity priority operation. During the efficiency priority operation, the efficiency of the heat exchange in the subcooler 80 may be improved and it may be possible to relatively super cool the refrigerant flowing in the first pipe 81 in comparison with the capacity priority operation. As a result, during the efficiency priority operation, as illustrated in FIG. 19, the system efficiency of the air conditioner 100 may be improved in comparison with the capacity priority operation.

The air conditioner 100 according to the fifth embodiment may include a receiver 281 configured to store the surplus refrigerant in the super cooled state, like in the first embodiment.

Therefore, as for the air conditioner 100 according to the fifth embodiment, during the cooling operation, the refrigerant, which is remaining after the surplus refrigerant is stored in the receiver 218, may be suctioned into the subcooler 80. That is, as for the air conditioner 100 according to the fifth embodiment, during the cooling operation, the amount of the refrigerant suctioned into the first pipe 81 of the subcooler 80 may be reduced in comparison with a case in which the air conditioner 100 excludes the receiver 218.

Therefore, the pressure loss generated in the subcooler 80 may be reduced in comparison with the case in which the case in which the air conditioner 100 excludes the receiver 218. Accordingly, the reduction of the heat exchange efficiency in the subcooler 80 may be more prevented.

The fifth embodiment may be applied to the air conditioner 100 with which the receiver 218 is not provided. As mentioned above, as for the air conditioner 100 according to the fifth embodiment, it may be possible to super cool the refrigerant. Therefore, it may be possible to make the refrigerant, which is before being suctioned into the first expansion valve 204*a* in the one side or the first expansion valve 204*b* in the other side, be in the subcooled state.

When it is considered that the air conditioner 100 performs the cooling operation and the heating operation with the optimal amount of the refrigerant, it may be appropriate that the air conditioner 100 is provided with the receiver 218.

As for the air conditioner 100 according to the fifth embodiment, the refrigerant flowing in the first pipe 81 of the subcooler 80 and the refrigerant flowing in the second pipe 82 of the subcooler 80 may be a counter flow by installing the bridge circuit 23 having the first non-return valve 231 to the fourth non-return valve 234. However, a means configured to allow the refrigerant flowing in the first pipe 81 and the second pipe 82 of the subcooler 80 to be the counter flow is not limited thereto. For example, the refrigerant flowing in the first pipe 81 and the second pipe 82 may become the counter flow by switching the flow direction of the refrigerant by using an electronic switching valve.

A Sixth Embodiment

The sixth embodiment of the present disclosure will be described with reference to the drawings.

Figure 20:
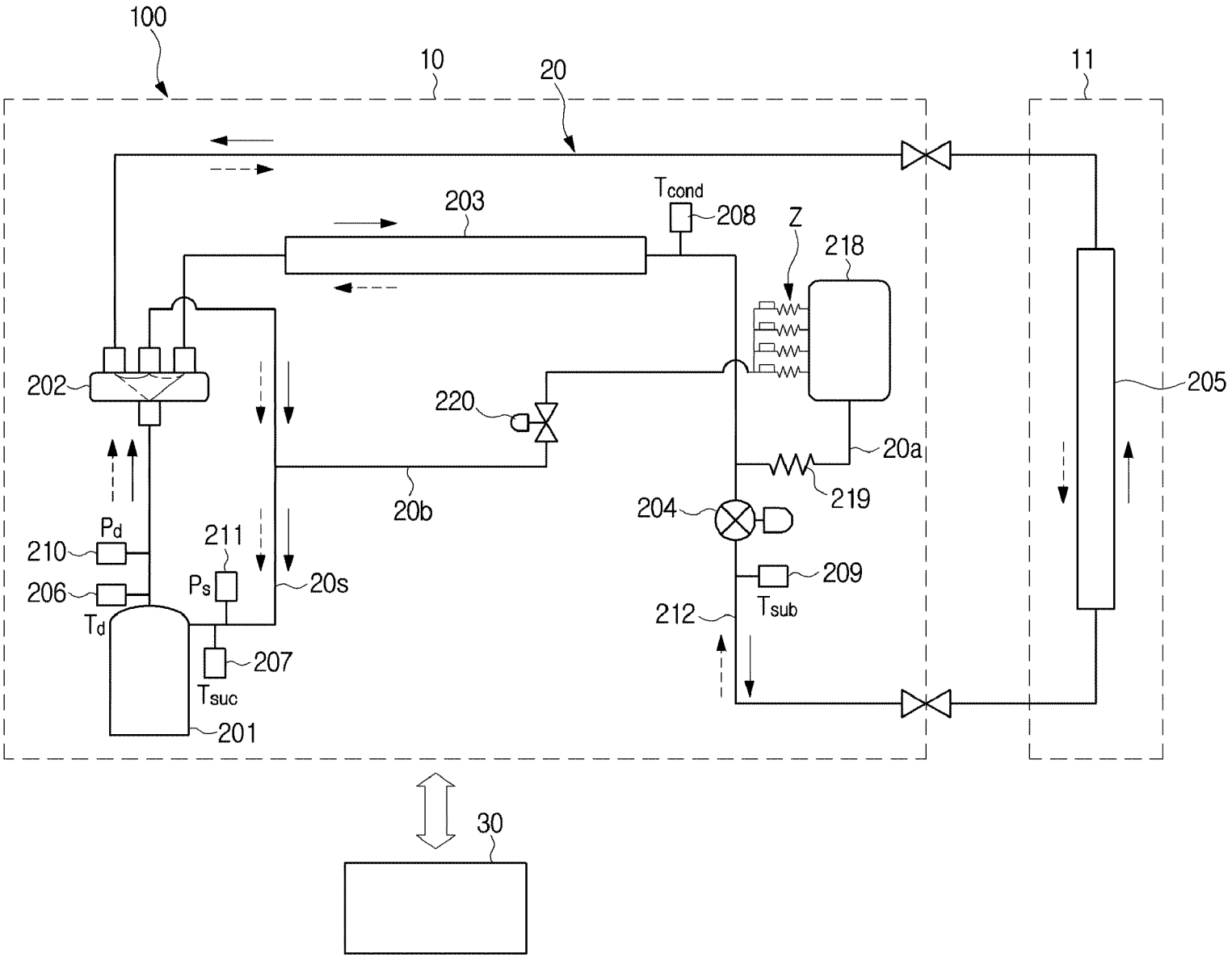
FIG. 20 is a schematic diagram illustrating a configuration of an air conditioner according to a sixth embodiment.

As illustrated in FIG. 20, an air conditioner 100 according to the sixth embodiment may include the configuration of the fourth embodiment and the fifth embodiment and further include a refrigerant amount detection device (Z) configured to detect an amount of the refrigerant in a receiver 218 that is the refrigerant storage.

Figure 21:
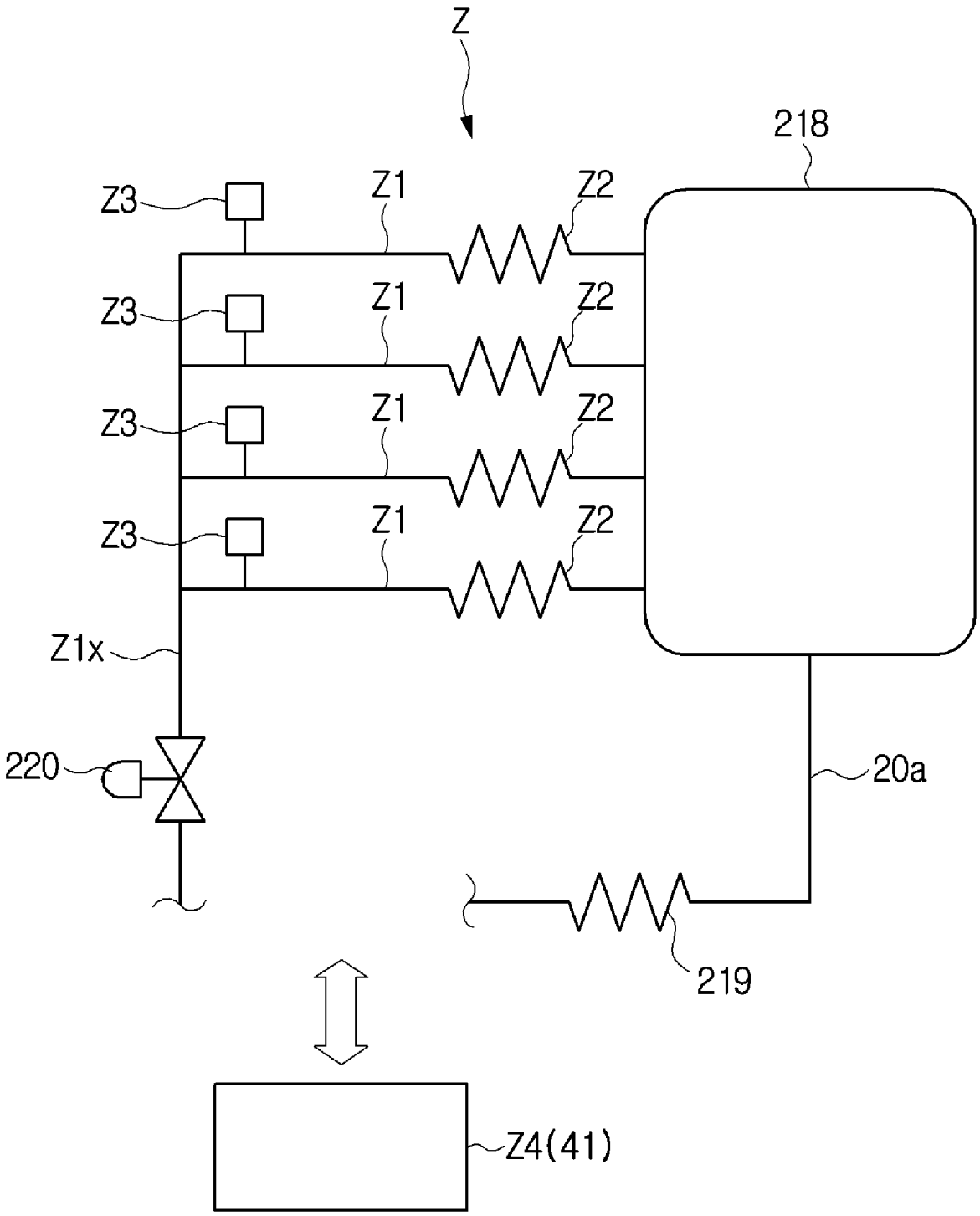
FIG. 21 is a view illustrating a configuration of a refrigerant amount detection device according to the sixth embodiment.

Particularly, as illustrated in FIG. 21, the refrigerant amount detection device (Z) may include a plurality of derivation paths (Z1) connected to a plurality of different height positions of the receiver 218; a fluid resistance (Z2), e.g., a plurality of capillaries installed in each of the plurality of derivation paths (Z1); a plurality of temperature sensors (Z3) installed in the downstream side of the fluid resistance (Z2) in the plurality of derivation paths (Z1); and a refrigerant amount detector (Z4) configured to detect the amount of refrigerant in the receiver 218 by using the refrigerant temperature obtained by the plurality of temperature sensors (Z3).

A collection pipe (Z1x) (corresponding to the connection path 20*b*) formed in the plurality of derivation paths (Z1) may be connected to the low pressure pipe 20*s* of the refrigerant circuit 20.

The refrigerant amount detector (Z4) may be configured with the refrigerant amount detector 41 according to the above mentioned embodiment.

Particularly, the refrigerant amount detector 41 may acquire the detection temperature of the plurality of temperature sensors (Z3) and then detect the amount of the refrigerant in the receiver 218 by using the inequality between the detection temperatures of the plurality of temperature sensors. Since among the plurality of derivation paths (Z1), a detection temperature of the temperature sensor (Z3) of the derivation path (Z1) connected to a liquid part is different from a detection temperature of the temperature sensor (Z3) of the derivation path (Z1) connected to a gas part, it may be possible to distinguish between the derivation path (Z1) through which the liquid refrigerant passes and the derivation path (Z1) through which the liquid refrigerant does not pass. Therefore, the refrigerant amount detector 41 may detect the amount of the refrigerant in the receiver 218.

Figure 22:
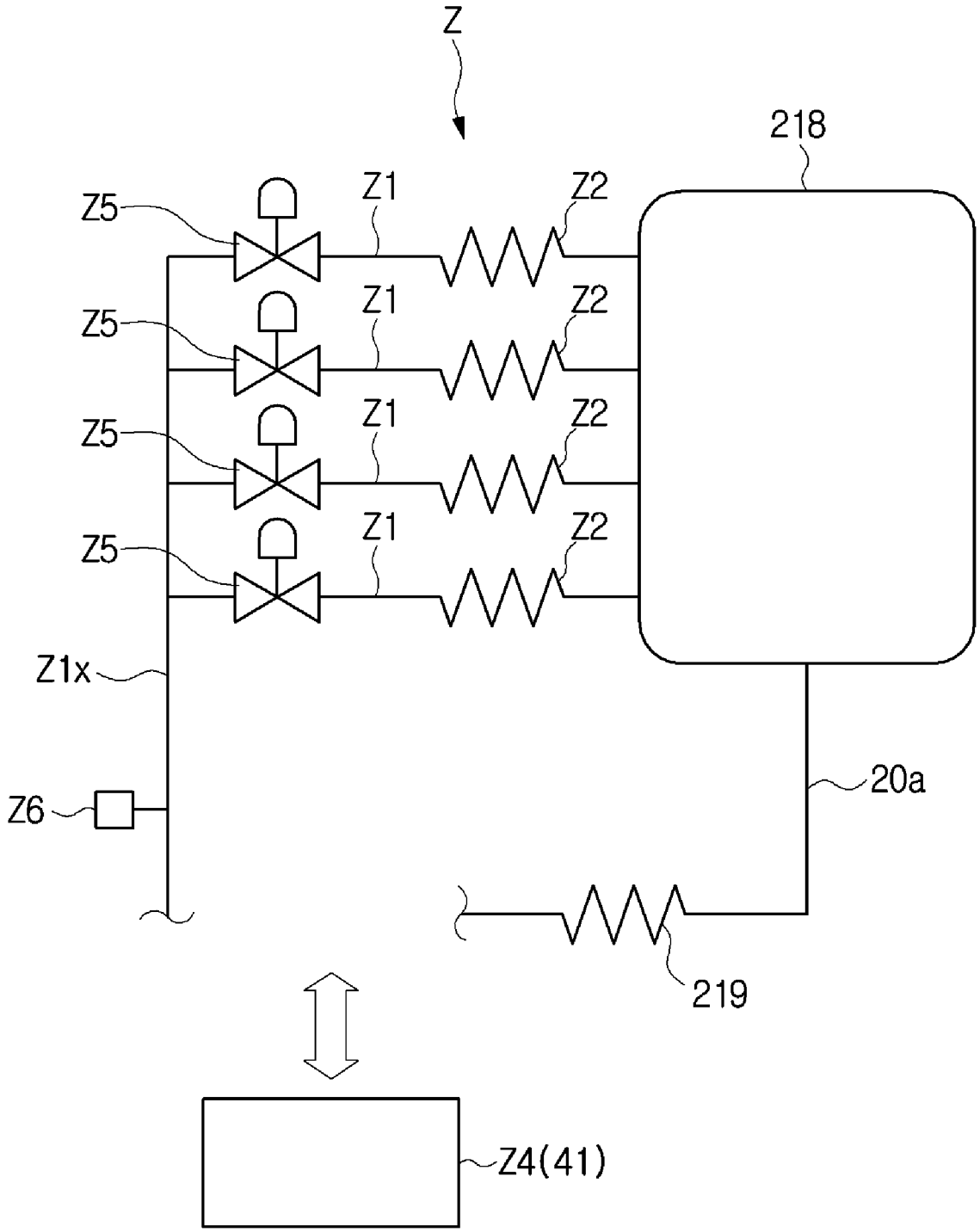
FIG. 22 is a view illustrating a modified example of the refrigerant amount detection device.

In addition, as illustrated in FIG. 22, a refrigerant amount detection device (Z) may include a plurality of derivation paths (Z1) connected to a plurality of different height positions of the receiver 218; a fluid resistance (Z2), e.g., a plurality of capillaries installed in each of the plurality of derivation paths (Z1); a plurality of electronic valves (Z5) installed in the downstream side of the fluid resistance (Z2) in the plurality of derivation paths (Z1); a temperature sensor (Z6) installed in a collection pipe (Z1x) of the plurality of derivation paths (Z1); and a refrigerant amount detector (Z4) configured to detect the amount of refrigerant in the receiver 218 by using the refrigerant temperature obtained by the plurality of temperature sensors (Z6).

The collection pipe (Z1x) (corresponding to the connection path 20*b*) formed in the plurality of derivation paths (Z1) may be connected to the low pressure pipe 20*s* of the refrigerant circuit 20.

The refrigerant amount detector (Z4) may be configured with the refrigerant amount detector 41 according to the above mentioned embodiment.

Particularly, the refrigerant amount detector 41 may control the opening and closing the plurality of electronic valves (Z5) to communicate each derivation path thereby acquiring the detection temperature of temperature sensors (Z6). Since among the communicated derivation paths (Z1), a detection temperature of the temperature sensor (Z6) of the derivation path (Z1) connected to a liquid part is different from a detection temperature of the temperature sensor (Z6) of the derivation path (Z1) connected to a gas part, it may be possible to distinguish between the derivation path (Z1) through which the liquid refrigerant passes and the derivation path (Z1) through which the liquid refrigerant does not pass. Therefore, the refrigerant amount detector 41 may detect the amount of the refrigerant in the receiver 218.

A Seventh Embodiment

The seventh embodiment of the present disclosure will be described with reference to the drawings.

Figure 23:
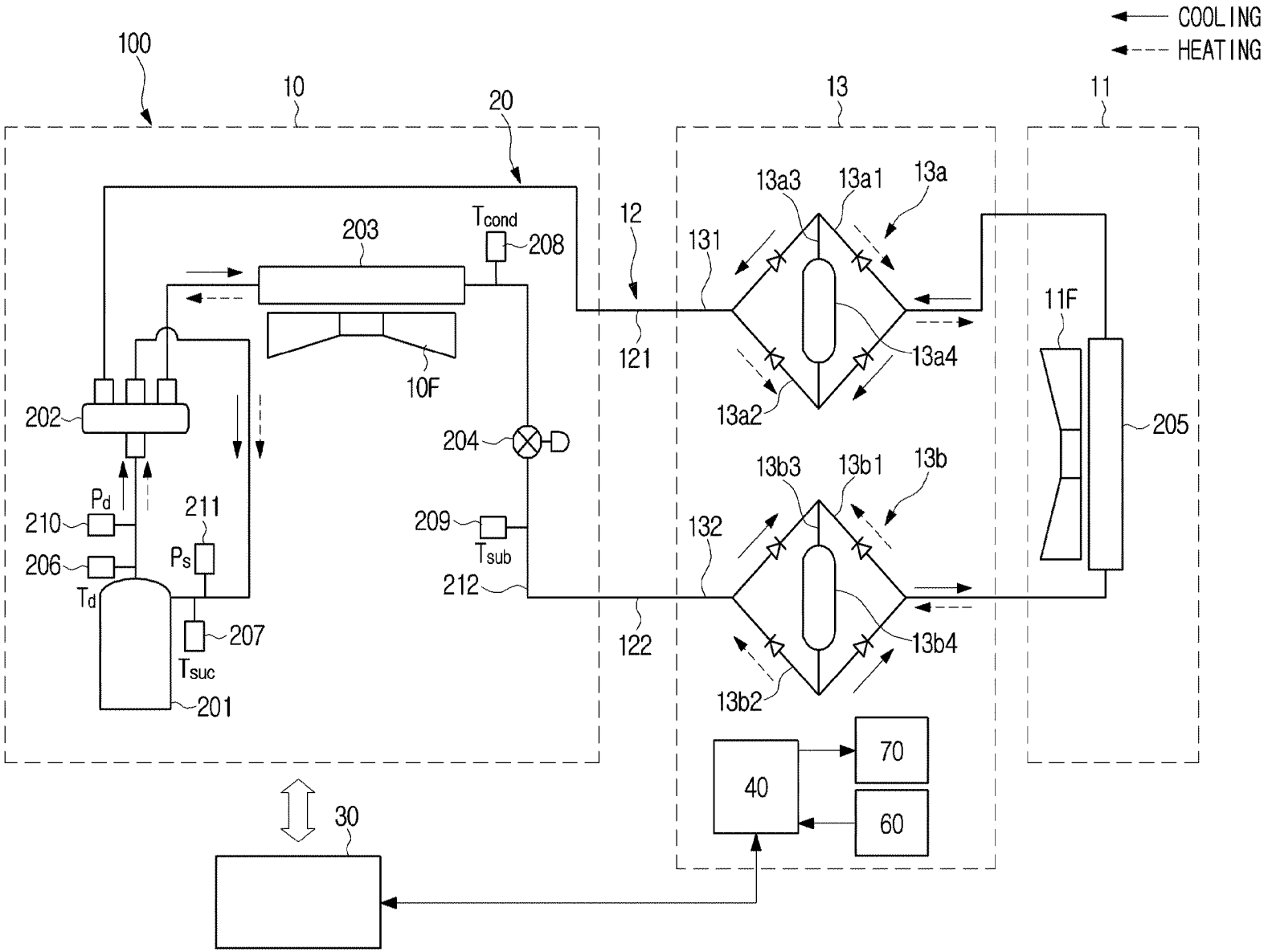
FIG. 23 is a schematic diagram illustrating a configuration of an air conditioner and an auxiliary unit according to a seventh embodiment

As illustrated in FIG. 23, according to the seventh embodiment, an air conditioner 100 may include an outdoor unit 10 installed outdoors of a building; an indoor unit 11 installed inside of the building; a refrigerant circuit 20 configured by connecting the outdoor unit 10 to the indoor unit 11 by a refrigerant pipe 12; and an air conditioner controller 30 configured to perform an air conditioning operation by controlling the outdoor unit 10 and the indoor unit 11.

The refrigerant circuit 20 may be configured by connecting a compressor 201, a four-way switching valve 202, a condenser (outdoor heat exchanger) 203, a first expansion valve 204, and an evaporator (indoor heat exchanger) 205. According to the seventh embodiment, the compressor 201, the four-way switching valve 202, the condenser 203, and the first expansion valve 204 may be installed inside the outdoor unit 10, and the evaporator 205 may be installed inside of the indoor unit 11. Meanwhile, the outdoor unit 10 may compress the refrigerant vaporized in the evaporator 205 of the indoor unit 11 and cool the compressed refrigerant. Further, the indoor unit 11 may perform a heat exchange between the room air and the refrigerant in the evaporator 205, and cool the room air while vaporizing the refrigerant.

The compressor 201 may generate a high-temperature and a high-pressure compressed gas by compressing the vaporized refrigerant gas flowing from an inlet of the low pressure side. The compressor 201 may be driven by a motor capable of controlling the rotational speed, and thus the compression performance may be changed in accordance with the rotational speed of the motor. That is, when the rotational speed of the motor is high, the compression performance may be high, and when the rotational speed of the motor is low, the compression performance may be low. The compressor 201 may control the rotational speed of the motor by a compressor controller 301, described later. The compressor 201 may send the generated high-temperature and high-pressure compressed gas to the condenser 203 through the four-way switching valve 202.

The condenser 203 may condense the compressed gas, which is generated by the compressor 201, through the heat exchanger. The condenser 203 may perform the heat exchange between the high temperature compressed gas and the low temperature outdoor air, and then generate a liquid refrigerant. The condenser 203 may send the liquid refrigerant generated by the heat exchange, to the first expansion valve 204.

The first expansion valve 204 may be a valve configured to adjust the flow rate flowing therethrough by opening or closing thereof. The first expansion valve 204 may be opened and closed by a first expansion valve controller 302. When the first expansion valve 204 is opened, the liquid refrigerant may expand and vaporize and then become refrigerant gas. This refrigerant gas has a lower temperature than the liquid refrigerant before flowing into the first expansion valve 204. The first expansion valve 204 may control a degree of opening indicating the degree of its openness, in response to a signal output from the first expansion valve controller 302, described later. The first expansion valve 204 may send the refrigerant gas to the evaporator 205.

The evaporator 205 may perform the heat exchange between the refrigerant gas generated in the first expansion valve 204 and the high temperature room air. The evaporator 205 may cool the room air while vaporizing a portion of the refrigerant. Two-phase gas-liquid refrigerant generated in the evaporator 205 may be sent to the compressor 201 through the four-way switching valve 202.

A refrigerant pipe 12 may include a first refrigerant pipe 121 in the gas side; and a second refrigerant pipe 122 in the liquid side. The first refrigerant pipe 121 may connect the evaporator 205 of the indoor unit 11 to the four-way switching valve 202 of the outdoor unit 10. The second refrigerant pipe 122 may connect the condenser 203 (the first expansion valve 204) of the indoor unit 11 to the evaporator 205 of the indoor unit 11.

In addition, an outdoor fan 10F may be installed in the outdoor unit 10 and an indoor fan 11F may be installed in the indoor unit 11.

The outdoor fan 10F may cool the refrigerant by blowing air to the condenser 203. The rotational speed of the outdoor fan 10F may be controlled by an outdoor fan controller 303, described later.

The indoor fan 11F may cool the indoor air in the evaporator 205 and then blow the cooled air into the room. The rotational speed of the indoor fan 11F may be controlled by an indoor fan controller 304, described later.

In addition, a discharge temperature sensor 206, a suction temperature sensor 207, an outlet temperature sensor 208, a liquid pipe temperature sensor 209, a high pressure sensor 210, and a low pressure sensor 211 may be installed in the refrigerant circuit 20.

The discharge temperature sensor 206 may detect a refrigerant temperature (discharge temperature; Td) in the high-pressure side of the compressor 201 and output a signal indicating the detected discharge temperature to an A/D converter 50. Meanwhile, the A/D converter 50 may be installed in the air conditioner controller 30 and alternatively installed in the refrigerant amount detection device 40 described later.

The suction temperature sensor 207 may detect a refrigerant temperature (suction temperature; Tsuc) in the low-pressure side of the compressor 201 and output a signal indicating the detected suction temperature to the A/D converter 50.

The outlet temperature sensor 208 may detect a refrigerant temperature (outlet temperature; Tcond (a first refrigerant temperature)) in the side of the outlet of the condenser 203 and output a signal indicating the detected outlet temperature to the A/D converter 50. The outlet temperature sensor 208 may be installed in a heat transfer pipe on the side of the outlet of the condenser 203.

The liquid pipe temperature sensor 209 may detect a refrigerant temperature (liquid pipe temperature; Tsub (a second refrigerant temperature)) in the downstream side of the first expansion valve 204 installed in the side of the outlet of the condenser 203, and output a signal indicating the detected liquid pipe temperature to the A/D converter 50. The liquid pipe temperature sensor 209 may be installed in a liquid pipe 212. The liquid pipe 212 may be a pipe connecting the outlet of the condenser 203 to the inlet of the evaporator 205.

The high pressure sensor 210 may detect a pressure (high pressure side pressure; Pd) in the high pressure side of the compressor 201 and output a signal indicating the detected high pressure side pressure to the A/D converter 50.

The low pressure sensor 211 may detect a pressure (low pressure side pressure; Ps) in the low pressure side of the compressor 201 and output a signal indicating the detected low pressure side pressure to the A/D converter 50.

The air conditioner controller 30 may control each component of the air conditioner 100. Meanwhile, although the air conditioner controller 30 and each component of the indoor unit 11 and the outdoor unit 10 are connected to each other, the connection thereof is not described in FIG. 23. A detail description of the air conditioner controller 30 will be described later with reference to FIG. 24.

In the refrigerant pipe 12 (the first refrigerant pipe 121 and the second refrigerant pipe 122) of the air conditioner 100 according to the seventh embodiment, an auxiliary unit 13 may be separately installed from the air conditioner 100. The auxiliary unit 13 may be detachably installed in the refrigerant pipe 12. A diameter of an internal pipe (a first internal pipe 131 and a second internal pipe 132) of the auxiliary unit 13 connected to the refrigerant pipe 12 may be larger than a diameter of the refrigerant pipe 12.

The auxiliary unit 13 may include a first trapper 13*a* and a second trapper 13*b* configured to capture impurities in the refrigerant flowing through the refrigerant pipe 12; and a refrigerant amount detection device 40 configured to detect an amount of the refrigerant in the refrigerant circuit 20.

The first trapper 13*a* may include a first branch pipe 13*a*1 and a second branch pipe 13*a*2 installed in the first internal pipe 131, which is detachably installed in the first refrigerant pipe 121, and formed by being diverged from the first internal pipe 131; a connection pipe 13*a*3 connecting the first branch pipe 13*a*1 to the second branch pipe 13*a*2; and a trapping member 13*a*4 installed in the connection pipe 13*a*3 and configured to capture a certain material of the refrigerant flowing in the connection pipe 13*a*3. The first branch pipe 13*a*1 to the second branch pipe 13*a*2 may be joined on the downstream side.

The second trapper 13*b* may include a first branch pipe 13*b*1 and a second branch pipe 13*b*2 installed in the second internal pipe 132, which is detachably installed in the second refrigerant pipe 122, and formed by being diverged from the second internal pipe 132; a connection pipe 13*b*3 connecting the first branch pipe 13*b*1 to the second branch pipe 13*b*2; and a trapping member 13*b*4 installed in the connection pipe 13*b*3 and configured to capture a certain material of the refrigerant flowing in the connection pipe 13*b*3. The first branch pipe 13*b*1 to the second branch pipe 13*b*2 may be are joined on the downstream side.

The trapping member 13*a*4 and 13*b*4 may be configured to capture oxide scale generated when wielding, an abrasion material from the compressor 201, a refrigeration oil and a sludge thereof used in the compressor of a previous outdoor unit when replacing a previous indoor unit and outdoor unit with a new first indoor unit 10 and outdoor unit 11, and according to the seventh embodiment, a filter may be used as the trapping member 13*a*4 and 13*b*4.

The refrigerant amount detection device 40 may detect the amount of refrigerant in the refrigerant circuit in the air conditioner 100. Meanwhile, although the refrigerant amount detection device 40 and each component of the he indoor unit 11 and the outdoor unit 10 are connected to each other, the connection thereof is not described in FIG. 23. A detail description of the refrigerant amount detection device 40 will be described later with reference to FIG. 24.

Figure 24:
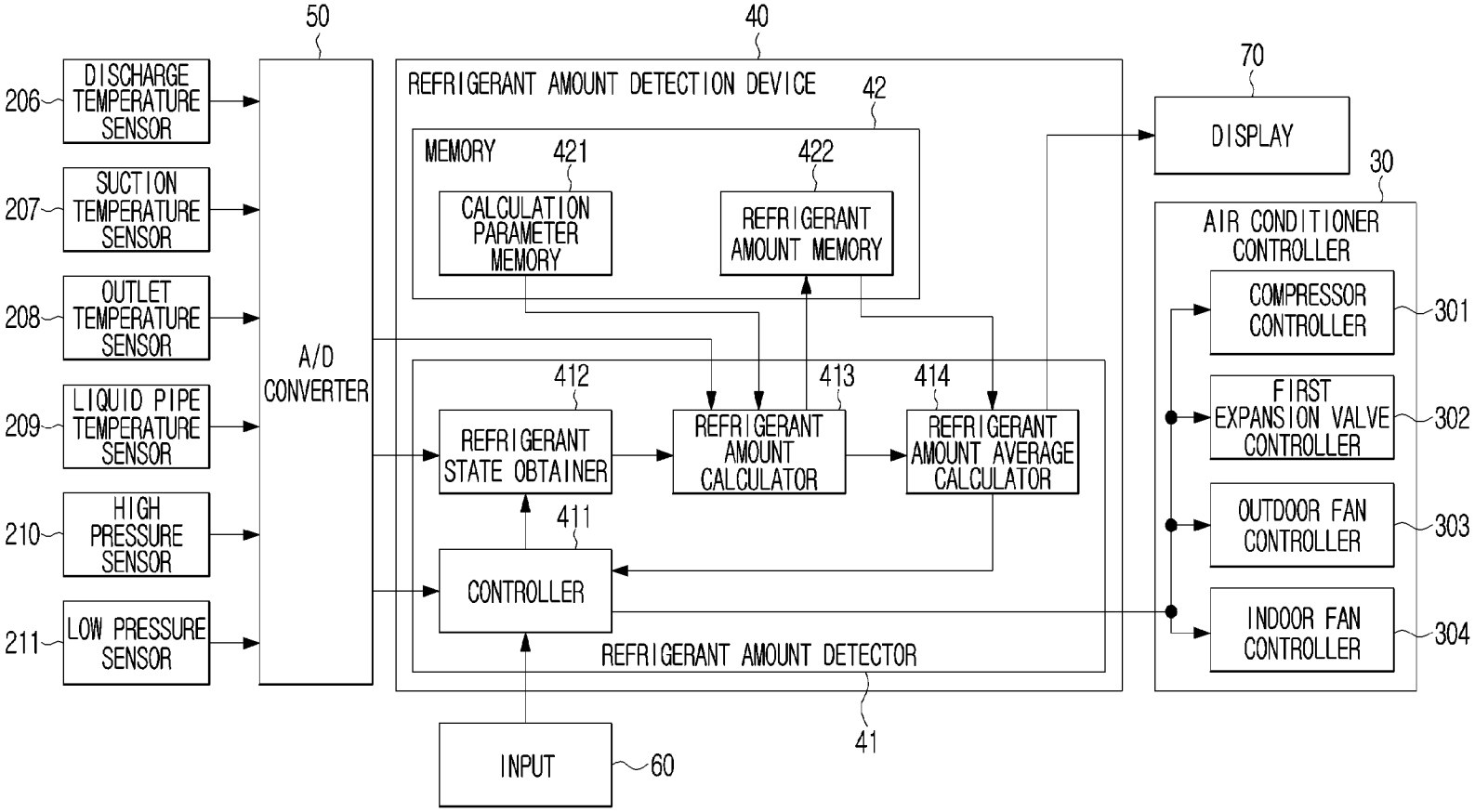
FIG. 24 is a schematic block diagram illustrating a configuration of a refrigerant amount detection device according to the seventh embodiment.

FIG. 24 is a schematic block diagram illustrating a configuration of the refrigerant amount detection device 40 according to the seventh embodiment. The A/D converter 50 may analog-to-digital convert the signal received from the sensors 206 to 211 and then output the converted signal to a refrigerant amount detector 41. An input 60 may output detection start information indicating that the detection of the refrigerant amount is started, to a controller 411 in response to a user's operation. A display 70 may be a display unit configured to display information, i.e., a digital display panel by using light emitting diode (LED), and the display 70 may display information about a refrigerant amount ratio input from a refrigerant amount average calculator 414, described later.

Particularly, the refrigerant amount detection device 40 may include the refrigerant amount detector 41 configured to determine a refrigerant state and calculate the refrigerant amount ratio and a memory 42 configured to record a parameter, which is used for calculating the refrigerant amount ratio, and a refrigerant amount ratio that is previously calculated.

The refrigerant amount detector 41 may calculate the refrigerant amount ratio based on the information of the temperature and the pressure received from the A/D converter 50, and output the calculated refrigerant amount ratio to the display 70. "Refrigerant amount ratio" may represent a value obtained by dividing an amount of refrigerant actually present in the air conditioner 100 by an amount of refrigerant specified as the specification for the air conditioner 100 ("actual refrigerant amount"/"specified refrigerant amount")

The refrigerant amount detector 41 may include a controller 411, a refrigerant state obtainer 412, a refrigerant amount calculator 413, and the refrigerant amount average calculator 414.

The controller 411 may receive the detection start information indicating that the detection of the refrigerant amount ratio of the air conditioner 100 is started, from the input 60. Further, the controller 411 may output a command configured to allow the air conditioner 100 to perform a certain operation mode that is a cooling operation, to the air conditioner controller 30. The controller 411 may output an operation end command configured to end the operation, to the air conditioner controller 30.

The air conditioner controller 30 may include the compressor controller 301 controlling the rotational speed of the motor of the compressor 201; the first expansion valve controller 302 controlling the opening degree of the first expansion valve 204; the outdoor fan controller 303 controlling the rotational speed of the outdoor fan 10F; and the indoor fan controller 304 controlling the rotational speed of the indoor fan 11F.

Particularly, the air conditioner controller 30 may allow a degree of superheat (SH) of the evaporator 205 provided in the indoor unit 11, to be constant (e.g., 3K). "Degree of superheat" may be obtained by subtracting a saturation temperature at an evaporation temperature from the refrigerant temperature at the outlet of the evaporator 205, i.e., by subtracting a saturation temperature of the pressure in the low pressure side of the compressor 201 from the refrigerant temperature in the low pressure side of the compressor 201. The first expansion valve controller 302 may allow the degree of superheat of the evaporator 205 to be constant by adjusting the opening degree of the first expansion valve 204. In addition, the controller 411 may output a command, which is configured to allow the rotational speed of the motor of the compressor 201 to be driven at a predetermined rotational speed (e.g., 65 Hz), to the compressor controller 301. The compressor controller 301 may receive the command, which is configured to allow the rotational speed of the motor of the compressor 201 to be driven at the predetermined rotational speed (e.g., 65 Hz), and drive the motor at the rotational speed of 65 Hz.

The controller 411 may output a command configured to drive the outdoor fan 10F at a constant speed, to the outdoor fan controller 303. The outdoor fan controller 303 may drive the outdoor fan 10F at the constant speed.

The controller 411 may output a command configured to drive the indoor fan 11F at a constant speed, to the indoor fan controller 304. The indoor fan controller 304 may drive the indoor fan 11F at the constant speed.

In addition, the controller 411 may output a command configured to allow the refrigerant state obtainer 412 and the refrigerant amount calculator 413 to calculate the refrigerant amount ratio. The controller 411 may receive an average calculation end signal indicating that the calculation of the average value of the refrigerant amount ratio is completed, from the refrigerant amount average calculator 414. The controller 411 may output an operation end signal to the air conditioner controller 30 when receiving the average value calculation end signal from the refrigerant amount average calculator 414.

The refrigerant state obtainer 412 may acquire information related to whether the refrigerant state in the outlet of the condenser 203 is a subcooled state or a gas liquid two-phase state, after the air conditioner 100 starts a certain operation mode by the air conditioner controller 30. The refrigerant state obtainer 412 may determine that the refrigerant is in any one of the subcooled state or the gas liquid two-phase state, by using the outlet temperature (Tcond) indicated by an outlet temperature signal and the liquid pipe temperature (Tsub) indicated by the liquid pipe temperature signal as parameters. The refrigerant state obtainer 412 may output a determination signal to the refrigerant amount calculator 413.

Details are as follows.

When Tcond-Tsub≤X is established, the refrigerant state may be determined as "subcooled state".

When Tcond-Tsub>X is established, the refrigerant state may be determined as "gas-liquid two-phase state."

X is a constant, and obtained in advance by using measured data (e.g., X=1.5).

The refrigerant amount calculator 413 may calculate the refrigerant amount ratio in the air conditioner 100 by using a different equation, according to the state refrigerant obtained by the refrigerant state obtainer 412.

Particularly, when the refrigerant is in the subcooled state, the refrigerant amount calculator 413 may calculate a refrigerant amount ratio (RA) by using an equation for the subcooled state and when the refrigerant is in the gas-liquid two-phase state, the refrigerant amount calculator 413 may calculate a refrigerant amount ratio (RA) by using an equation for the gas-liquid two-phase state.

The equation for the subcooled state is as follows.

$$RA=a1+b1+Pd+c1\times Ps+d1\times Tsub+e1\times Td$$

The constants (a1, b1, c1, d1, and e1) may be a value obtained in advance by the multi-regression calculation by using measured data indicating a relationship between Pd, Ps, Tsub, Td and RA in the subcooled state. Meanwhile, the constants (a1, b1, c1, d1 and e1) may be recorded in a calculation parameter memory 421 set in the memory 42.

The equation for the gas-liquid two-phase state is as follows.

$$RA=a2+b2+Pd+c2\times Ps+d2\times Tsub+e2\times Td$$

The constants (a2, b2, c2, d2, and e2) may be a value obtained in advance by the multi-regression calculation by using measured data indicating a relationship between Pd, Ps, Tsub, Td and RA in the gas-liquid two-phase state. Meanwhile, the constants (a2, b2, c2, d2, and e2) may be recorded in the calculation parameter memory 421 set in the memory 42.

The refrigerant amount calculator 413 may read the constants (a1, b1, c1, d1, and e1), or the constants (a2, b2, c2, d2, and e2) in accordance with the refrigerant state acquired by the refrigerant state obtainer 412.

Further, the refrigerant amount calculator 413 may calculate the refrigerant amount radio (RA) by the equation corresponding to the refrigerant state, by using the discharge pressure (Pd) indicated by the discharge pressure signal, the suction pressure (Ps) indicated by the suction pressure signal, the liquid pipe temperature (Tsub) indicated by the liquid pipe temperature signal, and the discharge temperature (Td) indicated by the discharge temperature signal. The refrigerant amount calculator 413 may record the refrigerant amount ratio data indicating the calculated refrigerant amount ratio (RA) in the refrigerant amount memory 422 set in the memory 42.

The refrigerant amount average calculator 414 may read a refrigerant amount ratio (RA) that is calculated within a predetermined time (e.g., the past five minutes), on the refrigerant amount calculator 413. The refrigerant amount average calculator 414 may calculate an average value of the read refrigerant amount ratio (RA) and output the calculated average value of the refrigerant amount ratio (RA) to the display 70. When the calculation of the average value of the refrigerant amount ratio (RA) is completed, the refrigerant amount average calculator 414 may output a calculation end signal indicating that the calculation of the average value of the refrigerant amount ratio RA is completed, to the controller 411.

According to the seventh embodiment, the air conditioner 100 may detect the amount of refrigerant by installing the auxiliary unit 13 on the air conditioner controller 100 in the conventional manner. The air conditioner 100 may detect the amount of refrigerant with high accuracy, regardless of the refrigerant state at the outlet of the condenser 203, by using the equation for the subcooled state when the refrigerant state is the subcooled state, and by using the equation for the gas-liquid two-phase state when the refrigerant state is the gas-liquid two-phase state. Therefore, according to the seventh embodiment, it may be possible to detect the refrigerant amount ratio with high accuracy, despite of using a long pipe or although there is a large difference in height between the outdoor unit 10 and the indoor unit 11.

According to the seventh embodiment, the controller 411 may fix the opening degree of the second expansion valve 215 to a predetermined value. As a result, the degree of cooling of the liquid refrigerant in the liquid pipe 212 may be maintained to be constant, and the refrigerant amount ratio may be detected with high accuracy.

In addition, according to the seventh embodiment, the controller 411 may fix the compression performance of the compressor 201 to a predetermined value. Accordingly, in this embodiment, the refrigerant state at the inlet and the outlet of the compressor 201 may be maintained to constant, and the refrigerant amount ratio may be detected with high accuracy.

According to the seventh embodiment, the controller 411 may fix the opening degree of the first expansion valve 204 to a predetermined value. As a result, the degree of cooling of the refrigerant in the first expansion valve 204 may be maintained to be constant, and the refrigerant amount ratio may be detected with high accuracy.

According to the seventh embodiment, the controller 411 may fix the rotational speed of the outdoor fan 10F and the rotational speed of the indoor fan 11F to a predetermined value. Accordingly, it may be possible to maintain the degree of heat exchange in the condenser 203 and the degree of heat exchange in the evaporator 205 to be constant and thus the refrigerant amount ratio may be detected with high accuracy.

According to the seventh embodiment, since the auxiliary unit 13 is separately installed from the air conditioner 100 and detachably attached in the first refrigerant pipe 121 and the second refrigerant pipe 122, the auxiliary unit 13 may have the versatility. Since the auxiliary unit 13 is provided with the first and second trapper 13*a* and 13*b* configured to capture the refrigerator oil, sludge, and oxide scale in the refrigerant, by using a single auxiliary unit 13, it may be possible to eliminate the inconvenience generated by changing the refrigerant of the plurality of outdoor units. Therefore, there may be no need of manufacturing an outdoor unit for the refrigerant exchange, and the deterioration of productivity may be prevented. When replacing the trapping member 13*a*4 and 13*b*4, the maintenance may be easily performed by separating the auxiliary unit 13 from the refrigerant pipe 12.

Although the refrigerant flows from the first branch pipe 13*a*1 and 13*b*1 to the second branch pipe 13*a*2 and 13*b*2 or although the refrigerant flows from the second branch pipe 13*a*2 and 13*b*2 to the first branch pipe 13*a*1 and 13*b*1 by switching the cooling operation into the heating operation or vice versa, it may be possible to allow a flow direction of the refrigerant flowing in the connection pipe 13*a*3 and 13*b*3 to be the same. Since the trapping member 13*a*4 and 13*b*4 is installed in the connection pipe 13*a*3 and 13*b*3, the flow direction of the refrigerant flowing in the trapping member 13*a*4 and 13*b*4 may be constant, and thus impurities captured by the trapping member 13*a*4 and 13*b*4 may be prevented from flowing to the refrigerant pipe 12 again.

An Eighth Embodiment

An auxiliary unit 13 according to the eighth embodiment will be described with reference to the drawings.

According to the seventh embodiment, it may be possible to precisely measure the amount of refrigerant in the air conditioner 100. However, according to the eighth embodiment, when the refrigerant is supplemented, while calculating the refrigerant amount ratio, it may be possible to display a notification informing a user, who performs an operation, of operating a refrigerant injection valve 216, promptly when charging the refrigerant is started and the refrigerant amount ratio reaches 100%.

Figure 25:
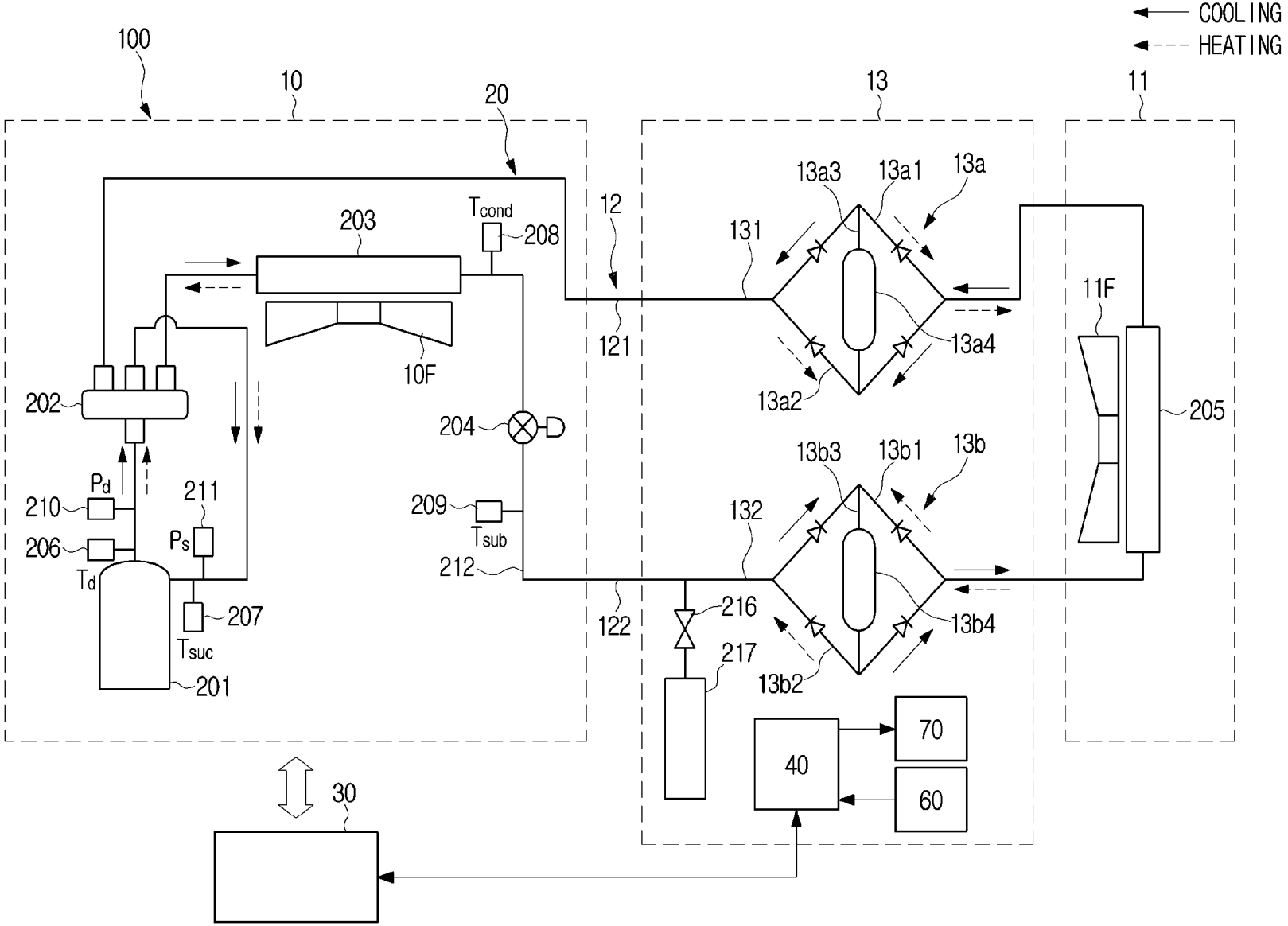
FIG. 25 is a schematic block diagram illustrating a configuration of an air conditioner and an auxiliary unit according to an eighth embodiment.

FIG. 25 is a schematic block diagram illustrating a configuration of the air conditioner 100 and the auxiliary unit 13 according to the eighth embodiment.

According to the eighth embodiment, the auxiliary unit 13 may further include a refrigerant supply device provided with a refrigerant injection valve (charging valve) 216 and a refrigerant storage container 217. The refrigerant supply device may be connected to the second internal pipe 132 to supply the refrigerant to the second internal pipe 132.

The refrigerant injection valve 216 may be a valve configured to be opened or closed by a user who performs an operation to supplement the refrigerant according to instructions displayed on the display 70.

The refrigerant storage container 217 may be a container to store the supplemented refrigerant.

Figure 26:
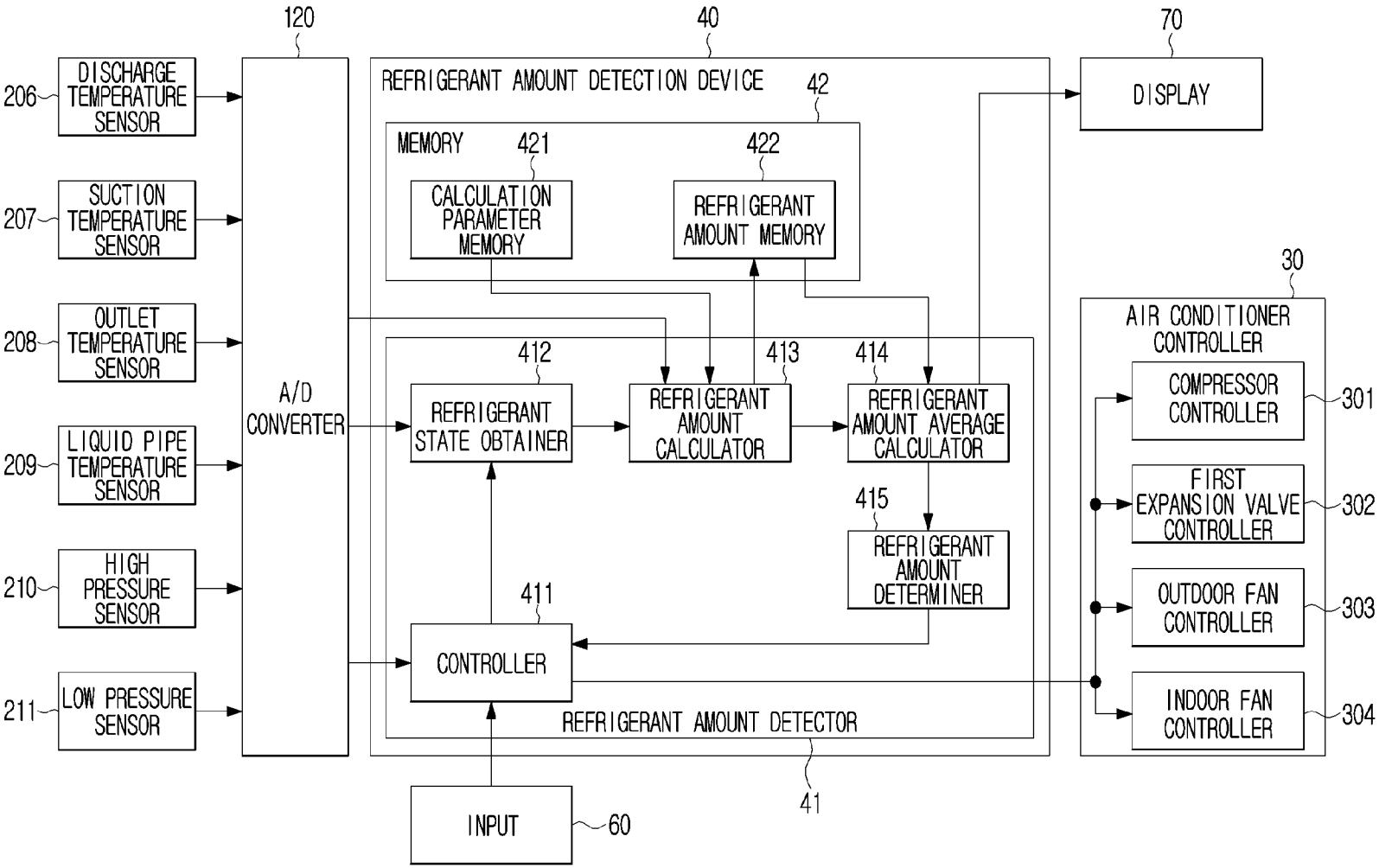
FIG. 26 is a schematic block diagram illustrating a configuration of a refrigerant detection device according to the eighth embodiment.

FIG. 26 is a schematic block diagram illustrating a configuration of a refrigerant detection device 40 according to the eighth embodiment.

According to the eighth embodiment, the configuration of the refrigerant amount detection device 40 may be the same as that of the refrigerant detection device 40 according to the seventh embodiment (FIG. 24), except that a refrigerant amount determiner 415 is included and a new function is added to the refrigerant amount average calculator 414 and the controller 411. Therefore, a description other than the refrigerant amount average calculator 414, the refrigerant amount determiner 415 and the controller 411 will be omitted.

The refrigerant amount average calculator 414 may read a refrigerant amount ratio that is calculated within a predetermined time (e.g., the past five minutes), from the refrigerant amount memory 422. The refrigerant amount average calculator 414 may calculate a moving average value of the read refrigerant amount ratio and output the calculated moving average value of the refrigerant amount ratio to the refrigerant amount determiner 415.

The refrigerant amount determiner 415 may determine whether the moving average value of the refrigerant amount ratio is more than 100% or not, based on the moving average value of the refrigerant amount ratio received from the refrigerant amount average calculator 414. When it is determined that the moving average value of the refrigerant amount ratio is more than 100%, the refrigerant amount determiner 415 may output a charging end signal to the controller 411.

The controller 411 may output a command, which is configured to inform a user who performs an operation, about "open" or "close" the refrigerant injection valve 216, on the display 70, according to the input of the detection start information from the input 60 and the input of charging end signal from the refrigerant amount determiner 415.

An operation of the refrigerant amount detection device 40 according to the eighth embodiment may be the same as the operation of the refrigerant amount detection device 40 according to the third embodiment (refer to FIG. 8)

According to the eighth embodiment, the air conditioner 100 may be provided with the refrigerant injection valve 216 to charge the refrigerant to the air conditioner 100 and depending on the determination of the refrigerant amount determiner 415, the air conditioner 100 may display an instruction configured to close the refrigerant injection valve 216, to the display 70. Accordingly, it may be possible to allow a user who performs an operation to open the refrigerant injection valve 216 when the detection of the refrigerant amount ratio is started and it may be possible to allow a user who performs an operation to promptly close the refrigerant injection valve 216 when the refrigerant amount ratio becomes more than 100%. Therefore, the refrigerant may be surely supplemented.

According to the eighth embodiment, the refrigerant injection valve 216 may be opened or closed by a user who performs the operation, but alternatively it may be possible that the controller 411 allows the refrigerant injection valve 216 to be automatically opened or closed through the air conditioner controller 30.

According to each embodiment described above, when the reliable protection of the compressor 201 is continued and it enters the protection station (i.e., each measured value of the discharge temperature, the overcurrent, the high voltage and the low pressure is over a minimum physical amount that causes a predetermined reaction), it may be possible to stop the operation of the air conditioner 100 and display "detection failure" on the display 70.

A Ninth Embodiment

The ninth embodiment of the present disclosure will be described with reference to the drawings.

According to the ninth embodiment, an auxiliary unit 13 may include the configuration of the eighth embodiment and further include a refrigerant storage configured to store a surplus refrigerant of the refrigerant circuit 20.

Figure 27:
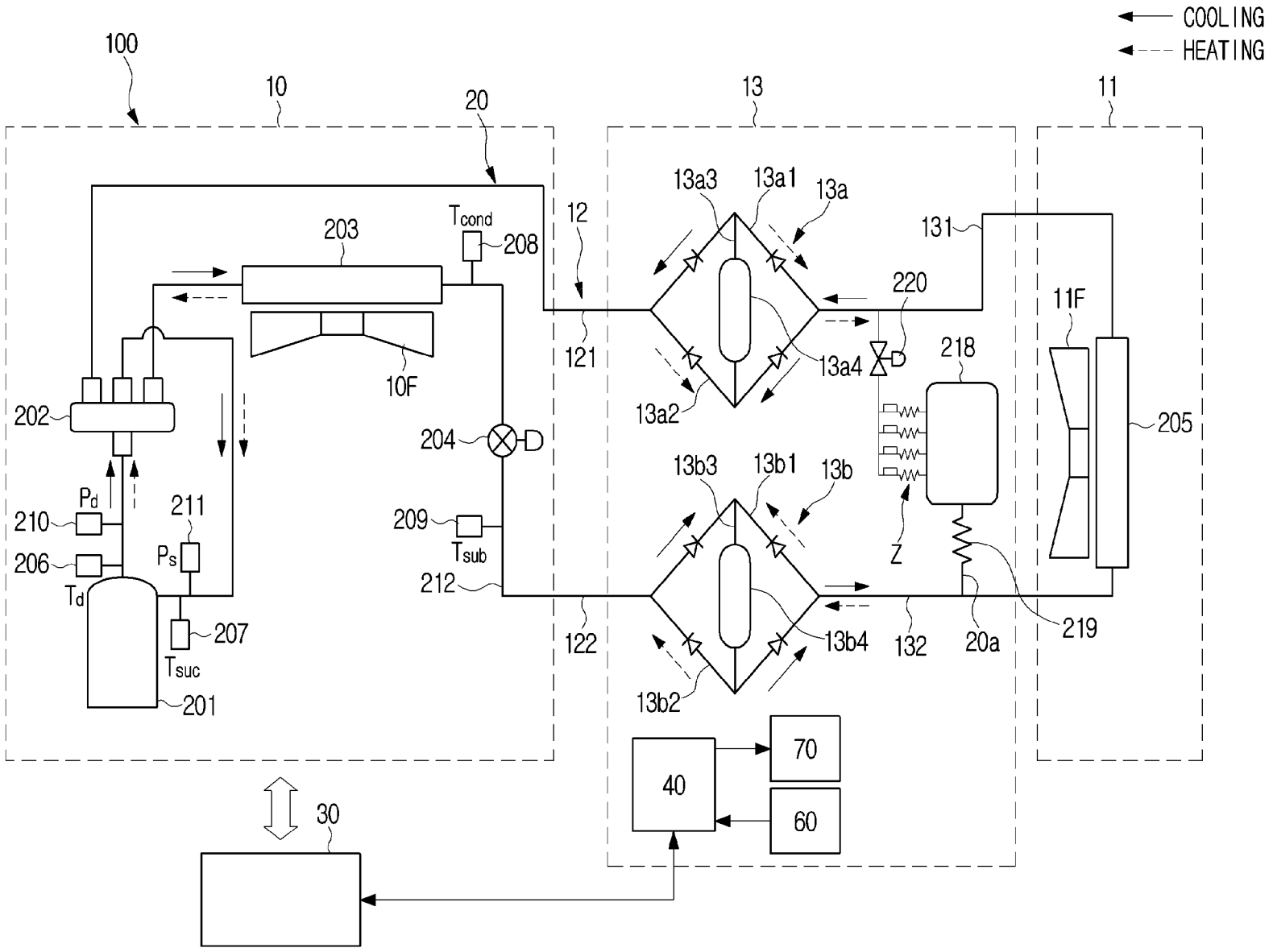
FIG. 27 is a schematic block diagram illustrating a configuration of an air conditioner and an auxiliary unit according to a ninth embodiment.

Particularly, as illustrated in FIG. 27, the auxiliary unit 13 may include a receiver 218 that is an example of refrigerant storage configured to store a surplus refrigerant; and a receiver pressure-reducing valve 219 that is an example of flow controller configured to reduce the pressure of the refrigerant while regulating the flow of the refrigerant discharged from the receiver 218.

According to the ninth embodiment, the degree of the opening of the receiver pressure-reducing valve 219 may be controlled by the control of the air conditioner controller 30, and the receiver pressure-reducing valve 219 may be configured to regulate the pressure and the amount of the refrigerant passing the receiver pressure-reducing valve 219.

A branch path 20*a* may be diverged from a pipe (the second internal pipe 312) between the outdoor heat exchanger 102 (outdoor heat exchanger) and the first expansion valve 103 in the refrigerant circuit 20. The receiver 218 may be connected to an end of the branch path 20*a*. In addition, the receiver pressure-reducing valve 219 may be installed in the branch path 20*a*.

According to the ninth embodiment, the receiver 218 may be formed of material having thermal conductivity, e.g., iron. For example, the receiver 218 may have a cylindrical shape and vertically installed in the outdoor unit 10. A connector connected to the end of the branch path 20*a* may be formed in a bottom of the receiver 218 that is vertically lowered. In other words, as for the receiver 218 according to the ninth embodiment, the refrigerant may be introduced and discharged via the connector installed in a vertically lower portion of the receiver 218.

The receiver 218 may store a surplus refrigerant during the cooling operation and a defrosting operation. In addition, during a heating operation, the receiver 218 may supply the refrigerant stored at the time of the cooling operation or the defrosting operation, to the refrigerant circuit 20. In other words, as for the air conditioner 100 according to the ninth embodiment, it may be possible to regulate the amount of refrigerant circulating in the refrigerant circuit 20 by the receiver 218.

The volume of the receiver 218 may be set the same as a volume obtained by converting an amount of refrigerant obtained by subtracting an optimal amount of refrigerant when the cooling operation, from an optimal amount of refrigerant when the heating operation, into a super cooled liquid state. "Optimum amount of refrigerant" may represent an amount of refrigerant allowing the system efficiency of the heating operation and cooling operation to be the highest. Although a detail description will be described later, in the air conditioner 100 according to the ninth embodiment, the optimal amount of refrigerant for the heating operation may be sealed in the refrigerant circuit 20. Therefore, when the volume is set as mentioned above, the surplus refrigerant may be stored in the receiver 218 during the cooling operation, and thus the cooling operation may be performed with the optimal amount of refrigerant. Accordingly, the increase in size of the receiver 218 may be prevented.

Figure 28:
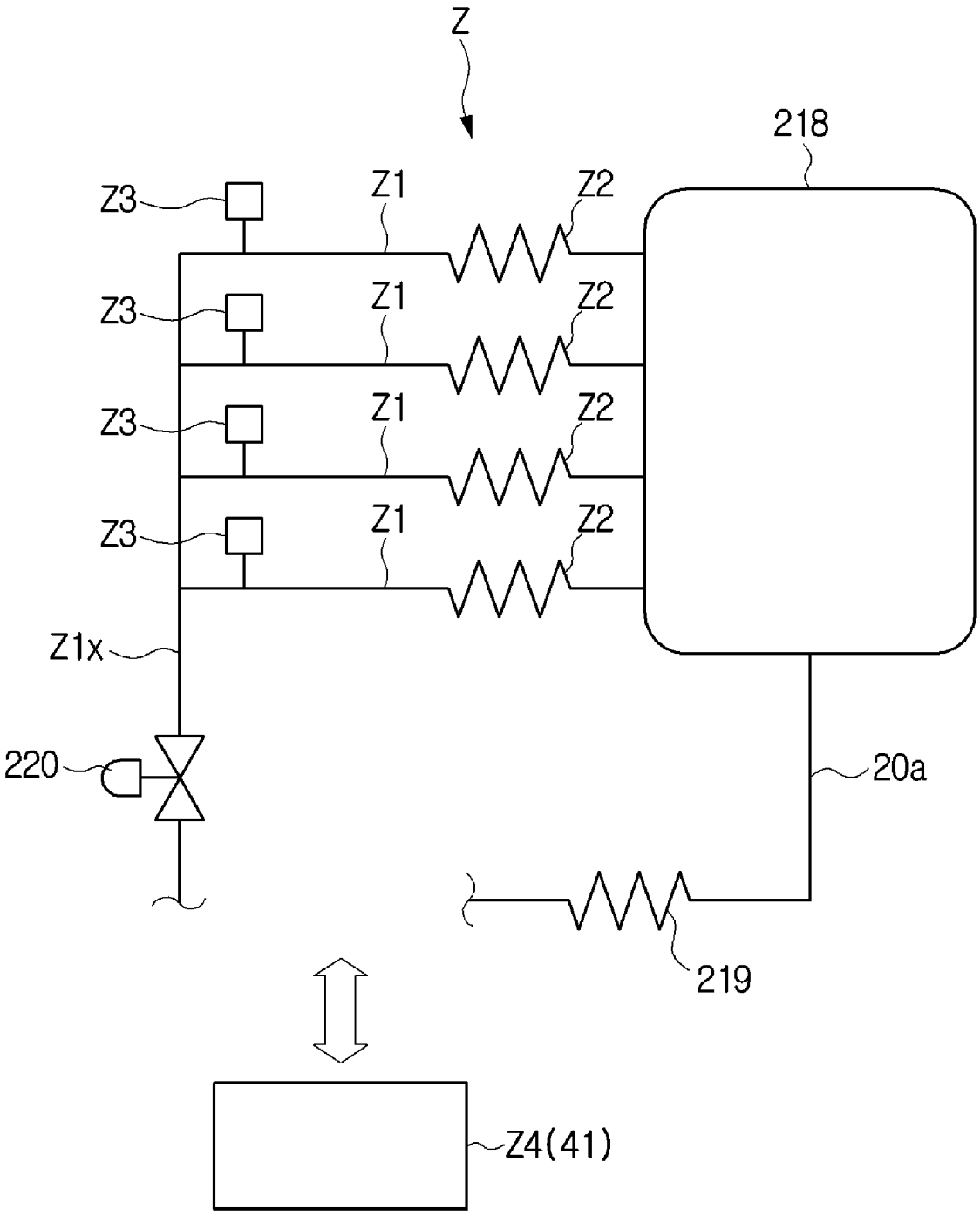
FIG. 28 is a view illustrating a configuration of a refrigerant amount detection device according to the ninth embodiment.

However, the auxiliary unit 13 according to the ninth embodiment may be provided with a refrigerant amount detection device (Z) configured to detect an amount of the refrigerant in the receiver 218 that is the refrigerant storage Particularly, as illustrated in FIG. 28, the refrigerant amount detection device (Z) may include a plurality of derivation paths (Z1) connected to a plurality of different height positions of the receiver 218; a fluid resistance (Z2), e.g., a plurality of capillaries installed in each of the plurality of derivation paths (Z1); a plurality of temperature sensors (Z3) installed in the downstream side of the fluid resistance (Z2) in the plurality of derivation paths (Z1); and a refrigerant amount detector (Z4) configured to detect the amount of refrigerant in the receiver 218 by using the refrigerant temperature obtained by the plurality of temperature sensors (Z3).

A collection pipe (Z1x) formed in the plurality of derivation paths (Z1) may be connected to the first internal pipe 131. Meanwhile, the connection opening and closing valve 220 may be installed in the collection pipe (Z1x) and the opening and closing state of the collection pipe (Z1x) may be switched by the connection opening and closing valve 220.

The refrigerant amount detector (Z4) may be configured with the refrigerant amount detector 41 according to the above mentioned embodiment.

Particularly, the refrigerant amount detector 41 may acquire the detection temperature of the plurality of temperature sensors (Z3) and then detect the amount of the refrigerant in the receiver 218 by using the inequality between the detection temperatures of the plurality of temperature sensors. Since among the plurality of derivation paths (Z1), a detection temperature of the temperature sensor (Z3) of the derivation path (Z1) connected to a liquid part is different from a detection temperature of the temperature sensor (Z3) of the derivation path (Z1) connected to a gas part, it may be possible to distinguish between the derivation path (Z1) through which the liquid refrigerant passes and the derivation path (Z1) through which the liquid refrigerant does not pass. Therefore, the refrigerant amount detector 41 may detect the amount of the refrigerant in the receiver 218.

According to the ninth embodiment, the air conditioner 100 may detect the amount of refrigerant by additionally installing the auxiliary unit 13 on the air conditioner 100 in the conventional manner. Since the refrigerant amount detection device (Z) configured to detect the amount of the refrigerant in the refrigerant storage 218 is provided, it may be possible to detect the amount of refrigerant in the refrigerant storage 218 and the amount of refrigerant in the air conditioner 100 (the refrigerant circuit 20) with high accuracy, regardless of the refrigerant state at the outlet of the outdoor heat exchanger 203.

In the above-described example, the air conditioner 100 provided with the receiver pressure-reducing valve 219, which is an example of a flow rate adjusting means, has been described. However, an example of the flow rate adjusting means is not limited to the pressure reducing valve. For example, an opening and closing valve and a flow control valve may be used as the flow rate adjusting means. In this case, the flow rate and the speed of the refrigerant discharged from the receiver 218 to the refrigerant circuit 20 through the branch path 20*a* may be adjusted.

The configuration of FIG. 22 according to the sixth embodiment may be used as the refrigerant amount detection device (Z).

According to the ninth embodiment, the auxiliary unit 13 may be provided with the refrigerant amount detection device 40 to detect the amount of the refrigerant in the refrigerant circuit 20 by using the equation and to detect the amount of the refrigerant in the refrigerant storage by the refrigerant amount detection device (Z). However, the auxiliary unit may not detect the amount of the refrigerant in the refrigerant circuit 20 by using the equation and it may be possible to have only the refrigerant amount detection device (Z).

A Tenth Embodiment

The tenth embodiment of the present disclosure will be described with reference to the drawings.

Figure 29:
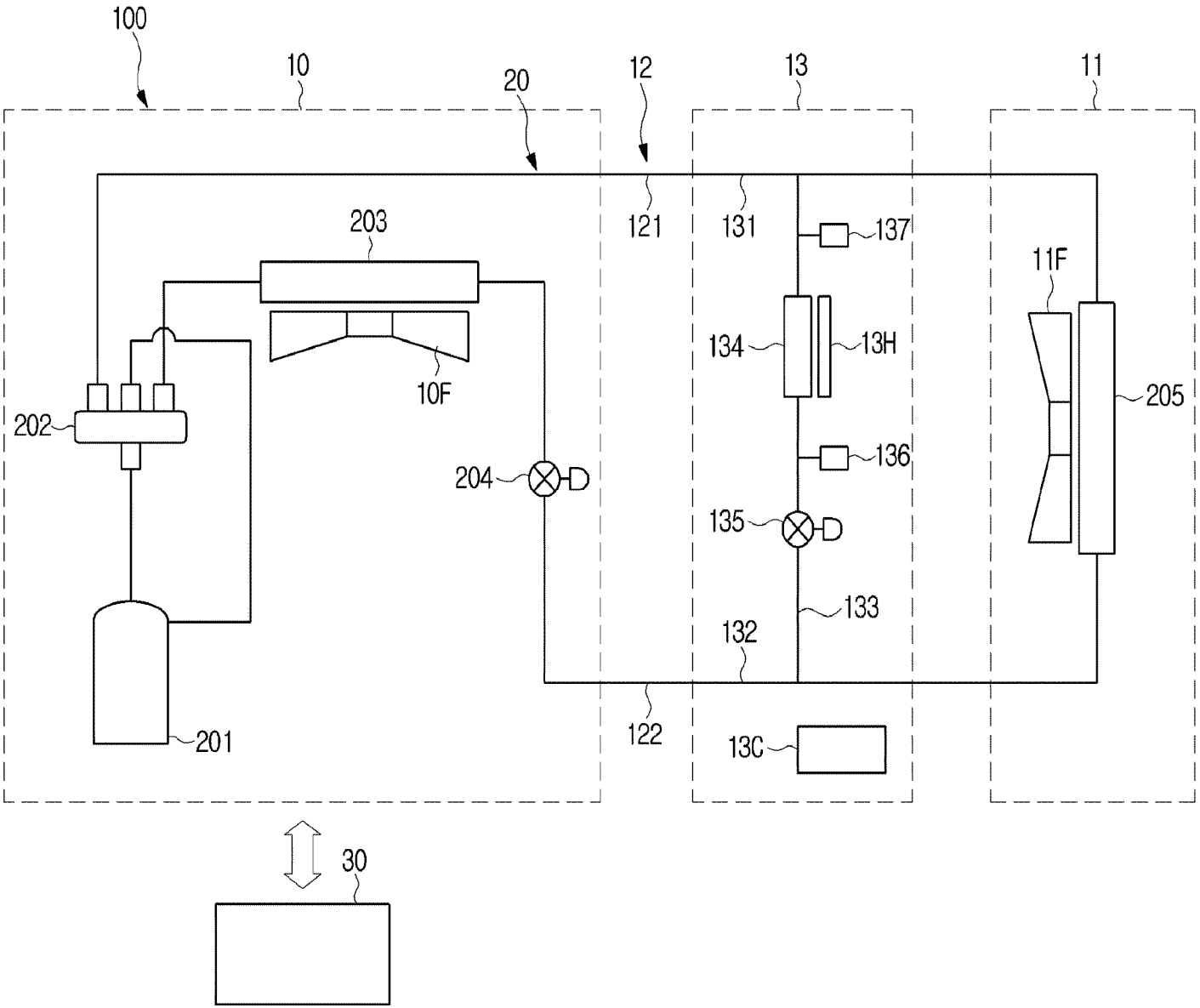
FIG. 29 is a schematic block diagram illustrating a configuration of an air conditioner and an auxiliary unit according to a tenth embodiment.

According to the tenth embodiment, as illustrated in FIG. 29, an auxiliary unit 13 may include a gas-side internal pipe 131 detachably connected to a gas-side refrigerant pipe (a first refrigerant pipe 121); a liquid-side internal pipe 132 detachably connected to a liquid-side refrigerant pipe (a second refrigerant pipe 122); a bypass pipe 133 connected to the gas-side internal pipe 131 and the liquid-side internal pipe 132; and an auxiliary heat exchanger 134 installed in the bypass pipe 133 and configured to perform a heat exchange with other heat source.

The gas-side internal pipe 131 may be connected to the first refrigerant pipe 121 to connect the evaporator 205 of the indoor unit 11 and the four-way switching valve 202 of the outdoor unit 10. The liquid-side internal pipe 132 may be connected to the second refrigerant pipe 122 to connect the condenser 203 (the first expansion valve 204) of the indoor unit 11 and the evaporator 205 of the indoor unit 11.

According to the tenth embodiment, the auxiliary heat exchanger 134 may be configured to exchange a heat between a heater 13H that is other heat source and a refrigerant flowing in the bypass pipe 133. The heater 13H may be installed in the auxiliary unit 13.

Figure 30A:
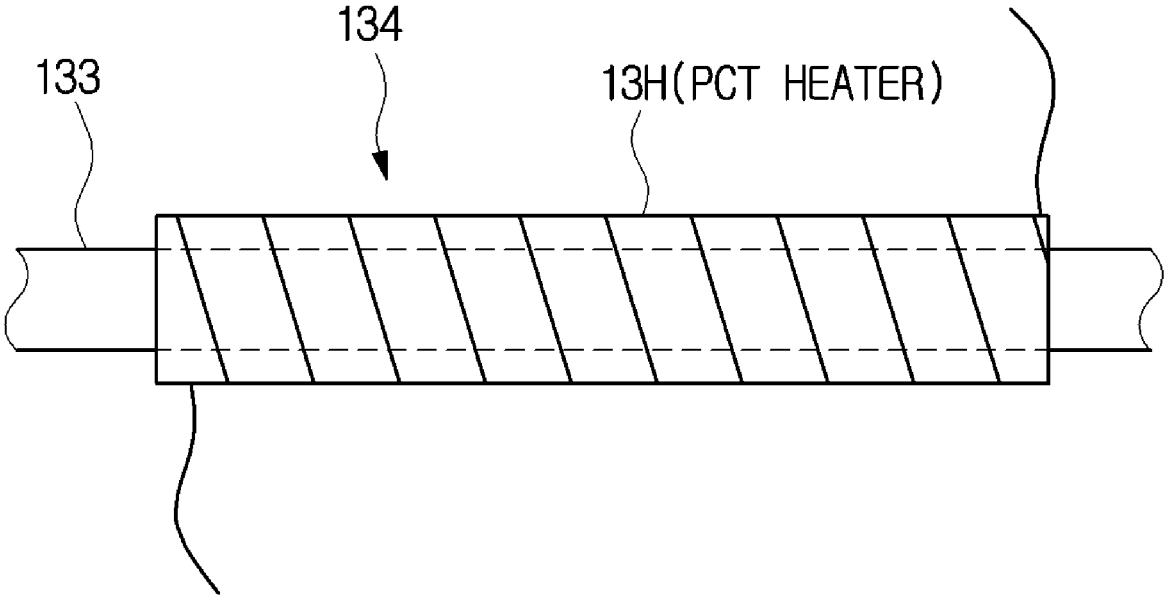
FIG. 30 includes FIG. 30A and FIG. 30B which are a schematic block diagram illustrating a type of the heater and a configuration of an auxiliary heat exchanger configured to heat the refrigerant.
Figure 30B:
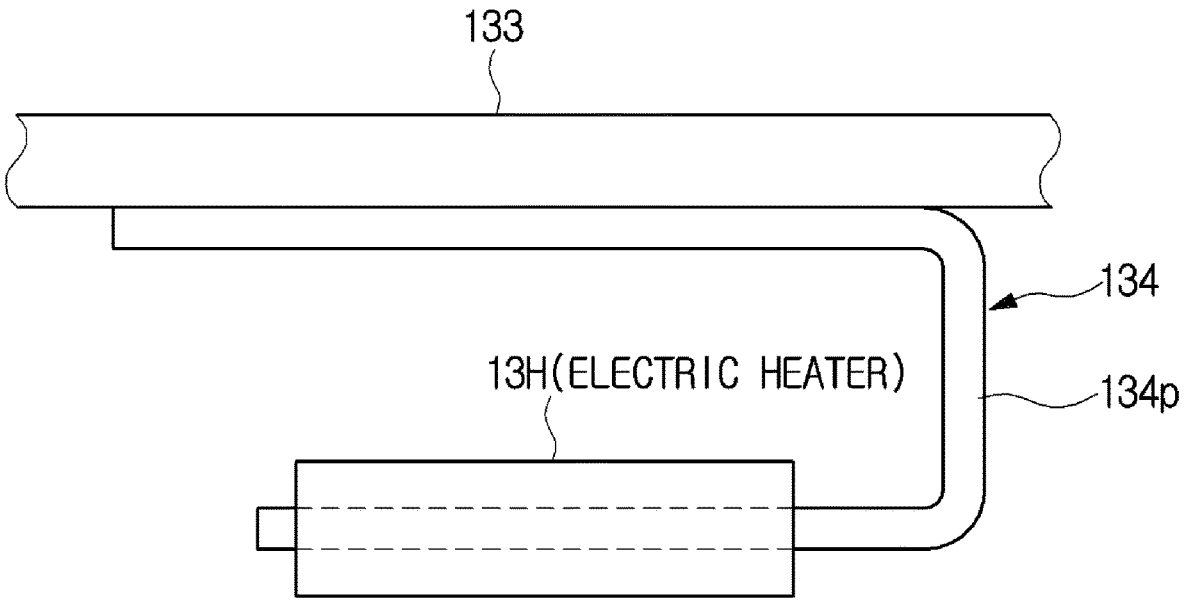

FIG. 30 illustrates the type of the heater 13H and a configuration of the auxiliary heat exchanger 134 configured to heat the refrigerant. As illustrated in FIG. 30A, when using a heater configured to autonomously control a temperature, e.g., a PTC heater, as the heater 13H, it may be possible to autonomously maintain a temperature at which refrigerant does not deteriorate, e.g., a temperature equal to or higher than 150° C., and thus it may be possible to allow the heat exchanger to have a simple structure, e.g., directly wielding the heater 13H on the bypass pipe 133 (the refrigerant pipe). As illustrated in FIG. 30B, when using a heater incapable of autonomously controlling a temperature, e.g., an electric heater, and thus it may be possible to allow a configuration configured to transfer a heat by installing a heat pipe 134*p* between the heater 13H and the bypass pipe 133 (the refrigerant pipe) so that it is not possible to perform heating above a certain temperature.

In the bypass pipe 133, a flow rate adjustment valve 135 (an additional expansion valve) configured to adjust the amount of the refrigerant flowing to the gas pipe side from the liquid pipe side may be installed. The degree of opening of the flow rate adjustment valve 135 may be controlled by an auxiliary unit controller 13C.

In the bypass pipe 133, an inlet temperature sensor 136 provided in an inlet side of the auxiliary heat exchanger 134 and configured to detect a temperature of the refrigerant flowing into the auxiliary heat exchanger 134 may be installed. The inlet temperature sensor 136 may output a signal indicating the detected inlet temperature to the auxiliary unit controller 13C.

In the bypass pipe 133, an outlet temperature sensor 137 provided in an outlet side of the auxiliary heat exchanger 134 and configured to detect a temperature of the refrigerant discharging from the auxiliary heat exchanger 134 may be installed. The outlet temperature sensor 137 may output a signal indicating the detected outlet temperature to the auxiliary unit controller 13C.

Hereinafter the cooling operation of the air conditioner 100 connected to the auxiliary unit 13 will be briefly described with a function of the auxiliary unit controller 13C.

(1) A Normal Cooling Operation

During the normal cooling operation, the auxiliary unit controller 13C may output a closing signal to the flow adjustment valve 135, and allow the flow adjustment valve 135 to be in the closed state. In addition, the auxiliary unit controller 13C may turn off the heater 13H.

(2) A Cooling Operation at the Low Outside Air Temperature

During the cooling operation at the low outside air temperature, the auxiliary unit controller 13C may output an opening signal to the flow rate adjustment valve 135 by turning on the heater 13H and allow the flow rate adjustment valve 135 to be in the open state. The auxiliary unit controller 13C may acquire the inlet temperature from the inlet temperature sensor 136 and the outlet temperature from the outlet temperature sensor 137. Accordingly, the auxiliary unit controller 13C may control the degree of the opening of the flow rate adjustment valve 135 based on the temperature difference (SH) between the inlet temperature and the outlet temperature.

As for the auxiliary unit 13 according to the tenth embodiment, since the auxiliary heat exchanger 134 configured to perform a heat exchange with the heater 13H, which is other heat source is installed in the bypass pipe 133 connected to the gas-side internal pipe 131 and the liquid-side internal pipe 132, a part of the refrigerant flowing in the liquid-side internal pipe 132 may be heated by the auxiliary heat exchanger 134 and then supplied to the gas-side internal pipe 131. Accordingly, the heat exchange amount of the outdoor heat exchanger 203 and the indoor heat exchanger 205 may be controlled by regulating the supply amount of the refrigerant supplied to the indoor heat exchanger 205 and the outdoor heat exchanger 203. Therefore, during the cooling operation at the low outside air temperature, the heat exchange amount of the outdoor heat exchanger 203 and the indoor heat exchanger 205 may be controlled and thus there may be no difficulty in performing the cooling operation at the low outside air temperature. In addition, by attaching the auxiliary unit 13 to the air conditioner 100 in the conventional manner, the above mentioned function may be added to the air conditioner 100 in the conventional manner.

Figure 31:
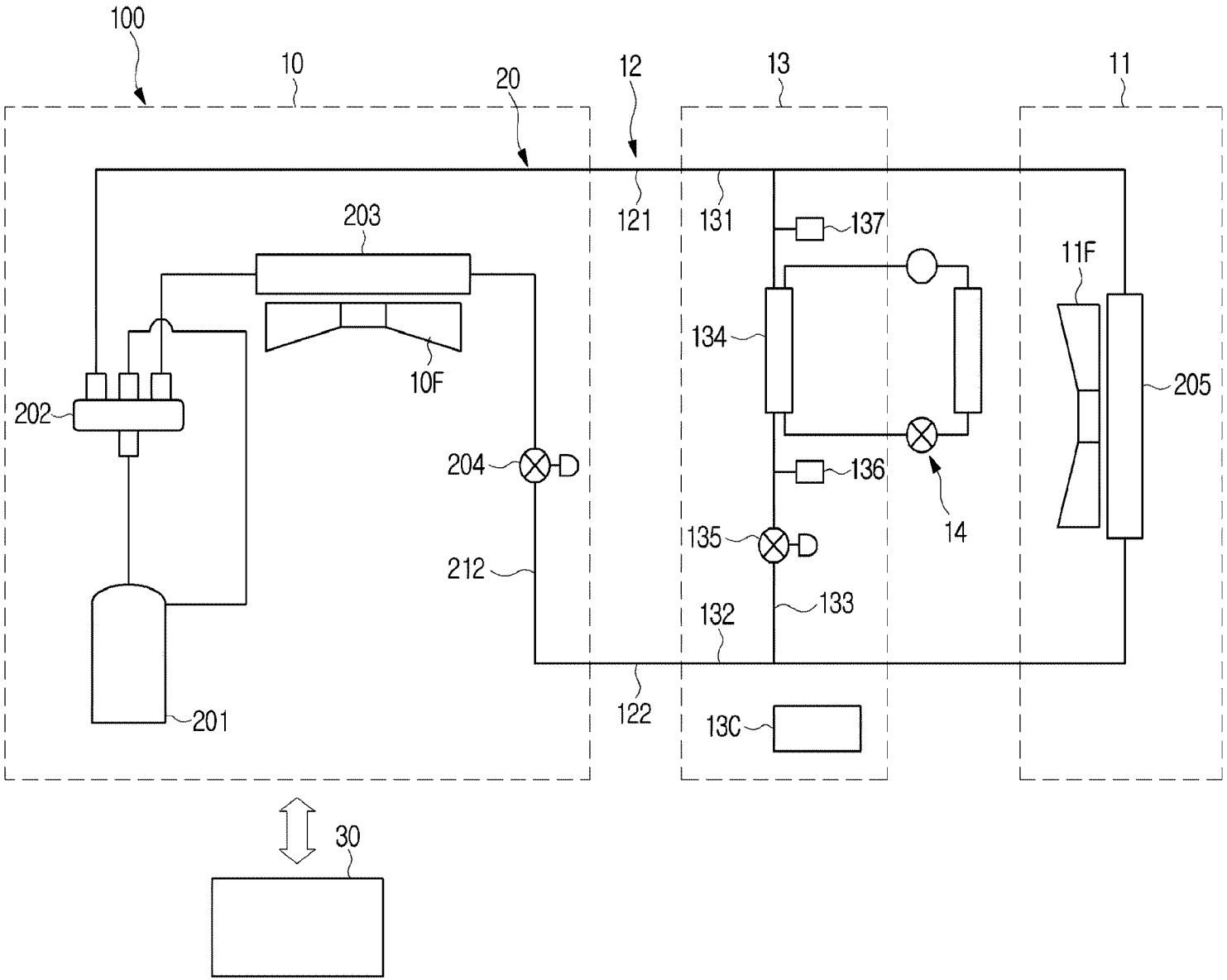
FIG. 31 is a view illustrating a modified example of the auxiliary unit.
Figure 32:
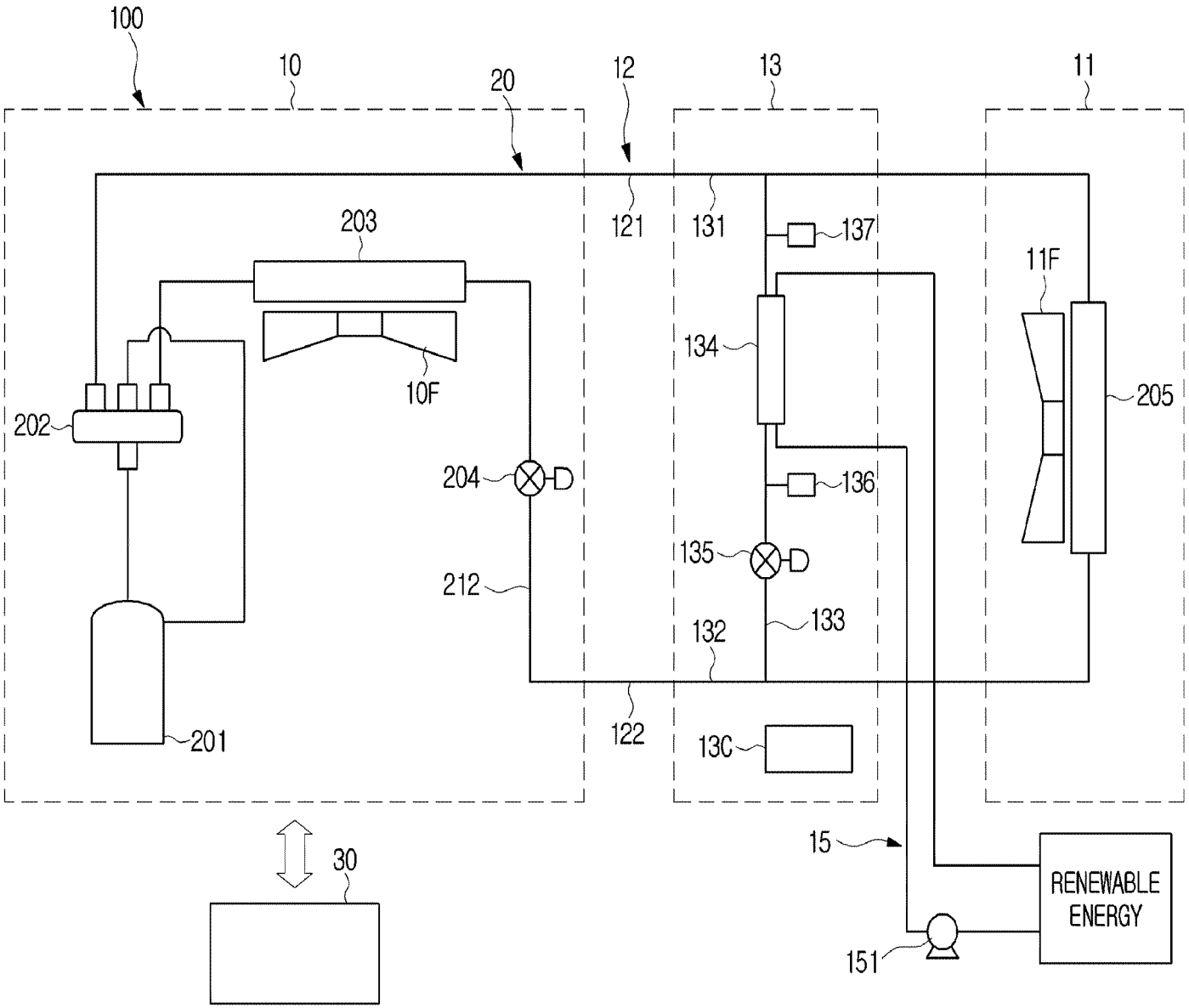
FIG. 32 is a view illustrating a modified example of the auxiliary unit.

As for the other heat source according to the tenth embodiment, other than the heater 13H according to the tenth embodiment, it may be possible to employ a heat pump 14 as illustrated in FIG. 31, and a heat transfer system 15 configured to transfer a heat generated in the outside, as illustrated in FIG. 32.

When using the heat pump 14 as illustrated in FIG. 31, during the cooling operation at the low outside air temperature, the high temperature refrigerant may be supplied to the auxiliary heat exchanger 134 by the heat pump 14. Accordingly, as for the auxiliary heat exchanger 134, the heat exchange between the high temperature refrigerant of the heat pump 14 and the refrigerant flowing in the bypass pipe 133 may be performed. Meanwhile, the auxiliary unit controller 13C may acquire the inlet temperature from the inlet temperature sensor 136 and the outlet temperature from the outlet temperature sensor 137. Accordingly, the auxiliary unit controller 13C may control the degree of the opening of the flow rate adjustment valve 135 based on the temperature difference (SH) between the inlet temperature and the outlet temperature.

When using the heat transfer system 15 as illustrated in FIG. 32, during the cooling operation at the low outside air temperature, the high temperature refrigerant may be supplied to the auxiliary heat exchanger 134 by the heat transfer system 15. The heat transfer system 15 may be configured to transport the renewable energy, e.g., geothermal heat and solar heat, and the heat transfer system 15 may include a circulation pump 151 configured to circulate a heating medium. The auxiliary unit controller 13C may turn on the circulation pump 151 so that the high temperature refrigerant is supplied to the auxiliary heat exchanger 134U by the heat transfer system 15. The auxiliary unit controller 13C may acquire the inlet temperature from the inlet temperature sensor 136 and the outlet temperature from the outlet temperature sensor 137. Accordingly, the auxiliary unit controller 13C may control the degree of the opening of the flow rate adjustment valve 135 based on the temperature difference (SH) between the inlet temperature and the outlet temperature.

An Eleventh Embodiment

The eleventh embodiment of the present disclosure will be described with reference to the drawings.

Figure 33:
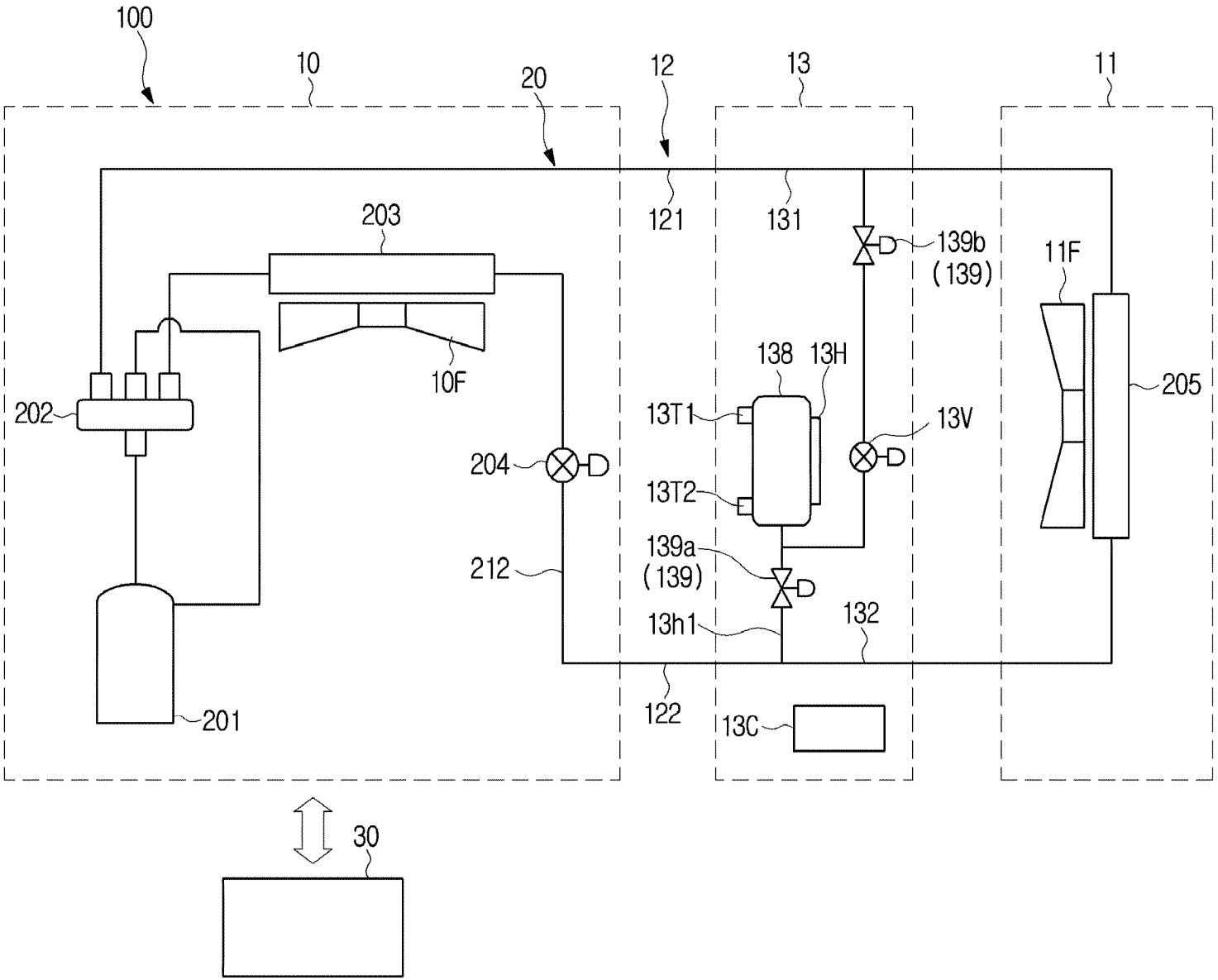
FIG. 33 is a schematic block diagram illustrating a configuration of an air conditioner and an auxiliary unit according to an eleventh embodiment.

According to the eleventh embodiment, as illustrated in FIG. 33, an auxiliary unit 13 may include a gas-side internal pipe 131 detachably connected to a gas-side refrigerant pipe (a first refrigerant pipe 121); a liquid-side internal pipe 132 detachably connected to a liquid-side refrigerant pipe (a second refrigerant pipe 122); a receiver 318 configured to store the refrigerant; a heating unit 13H configured to heat the refrigerant in the receiver 138; a first connection pipe **13*h*1 configured to allow the refrigerant to move between the receiver 138 and the liquid-side internal pipe 132; and a second connection pipe 13*h*2 diverged from the first connection pipe 13*h*1 and connected to the gas-side internal pipe 131**.

The gas-side internal pipe 131 may be connected to the first refrigerant pipe 121 to connect the evaporator 205 of the indoor unit 11 and the four-way switching valve 202 of the outdoor unit 10. The liquid-side internal pipe 132 may be connected to the second refrigerant pipe 122 to connect the condenser 203 (the first expansion valve 204) of the indoor unit 11 to the evaporator 205 of the indoor unit 11.

The receiver 138 may be formed of a material having a thermal conductivity, e.g., an iron. The receiver 138 may be heated by the heating unit 13H. The heating unit 13H may be a heater installed on the external surface of the receiver 138. In the receiver 138, a detector configured to detect whether the liquid refrigerant is present therein. The detector may include an upper temperature sensor 13T1 installed on the upper portion of the receiver 138 and a lower temperature sensor 13T2 installed on the lower portion of the receiver 138. An auxiliary unit controller 13C may acquire a detection signal from the upper temperature sensor 13T1 and the lower temperature sensor 13T2, and then the auxiliary unit controller 13C may determine that the liquid refrigerant is not present inside of the receiver 138 when the temperature difference is equal to or less than a certain temperature.

The first connection pipe **13*h*1 may be connected to a bottom surface placed in a vertical lower portion of the receiver 138. That is, according to the eleventh embodiment, the refrigerant may be introduced into or discharged from the receiver 138 via the first connection pipe 13*h*1 installed in the vertical lower portion. Accordingly, the refrigerant in the receiver 138 may be discharged in the liquid state while the refrigerant in the receiver 138 is hardly gasified. In the first connection pipe 13*h*1, a liquid side opening and closing valve 139*a* that is an electronic valve may be installed. Opening and closing of the liquid side opening and closing valve 139*a* may be controlled by the auxiliary unit controller 13**C.

In the second connection pipe **13*h*2, a flow rate adjustment valve (additional expansion valve) 13V configured to adjust the amount of the refrigerant flowing from the liquid pipe side to the gas pipe side, may be installed. The degree of opening of the flow rate adjustment valve 13V may be controlled by the auxiliary unit controller 13C. In the downstream side of the flow rate adjustment valve 13V of the second connection pipe 13*h*2, a gas side opening and closing valve 139***b* that is an electronic valve may be installed. Opening and closing of the gas side opening and closing valve 139*b* may be controlled by the auxiliary unit controller 13C. Meanwhile, a switching device 139 may be configured with the liquid side opening and closing valve 139*a* installed in the first connection pipe 13*h*1 and the gas side opening and closing valve 139*b* installed in the second connection pipe 13*h*2. Alternatively, the switching device 139 may be configured with a three-way valve installed in the connector of the first connection pipe 13*h*1 and the second connection pipe 13*h*2.

Next, the cooling operation of the air conditioner 100 connected to the auxiliary unit 13 will be briefly described with the function of the auxiliary controller 13C.

(1) A Normal Cooling Operation

Figure 34:
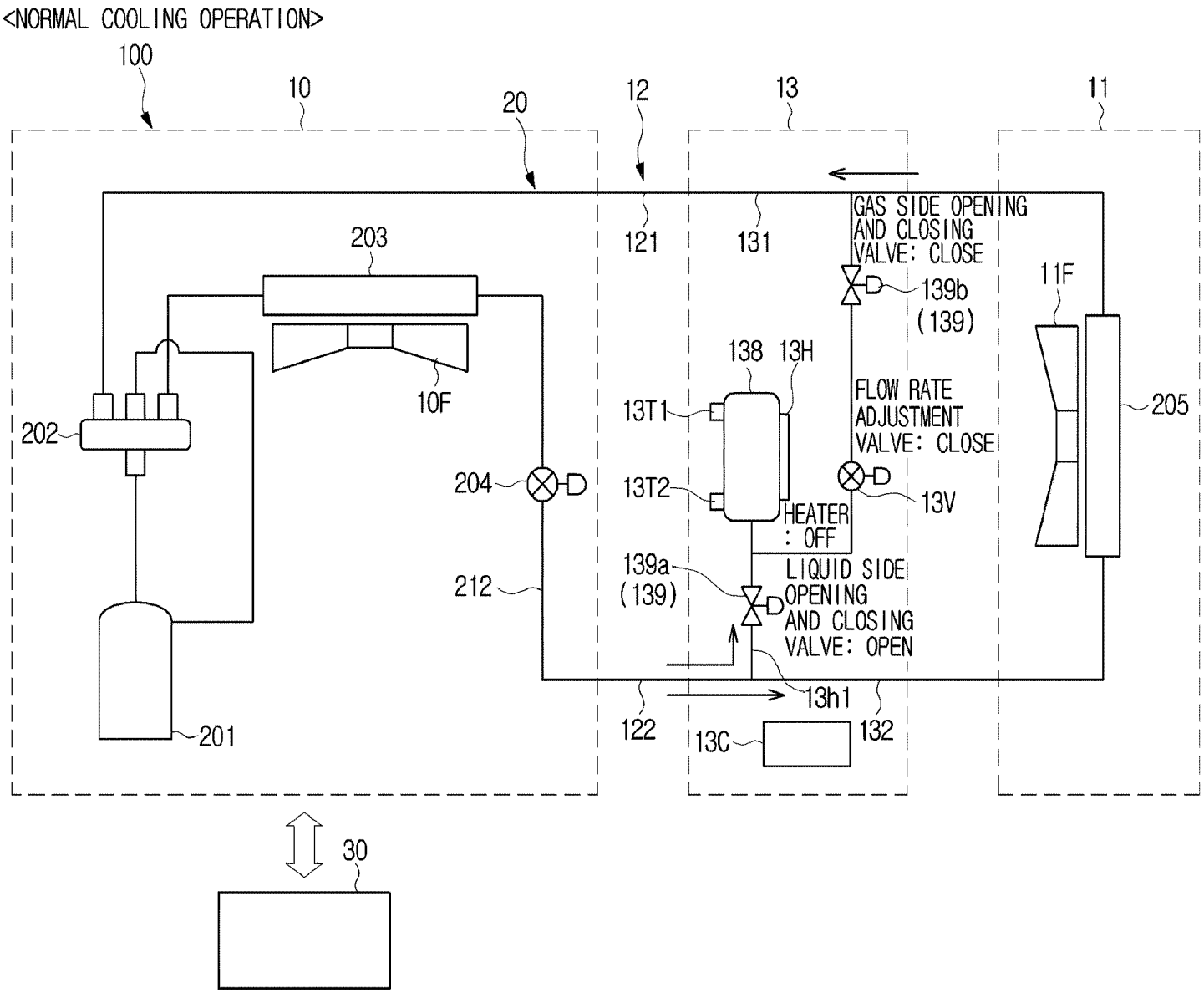
FIG. 34 is a view illustrating a refrigerant flowing during a normal cooling operation according to the eleventh embodiment.

As illustrated in FIG. 34, during the normal cooling operation, the auxiliary unit controller 13C may output an opening signal to the liquid side opening and closing valve 139*a*, and allow the liquid side opening and closing valve 139*a* to be in the open state. The auxiliary unit controller 13C may output a closing signal to the flow rate adjustment valve 13V and the gas side opening and closing valve 139*b*, and allow the flow rate adjustment valve 13V and the gas side opening and closing valve 139*b* to be in the closed state. In addition, the auxiliary unit controller 13C may turn off the heater 13H. In this case, since the air conditioner 100 performs the cooling operation, a part of the refrigerant, which flows from the outdoor unit 10 side to the indoor unit 11 side in the liquid-side internal pipe 132, may pass the first connection pipe 13*h*1 and then collected in the receiver 138 and thus it may be possible to maintain an appropriate amount of the refrigerant.

(2) A Cooling Operation at the Low Outside Air Temperature

Figure 35:
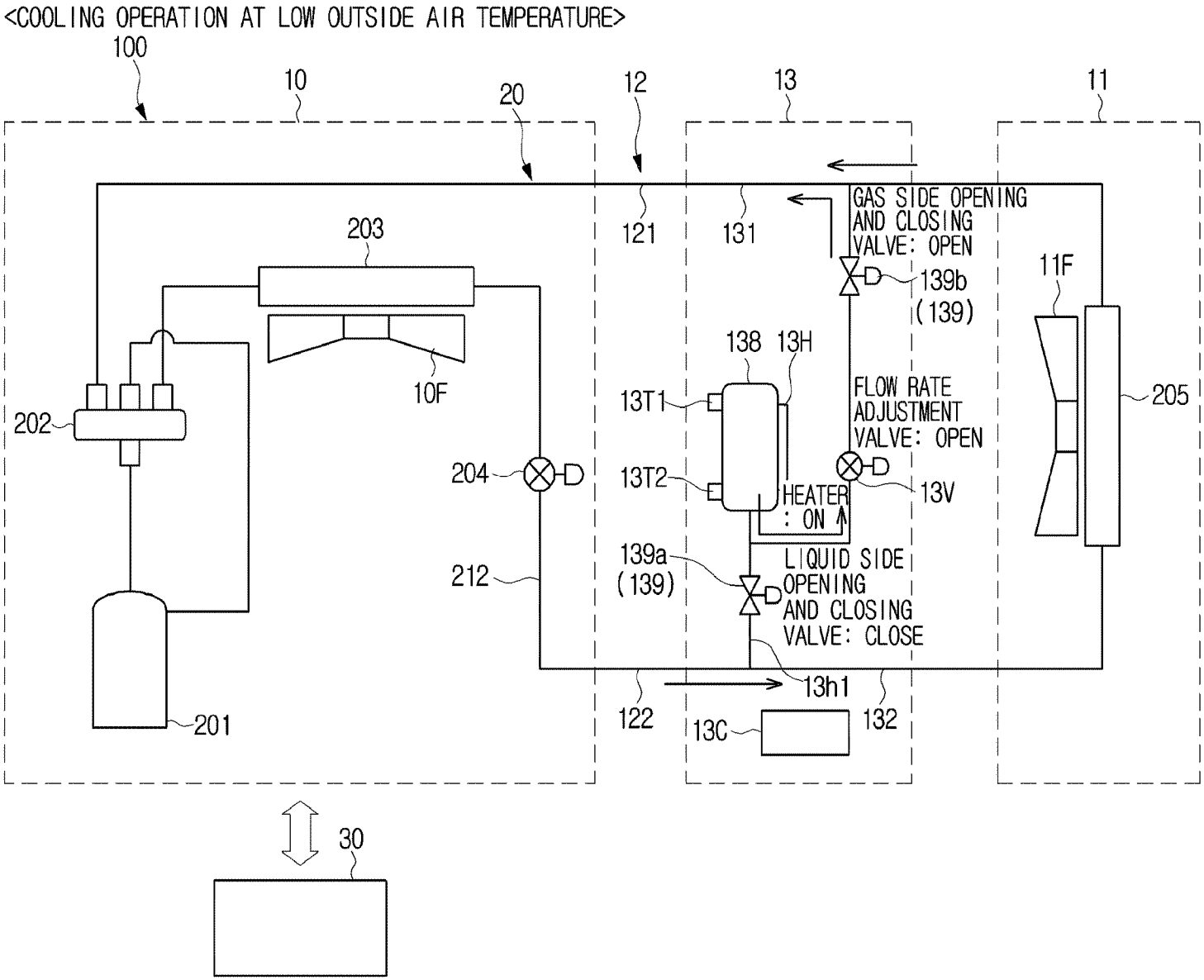
FIG. 35 is a view illustrating the refrigerant flowing during a cooling operation at the low outside air temperature according to the eleventh embodiment.

As illustrated in FIG. 35, during the cooling operation at the low outside air temperature, the auxiliary unit controller 13C may output a closing signal to the liquid side opening and closing valve 139*a*, and allow the liquid side opening and closing valve 139*a* to be in the closed state. In addition, the auxiliary unit controller 13C may turn on the heater 13H. The auxiliary unit controller 13C may output the opening signal to the flow rate adjustment valve 13V and the gas side opening and closing valve 139*b*, and allow the flow rate adjustment valve 13V and the gas side opening and closing valve 139*b* to be in the open state. In this case, the liquid refrigerant in the receiver 138 may be supplied from the second connection pipe 13*h*2 to the cycle. Accordingly, by collecting the refrigerant in the receiver 138 to the outdoor heat exchanger 203, it may be possible to reduce the condensing performance of the outdoor heat exchanger 203.

The auxiliary unit controller 13C may control the degree of the opening of the flow rate adjustment valve 13V according to a suction superheat degree of the outdoor unit 10 (compressor 201). The auxiliary unit controller 13C may acquire a detection temperature of the upper temperature sensor 13T1 and the lower temperature sensor 13T2, and then the auxiliary unit controller 13C may determine that the refrigerant in the receiver 138 is gasified and thus the liquid refrigerant is mostly supplied to the cycle when the temperature difference is equal to or less than a certain temperature. While turning off the heater 13H, the auxiliary unit controller 13C may output the closing signal to the flow rate adjustment valve 13V and the gas side opening and closing valve 139*b*, and allow the flow rate adjustment valve 13V and the gas side opening and closing valve 139*b* to be in the closed state.

(3) A Heating Operation

Figure 36:
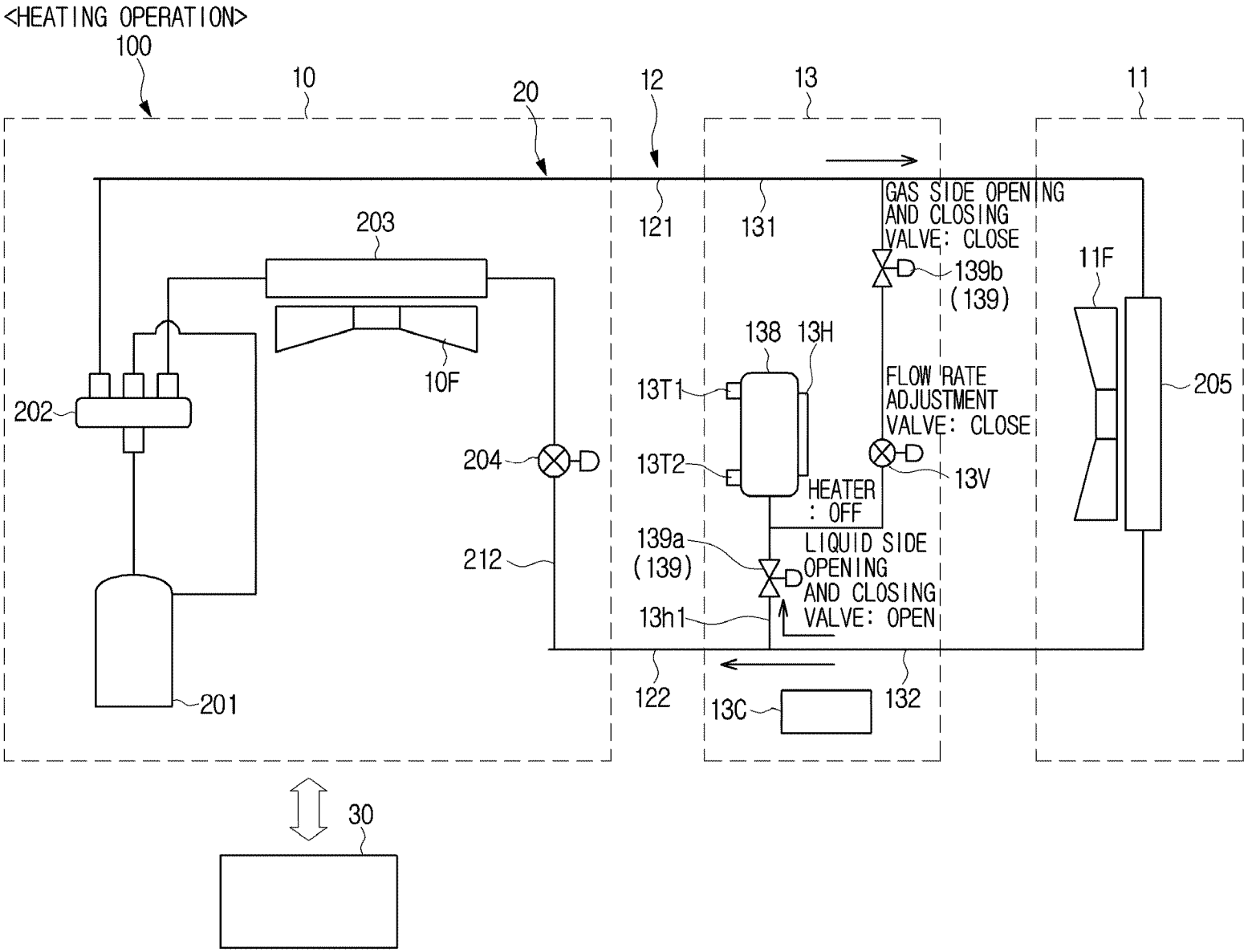
FIG. 36 is a view illustrating the refrigerant flowing during the heating operation according to the eleventh embodiment.

As illustrated in FIG. 36, during the heating operation, the auxiliary unit controller 13C may output the opening signal to the liquid side opening and closing valve 139*a*, and allow the liquid side opening and closing valve 139*a* to be in the open state. The auxiliary unit controller 13C may output the closing signal to the flow rate adjustment valve 13V and the gas side opening and closing valve 139*b*, and allow the flow rate adjustment valve 13V and the gas side opening and closing valve 139*b* to be in the closed state. In addition, the auxiliary unit controller 13C may turn off the heater 13H. In this case, since the air conditioner 100 performs the heating operation, a part of the refrigerant, which flows from the indoor unit 11 side to the outdoor unit 10 side in the liquid-side internal pipe 132, may pass the first connection pipe 13*h*1 and then collected in the receiver 138, and thus it may be possible to maintain an appropriate amount of the refrigerant.

As for the auxiliary unit 13 according to the eleventh embodiment, the refrigerant, which is stored in the receiver 138 during the cooling and the heating operation, may be heated by the heater 13H and then supplied to the gas side internal pipe 131 via the second connection pipe 13*h*2 during the cooling operation at the low outdoor temperature, and thus the liquid refrigerant may be collected in the outdoor heat exchanger 203 and thereby reducing the condensing performance of the outdoor heat exchanger 203. Accordingly, during the cooling operation at the low outdoor temperature, the heat exchange amount of the outdoor heat exchanger 203 and the indoor heat exchanger 205 may be controlled and thus there may be no difficulty in performing the cooling operation at the low outside air temperature. In addition, by attaching the auxiliary unit 13 to the air conditioner 100 in the conventional manner, the above mentioned function may be added to the air conditioner 100 in the conventional manner.

In the tenth embodiment and the eleventh embodiment, an air conditioner provided with a single outdoor unit and a single indoor unit has been described as an example, but alternatively it may be allowed that two or more indoor units are connected in parallel manner and that two or more outdoor units are connected in parallel manner.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. An air conditioner, comprising:

a refrigerant circuit provided with a compressor, a condenser, an expansion valve and an evaporator;

a refrigerant amount detection device including circuitry and configured to:

determine whether a refrigerant state in an outlet of the condenser is in a subcooled state or a gas-liquid two phase state based on a set value, and calculate a refrigerant amount ratio in the refrigerant circuit based on the determined refrigerant state and at least one of a temperature and a pressure detected in the refrigerant circuit, and a controller configured to control the refrigerant circuit according to the refrigerant amount ratio calculated by the refrigerant amount detection device.

2. The air conditioner of claim 1, wherein the refrigerant detection device calculates an average value of the refrigerant amount ratio based on the calculated refrigerant amount ratio.

3. The air conditioner of claim 1, wherein the refrigerant circuit further comprises:

a first temperature sensor configured to detect a first refrigerant temperature in the outlet of the condenser, and a second temperature sensor configured to detect a second refrigerant temperature of the refrigerant at a positon downstream from a fluid resistance installed in the outlet side of the condenser, wherein the refrigerant detection device determines whether the refrigerant is in the subcooled state or the gas-liquid two phase state based on the first refrigerant temperature and the second refrigerant temperature.

4. The air conditioner of claim 1, wherein the refrigerant circuit further comprises a subcooler provided between the condenser and the expansion valve and the refrigerant circuit is configured to cool a liquid refrigerant generated in the condenser.

5. The air conditioner of claim 4, wherein the controller allows at least one of the compressor, the condenser, the expansion valve, the evaporator and the subcooler to be constantly operated according to the control of the refrigerant amount detection device.

6. The air conditioner of claim 5, wherein the refrigerant circuit further comprises:

a refrigerant storage container configured to store a charging refrigerant and a refrigerant injection valve configured to control the refrigerant supplied from the refrigerant storage container, wherein the controller controls the refrigerant injection valve when an average value of refrigerant amount ratio reaches 100% during charging the refrigerant.

7. The air conditioner of claim 1, wherein the refrigerant circuit further comprises:

a receiver configured to store a surplus refrigerant present in the refrigerant circuit in the subcooled state; and a flow controller configured to reduce the pressure of a refrigerant discharged from the receiver while adjusting a flow rate of the refrigerant.

8. The air conditioner of claim 6, wherein the refrigerant comprises a non-azeotropic mixed refrigerant containing refrigerant R32 and HFO1234yf or HFO1234ze.

9. The air conditioner of claim 8, wherein the non-azeotropic mixed refrigerant is characterized in that HFC content is less than 70% by weight, HFO1234yf or HFO1234ze content is less than 30% by weight, and the remainder is a natural refrigerant.

10. The air conditioner of claim 7, wherein a volume of the surplus refrigerant stored in the receiver is equal to a volume obtained by subtracting an amount of refrigerant at the time of a cooling operation from an amount of refrigerant at the time of a heating operation, and the surplus refrigerant stored in the receiver is in a subcooled liquid state.

11. The air conditioner of claim 7, wherein the refrigerant circuit further comprises:

a subcooler configured to subcool a main refrigerant by performing a heat exchange between the main refrigerant condensed by the condenser, where the main refrigerant subcooled by the subcooler is decompressed by a subcooling pressure-reducing valve.

12. The air conditioner of claim 11, wherein the receiver further comprises:

at least one refrigerant amount detection device including circuitry and configured to detect an amount of refrigerant in the receiver.

13. The air conditioner of claim 1, further comprising:

an auxiliary unit configured to connect an outdoor unit provided with the compressor and the condenser, to an indoor unit provided with the evaporator, the auxiliary unit being detachably attached to a pipe of the refrigerant circuit, and wherein the auxiliary unit includes the refrigerant amount detection device.

14. The air conditioner of claim 13, wherein the auxiliary unit further comprises:

a refrigerant injection valve configured to control a refrigerant pipe of the auxiliary unit when the calculated refrigerant amount ratio reaches 100% during charging the refrigerant to the refrigerant circuit.

15. The air conditioner of claim 13, wherein the auxiliary unit further comprises:

a refrigerant storage container configured to store a charging refrigerant and a refrigerant injection valve configured to control the refrigerant supplied from the refrigerant storage container, wherein the controller controls the refrigerant injection valve when an average value of refrigerant amount ratio reaches 100% during charging the refrigerant.

16. The air conditioner of claim 15, wherein the auxiliary unit further comprises:

an auxiliary heat exchanger configured to perform a heat exchange with an external heat source that provides heat other than the air conditioner.

17. The air conditioner of claim 16, wherein the auxiliary unit further comprises a receiver configured to store a surplus refrigerant present in a pipe of the auxiliary unit in the subcooled state; and a flow controller configured to reduce the pressure of the refrigerant discharged from the receiver while adjusting a flow rate of the refrigerant.

18. A control method of air conditioner including a refrigerant circuit including a compressor, a condenser, an expansion valve and an evaporator, comprising:

determining whether a refrigerant state in an outlet of the condenser is in a subcooled state or a gas-liquid two phase state based on a set value;

calculating a refrigerant amount ratio in the refrigerant circuit based on the determined refrigerant state and at least one of a temperature and a pressure detected in the refrigerant circuit; and controlling the refrigerant circuit based on the refrigerant amount ratio.

19. The method of claim 18, further comprising:

calculating an average value of the refrigerant amount ratio based on the calculated refrigerant amount ratio.

20. The method of claim 19, wherein the refrigerant circuit comprises:

a first temperature sensor configured to detect a first refrigerant temperature in the outlet of the condenser, and a second temperature sensor configured to detect a second refrigerant temperature of the refrigerant at a position downstream from a fluid resistance installed in the outlet side of the condenser, wherein the determining comprises determining whether the refrigerant states is in the subcooled state or the gas-liquid two phase state based on the first refrigerant temperature and the second refrigerant temperature.

* * * * *